US006846062B2

(12) United States Patent
Harada et al.

(10) Patent No.: US 6,846,062 B2
(45) Date of Patent: Jan. 25, 2005

(54) INK JET RECORDING APPARATUS AND CLEANING CONTROL METHOD FOR RECORDING HEAD INCORPORATED THEREIN

(75) Inventors: Shuhei Harada, Nagano (JP); Hisashi Miyazawa, Nagano (JP); Hitoshi Hayakawa, Nagano (JP); Atsushi Kobayashi, Nagano (JP); Hitotoshi Kimura, Nagano (JP); Yoshiharu Aruga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/247,655

(22) Filed: Sep. 20, 2002

(65) Prior Publication Data

US 2003/0016265 A1 Jan. 23, 2003

Related U.S. Application Data

(63) Continuation of application No. 09/545,834, filed on Apr. 10, 2000.

(30) Foreign Application Priority Data

| | | |
|---|---|---|
| Apr. 8, 1999 | (JP) | 11-101764 |
| Jun. 17, 1999 | (JP) | 11-171258 |
| Jun. 17, 1999 | (JP) | 11-171259 |
| Sep. 7, 1999 | (JP) | 11-253506 |
| Oct. 15, 1999 | (JP) | 11-294400 |
| Mar. 10, 2000 | (JP) | 2000-67389 |

(51) Int. Cl.[7] ..... B41J 2/165
(52) U.S. Cl. ..... 347/30; 347/92
(58) Field of Search ..... 347/30, 29, 92

(56) References Cited

U.S. PATENT DOCUMENTS

| | | | | |
|---|---|---|---|---|
| 4,460,905 A | | 7/1984 | Thomas | |
| 4,602,662 A | | 7/1986 | Eremity et al. | |
| 5,086,305 A | | 2/1992 | Terasawa | |
| 5,126,766 A | * | 6/1992 | Terasawa et al. | 347/30 |
| 5,851,004 A | | 12/1998 | Wu et al. | |

FOREIGN PATENT DOCUMENTS

| | | |
|---|---|---|
| EP | 0 585 901 A2 | 3/1994 |
| JP | 2-3832 U | 1/1990 |
| JP | 3268948 | 11/1991 |
| JP | 5131645 | 5/1993 |
| JP | 7032601 | 2/1995 |
| JP | 10202910 | 8/1998 |
| JP | 2822586 | 9/1998 |

OTHER PUBLICATIONS

JP Office Action for JP App. No. 171258 mailed Feb. 10, 2004.

English language abstract 4–1055(A) Jul. 6, 1992.

* cited by examiner

*Primary Examiner*—Stephen D. Meier
*Assistant Examiner*—Ly T Tran
(74) *Attorney, Agent, or Firm*—Sughrue Mion, PLLC

(57) ABSTRACT

A valve unit 36 is placed in an ink flow passage 35 between an ink cartridge 8 and a recording head 7 and can be controlled in association with the cleaning operation of the recording head 7. Under the control of a drive controller, the valve unit 36 holds for a predetermined time a state in which negative pressure produced by a suction pump is accumulated, and is opened after the expiration of the predetermined time or is opened with the negative pressure accumulated and driving the suction pump is continued. The air bubbles remaining in a stuck state in the ink flow passage can be peeled from the ink flow passage together with an instantaneous fast ink flow produced as the valve unit 36 is opened, and the peeled air bubbles can be discharged effectively from the ink flow passage following the subsequent ink flow.

3 Claims, 39 Drawing Sheets

INK JET RECORDING APPARATUS AND CLEANING CONTROL METHOD FOR RECORDING HEAD INCORPORATED THEREIN

This is a continuation of application Ser. No. 09/545,834 filed Apr. 10, 2000; the disclosure of which is incorporated herein by reference.

BACKGROUND OF THE INVENTION

This invention relates to an ink jet recording apparatus comprising a recording head moving in a width direction of recording paper for jetting ink drops toward recording paper based on print data, thereby printing an image on the recording paper and a control technique of cleaning of the recording head for sucking ink from nozzle orifices of the recording head of the recording apparatus for recovering the print function of the recording head.

An ink jet recording apparatus, which produces comparatively small noise at the printing time and moreover can form small dots at a high density, is much used for printing including color printing in these days.

Such an ink jet recording apparatus comprises an ink jet recording head for receiving supply of ink from an ink storage section of an ink cartridge mounted on a cartridge, a subtank, etc., and paper feeder for causing recording paper to make a relative move to the recording head. While moving the recording head on the carriage in a width direction of recording paper, the ink jet recording apparatus ejects ink drops to the recording paper for recording.

The recording head capable of jetting black ink and yellow, cyan, and magenta color inks is placed on the carriage and makes it possible to execute not only text printing in black ink, but also full color printing by changing the jet percentage of the inks.

Since ink pressurized in a pressure generating chamber is jetted to recording paper as ink drops from a nozzle for printing, the recording head involves a problem of causing a print failure because of a rise in the ink viscosity and hardening of ink caused by vaporization of a solvent from nozzle orifices, for example, adhesion of dust, mixing of air bubbles, etc.

Thus, if the nozzle orifice is clogged or the ink cartridge is replaced, the nozzle formation face of the recording head is sealed by capping unit and ink is sucked and discharged from the nozzle orifice by negative pressure from a suction pump, whereby clogging caused by ink hardening in the nozzle orifice, etc., and an ink jet failure caused by mixing air bubbles into an ink flow passage are dissolved. This function is called cleaning operation.

To execute the cleaning operation, it is effective to cause a flow as fast as possible to occur in ink in the ink flow passage from the ink storage section to the nozzle orifices of the recording head, for example, whereby the air bubbles existing in the flow passage as well as the ink having increased viscosity can be discharged.

However, to increase the flow velocity of ink at the cleaning operation time, the capability of the suction pump needs to be increased to provide large negative pressure.

To do this, the pump must be upsized and a large-sized motor for driving the pump must also be used; it is inevitable to increase the costs and upsize the whole recording apparatus.

Then, a recording apparatus having the following configuration is proposed. A valve unit that can be opened and closed is placed in the ink flow passage between an ink storage section and a recording head and to perform cleaning operation, when sucking ink is started through capping unit, the valve unit is closed and when negative pressure in the capping unit rises, the valve unit is opened, whereby the flow velocity of ink in the recording head is increased instantaneously.

The described configuration makes it possible to comparatively easily discharge ink hardened or having increased viscosity in the proximity of the nozzle of the recording head without providing a special suction pump for producing large negative pressure.

Since the suction action from the nozzle is performed instantaneously, it is also made possible to produce the cleaning effect in a comparatively small discharge amount of ink as a result.

By the way, the ink cartridge of the ink storage section for supplying ink to the recording head generally has an outer case made of a material of polypropylene, etc., into which a porous substance is loaded for retaining ink. When the ink cartridge is shipped, it is deaerated, whereby the replacement load property (reliability of the operation of the recording apparatus when the ink cartridge is replaced and a new one is loaded) can be provided.

After the deaerated ink cartridge is loaded into the recording apparatus, the atmosphere gradually flows into the ink cartridge through an opening made in the top face of the ink cartridge as ink is consumed. Thus, the deaeration degree of ink in the ink cartridge lowers.

While a sufficient deaeration degree in the ink cartridge is provided, if ink is sucked by the capping unit, air bubbles smaller than the nozzle diameter occurring in the cap flow backward into the head flow passage by negative pressure of the ink cartridge, but disappear because the air bubbles are smaller than the critical radius.

While a sufficient deaeration degree in the ink cartridge is provided, minute air bubbles in the ink flow passage also dissolve in ink; consequently, the probability that a print failure will be caused by dot dropouts caused by air bubbles is low.

However, if the deaeration degree of ink in the ink cartridge lowers, the capability of dissolving minute air bubbles also lowers, so that the effect of air bubbles is received and a problem of a print failure, etc., occurs.

Then, when the cleaning operation of the recording head is performed, negative pressure is applied over a predetermined time, whereby the deaeration degree of ink in the recording head can be raised and the air bubbles produced by the deaeration action from ink grow with other air bubbles in one body, then the air bubbles are pushed out in a stroke by the ink flow.

In a recording apparatus as described above, generally ink cartridges containing black ink and color inks can be attached onto a carriage on which a recording head is placed detachably from above the carriage, and ink is supplied from each ink cartridge to the recording head via a hollow ink supply needle (also called hollow needle) placed upward on the carriage.

In the recording apparatus, the ink flow passage in the recording head is formed very delicately and therefore ink supplied from the ink cartridge to the recording head needs to be in a clean state with no foreign substances of dust, etc., mixed.

That is, if a foreign substance of dust, etc., is mixed, a particularly narrow ink supply port in the ink flow passage of the recording head or a nozzle orifice portion is clogged with the foreign substance, so that the normal ink jetting action cannot be executed and it is made impossible to recover the recording head function in many cases.

Then, generally a filter member for removing foreign substances is placed in the ink flow passage upstream from the recording head, for example, between the hollow needle and a head case supporting the hollow needle, thereby preventing foreign substances from entering the recording head.

FIG. 43 shows the situation in a cross-sectional state. In the figure, numeral 431 denotes a hollow needle on which an ink cartridge 408 is placed for deriving ink stored in the ink cartridge.

The upper end part of the hollow needle 431 is sharpened and an ink derivation hole 431*a* is made in a part of the upper end part. The hollow needle 431 closely joined to a rubber sealing member 408*b* attached to the ink cartridge 408 allows ink to derive from the ink cartridge 408 through the ink derivation hole 431*a*.

The base end part of the hollow needle 431 is widened to the bottom end and a tapered space 431*b* is formed in the part.

On the other hand, a space 471*a* is also formed on the side of a head case 471 of the recording head to which the base end part of the hollow needle 431 is attached, and a filter member 407*d* is placed between the base end part of the hollow needle 431 sandwiching the spaces.

The spaces are thus provided above and below the filter member 407*d* with the filter member 407*d* between, whereby the area of the filter member 407*d* is made effectively wide for suppressing dynamic pressure (pressure loss) of the filter member 407*d*.

As understood from the configuration shown in FIG. 43, in a state in which the ink flow passage formed in the hollow needle 431 and the filter member 407*d* are placed in a gravity direction, a phenomenon in which an air bubble A remains particularly in the tapered space 431*b* formed in the hollow needle 431 on the top of the filter member 407*d* occurs, for example, at the initial loading time of first loading ink into the flow passage of the recording head.

When the ink cartridge is replaced, a phenomenon in which air bubble A enters the space 431*b* on the top of the filter member 407*d* and remains in a stuck state in the space 431*b* also occurs.

On the other hand, if printing is executed with the air bubble A remaining as described above and the printing state is full duty (state in which ink is jetted at the highest frequency at the same time from all nozzle orifices), the air bubble A remaining upstream from the filter member 407*d* moves slowly to the proximity of the filter member 407*d* together with the ink flow and remains like flat on the top of the filter member 407*d*, resulting in a state in balance with the flow velocity of ink.

If the full-duty printing is further continued, a part of the air bubble A passes through the filter member 407*d*, reaches the ink flow passage in the recording head, and remains therein.

If such a state is entered, the air bubble in the recording head produces so-called cushion action of absorbing pressure change occurring in a pressure chamber based on print data, causing a problem in which it becomes impossible to jet ink from the recording head.

Then, the cleansing operation is executed to exclude the air bubble, as described above. If the valve unit is opened when the negative pressure in the capping unit rises as described above, the flow velocity of ink in the recording head is increased instantaneously, so that the air bubble A is released from the stuck state in the hollow needle 431 and is brought close to the filter member 407*d* or brought into intimate contact with the filter member 407*d*, but is not excluded since the negative pressure accumulated in the capping unit also lowers at once; this is a problem.

In this case, a part of the air bubble passes through the filter member 407*d* and can stay in the ink flow passage in the recording head, also causing a problem in which it becomes impossible to jet ink from the recording head, as described above.

It is therefore the first object of the invention to provide an ink jet recording apparatus and a recording head cleaning control method in the ink jet recording apparatus wherein at the cleaning operation time, a valve unit placed in an ink flow passage between an ink cartridge and nozzle orifices of a recording head is opened for instantaneously increasing the flow velocity of ink and the wait time for promoting the deaeration action is preset, whereby ink having increased viscosity can be discharged and removed and the air bubbles in the ink flow passage can be discharged easily.

It is therefore the second object of the invention to provide an ink jet recording apparatus provided with a cleaning sequence capable of discharging and removing ink having increased viscosity and effectively discharging air bubbles remaining in upper and lower spaces with a filer member between in an ink flow passage and a recording head cleaning control method in the ink jet recording apparatus.

SUMMARY OF THE INVENTION

In order to achieve the above objects, according to a first aspect of the invention, there is provided an ink jet recording apparatus comprising:

an ink jet recording head having nozzle orifices from which inkdrops are ejected;

an ink storage unit for storing ink to be supplied to the recording head;

an ink flow passage communicating the ink storage unit and the recording head;

a valve unit for opening/closing the ink flow passage;

a capping unit for sealing the nozzle orifices;

a suction pump for reducing pressure in an internal space of the capping unit to discharge inkdrops from the nozzles when the capping unit seals the nozzle orifices; and a control unit for controlling the valve unit, the capping unit and the suction pump in such order that:

a) the valve unit closes the ink flow passage;

b) the capping unit seals the nozzle orifice;

c) the suction pump decompresses the internal space of the capping unit; and d) the valve unit opens the ink flow passage a predetermined time period elapses.

Preferably, the control unit controls the valve unit such that the ink flow passage is opened after a predetermined time period has elapsed since the suction pump was stopped driving.

Preferably, the ink jet recording apparatus further comprises a filter member disposed in the ink flow passage.

A cleaning control method for the above ink jet recording apparatus comprises the steps of:

sealing the nozzle orifices by the capping unit;

closing the ink flow passage by the valve unit;

driving the suction pump to decompress the internal space of the capping unit;

holding the decompressed state for a predetermined time period; and opening the ink flow passage by the valve unit.

Here, the sealing step and the closing step may be executed synchronously or exchangeably.

Preferably, the predetermined time period is defined as either a time period required for obtaining a satisfactory deaeration degree of ink between the valve unit and the nozzle orifices, or a time period required for accumulating air bubbles therein.

According to the ink jet recording apparatus according to the first aspect of the invention or the recording head cleaning control method in the ink jet recording apparatus, the valve unit is placed in the ink flow passage between the ink cartridge and the nozzle orifices and is opened and closed in association with the cleaning operation of sucking ink drops from the nozzle orifices by the capping unit.

The valve unit is opened with the negative pressure accumulated, whereby it is made possible to efficiently discharge the air bubbles entering the recording head, for example, when the ink cartridge is replaced, together with a fast ink flow.

Moreover, the valve unit drive controller holds the state in which the negative pressure is accumulated for the predetermined time and opens the valve unit after the expiration of the predetermined time, so that the air bubbles produced by the deaeration action from ink as the negative pressure is applied for the predetermined time grow with other air bubbles in one body and are pushed out in a stroke because of the ink flow.

In this case, sufficient negative pressure is applied to the inside of the capping unit, whereby the air bubbles can be moved quickly and be discharged from the nozzle orifices; consequently, the ink discharge amount can be reduced.

Next, according to a second aspect of the invention, there is provided an ink jet recording apparatus comprising:

an ink jet recording head having nozzle orifices from which inkdrops are ejected;

an ink storage unit for storing ink to be supplied to the recording head;

an ink flow passage communicating the ink storage unit and the recording head;

a valve unit for opening/closing the ink flow passage;

a capping unit for sealing the nozzle orifices;

a suction pump for decompressing an internal space of the capping unit to discharge inkdrops from the nozzles when the capping unit seals the nozzle orifices; and a control unit for controlling the valve unit, the capping unit and the suction pump in such order that:

a) the valve unit closes the ink flow passage;

b) the capping unit seals the nozzle orifice;

c) the suction pump decompresses the internal space of the capping unit;

d) the valve unit opens the ink flow passage a first predetermined time period elapses; and e) the suction pump continues decompressing the internal space of the capping unit for a second predetermined time period.

According to a third aspect of the invention, there is provided an ink jet recording apparatus comprising a control unit for controlling the valve unit, the capping unit and the suction pump in such order that:

a) the capping unit seals the nozzle orifice;

b) the suction pump decompresses the internal space of the capping unit;

c) the valve unit closes the ink flow passage after a first predetermined time period elapses;

d) the valve unit opens the ink flow passage a second predetermined time period elapses; and e) the suction pump continues decompressing the internal space of the capping unit for a third predetermined time period.

Preferably, according to the second or third aspect of the invention, the ink jet recording apparatus further comprises a filter member disposed in the ink flow passage.

A cleaning control method for the ink jet recording apparatus according to the second aspect of the invention comprises the steps of:

sealing the nozzle orifices by the capping unit;

closing the ink flow passage by the valve unit;

driving the suction pump to decompress the internal space of the capping unit;

holding the decompressed state for a first predetermined time period; and opening the ink flow passage by the valve unit while driving the suction pump.

Here, the sealing step and the closing step may be executed synchronously or exchangeably.

A cleaning control method for the ink jet recording apparatus according to the third aspect of the invention comprises the steps of:

sealing the nozzle orifices by the capping unit;

driving the suction pump to decompress the internal space of the capping unit;

closing the ink flow passage by the valve unit;

holding the decompressed state for a first predetermined time period; and opening the ink flow passage by the valve unit while driving the suction pump.

To adopt the cleaning control method in the ink jet recording apparatus according to the second or third aspect of the invention, preferably the method further comprises the step of stopping to drive the suction pump after a second predetermined time period has elapsed since the ink flow passage was opened.

Preferably, the method further comprises the step of driving the suction pump between the sealing step and the closing step.

Preferably, the method further comprises the step of driving the suction pump again after the stopping step has executed.

Preferably, the method further comprises the steps of:

releasing the capping unit from the nozzle orifices after the suction pump has driven again; and driving the suction pump again to discharge ink from the nozzle orifices in a capping released state.

According to the ink jet recording apparatus adopting the control method, the valve unit placed in the ink flow passage between the ink cartridge and the nozzle orifices, for example, as ink storage means is closed in association with the cleaning operation of sucking ink drops from the nozzle orifices by the capping unit.

Then, the valve unit is opened in the state in which negative pressure is accumulated by driving the suction pump, whereby a fast ink flow can be generated instantaneously in the ink flow passage, whereby the air bubbles remaining in a stuck state in the ink flow passage can be peeled from the ink flow passage.

At this time, the control sequence of continuing the drive state of the suction pump over the predetermined time is executed after the opening operation of the valve unit, whereby the air bubbles peeled from the ink flow passage based on the instantaneous fast ink flow can be discharged together with a continuous ink flow.

The other features preferably applied to the ink jet recording apparatus according the first to third aspects of the invention will be discussed below.

Preferably, the ink storage unit is an ink cartridge mounted on a carriage for moving the recording head. The valve unit includes a valve body made of an elastic material through which the ink flow passage. The ink flow passage is closed by deforming the valve body with an external force.

Accordingly, the ink flow passage can be easily opened and closed by the valve body; for example, the valve body is opened in a state in which the valve body is closed and negative pressure is supplied by the capping unit, whereby a strong ink flow can be generated in the ink flow passage.

Therefore, the air bubbles remaining in the head filter upstream from each ink flow passage and the level difference part of the ink flow passage can be reliably discharged together with the ink flow.

Moreover, a higher negative pressure state can be provided without using a high-capability suction pump, and a high-capability drive pump need not be used.

Consequently, the ink jet recording apparatus can be manufactured at lower costs.

Further, according to the invention, there is provided an ink suction method in the described ink jet recording apparatus, comprising the steps of:

closing the ink flow passage by the valve unit;

sealing the nozzle orifices by the capping unit;

driving the suction pump to decompress the internal space of the capping unit; and opening the ink flow passage by the valve unit to discharge ink from the nozzle orifices.

Since the valve opening step of opening the valve unit is executed after negative pressure is raised at the suction step, a strong ink flow can be generated in the ink flow passage.

Therefore, the air bubbles remaining in the head filter upstream from each ink flow passage and the level difference part of the ink flow passage can be reliably discharged together with the ink flow, as described above.

Preferably, the method further comprises the steps of:

moving the carriage to the predetermined position to drive the valve unit such that the ink flow passage is closed to prevent the discharged ink and air bubbles from flowing back to the nozzle orifices; and cleaning the nozzle orifices.

Since the step of placing the valve unit in a closed valve state is executed before the step of cleaning the nozzle orifices of the recording head is executed, a backflow into which ink or an air bubble discharged to the nozzle orifices of the recording head is again pulled can be prevented.

Preferably, the ink flow passage in the valve body has a cross sectional shape which is asymmetric with respect to a first line extending perpendicular to a direction of which the external force is applied.

Thus, the valve body is an elastic substance in which an ink flow passage is provided, and is closed as the elastic substance is deformed by external pressure, and in addition, if the external pressure is removed, the valve body is opened because of the restoration force of the elastic member, so that the valve body can be opened and closed in a comparatively simple structure. Since the ink supply passage in the valve body is shaped like the above-mentioned form, the valve body becomes easily by a small external force and the ink flow passage can be closed completely.

Preferably, the valve unit includes a flexible diaphragm which constitutes a part of a side wall of the ink flow passage, and an actuation body for deforming the diaphragm in a direction perpendicular to the ink flow passage for opening/closing the ink flow passage.

Preferably, a convex is formed on one face of the diaphragm and the actuation body deforms the diaphragm such that the convex closes the ink flow passage.

Preferably, the actuation body is a rod member to press a portion on the other face of the diaphragm where is opposed to the convex.

According to the configuration, the valve unit comprising the diaphragm closes the communicating hole forming the ink flow passage to the recording head at the center upon reception of press pressure of an actuator as the actuation body.

Particularly, the annular convex formed at almost the center of the diaphragm closes the communicating hole to the recording head, so that the convex forms a flexible seal face and the reliable valve opening and closing operation can be executed in accordance with the linear move operation of the actuation body.

According to the configuration, if negative pressure is applied with the recording head capped, the diaphragm receives the negative pressure, the sealability in the closed valve state is furthermore enhanced, and the reliable valve closing function is maintained.

The diaphragm can extremely lessen volume change of the recording head involved in the operation of opening and closing the valve and a problem of destroying a meniscus of ink formed in the nozzle orifices of the recording head can be circumvented.

Preferably, the valve unit includes:

a flexible diaphragm having a through hole which constitutes a part of the ink flow passage;

an actuation body for deforming the diaphragm in a direction of which the through hole extends while closing one opening of the through hole; and a wall member for closing the other opening of the through hole when the diaphragm is deformed by the actuation body to close the ink flow passage.

Preferably, the through hole is formed on a substantial center portion of the diaphragm.

Preferably, the wall member is arranged an upstream side of the ink flow passage with respect to the diaphragm to constitute a check valve.

Preferably, the actuation body includes a spring member for normally urging the diaphragm toward the wall member. A predetermined or more pressure difference between an upstream side and a downstream side of the ink flow passage with respect to the diaphragm moves the actuation body to open the ink flow passage.

The through hole is abutted against the wall part by press pressure of an actuator as the actuation body, whereby the valve unit is placed in a closed valve state.

Therefore, the reliable valve opening and closing operation can be executed in accordance with the linear move operation of the actuation body like the valve unit comprising the diaphragm.

Particularly, the spring member for normally urging the diaphragm to the wall part side is placed, so that check valve is formed, and the function as a pressure regulating valve for placing the valve unit in an open valve state based on the pressure difference between the upstream and downstream sides of the diaphragm can also be provided. The flow passage can be opened in response to slight ink consumption during the print operation for supplying ink to the recording head without imposing excessive load on the recording head.

Preferably, the valve unit includes:

a valve control chamber which constitutes a part of the ink flow passage;

a flexible diaphragm which constitute a bottom wall of the valve control chamber;

an actuation body for deforming a center portion of the diaphragm in a direction perpendicular thereto.

Preferably, the valve control chamber has an entrance port formed on a top wall thereof at a portion where is away from the center portion of the diaphragm, and an exit port formed on the top wall at right above the center portion of the diaphragm.

Preferably, the entrance port is arranged below the exit port.

Preferably, the circumferential portion of the exit port is tapered such that a diameter of the port is reduced toward the above.

Preferably, the diaphragm includes an annular convex on the center portion thereof for sealing the exit port when the diaphragm is deformed by the actuation body.

Preferably, an annular groove is formed so as to surround the exit port, against which the annular convex is to be abutted. An outer peripheral wall of the groove is tapered such that a diameter of thereof is reduced toward the above.

Preferably, a distance between the annular convex and the annular groove is 1.0–1.3 mm when the ink flow passage is opened.

Preferably, a cross sectional area of the ink flow passage between the exit port and the recording head becomes larger as further from the exit port.

Preferably, the actuation body is a rod member arranged below the diaphragm.

According to the configuration, the diaphragm valve is opened in the state in which negative pressure is given to the nozzle formation face of the recording head by the capping unit, whereby a fast ink flow can be generated instantaneously in the ink flow passage from the ink storage section to the nozzle orifices of the recording head.

Since the valving control chamber of the ink flow passage from the ink storage section to the recording head is formed on the top side of the diaphragm in the gravity direction, the air bubbles remaining in the valving control chamber can be effectively discharged together with the fast ink flow.

In addition, the exit port from the valving control chamber to the recording head is formed just above almost the center of the diaphragm valve and the slope whose diameter lessens toward the anti-gravity direction is furthermore formed in the surrounding of the exit port, whereby the air bubbles remaining in the valving control chamber can be guided into the vicinity of the exit port by the float action.

Therefore, according to the configuration, the air bubbles in the valving control chamber can also be effectively discharged in the normal ink flow and the most of the feature that the air bubbles are hard to remain can be made.

Further, since the ink flow velocity can be increased instantaneously as described above, it is made possible to enhance the discharge effect of the remaining air bubbles still more.

Since the annular convex formed almost at the center of the diaphragm valve facing the side of the valving control chamber closes the exit port from the valving control chamber to the recording head, the annular convex forms a flexible seal face and the reliable valve opening/closing operation can be provided following the linear move operation of the actuation body.

According to the configuration, if negative pressure is applied with the recording head capped, the diaphragm valve receives the negative pressure, the sealability in the closed valve state is furthermore enhanced, and the reliable valve closing function is maintained.

The diaphragm valve makes it possible to extremely lessen volume change of the recording head involved in the operation of opening and closing the valve and a problem of destroying a meniscus of ink formed in the nozzle orifices of the recording head can be circumvented.

Preferably, the ink storage unit includes an air hole communicating with atmosphere, and an air valve for opening/closing the air hole. When pressure in the ink storage unit reaches for a predetermined value under a condition that both of the air hole and the ink flow passage is closed, the air hole is opened prior to the ink flow passage.

Since the air introduction port is closed by the air introduction valve and the ink flow passage is closed by the valve unit, the ink storage section can be hermetically sealed, evaporation of a solvent of ink can be prevented, and an increase in viscosity of ink can be suppressed.

Moreover, if the pressure in the ink storage section becomes the predetermined pressure or more or the predetermined pressure or less, the air introduction valve is opened preceding the valve unit. Thus, if the outside temperature rises and the pressure in the subtank becomes high because of expansion of ink or air or if the outside temperature lowers and the pressure in the subtank becomes low, breakage of the ink storage section can be prevented.

Ink drips from the recording head or inflow of air from the recording head can also be prevented.

Preferably, the ink flow passage is still closed even if the air hole is opened.

Since the valve unit is also maintained closed if the air introduction valve is opened preceding the valve unit, ink drips from the nozzle of the recording head, etc., can be prevented.

Preferably, a force for closing the air hole is weaker than a force for closing the ink flow passage to discharge internal air of the ink storage unit when pressure inside the ink storage unit is varied due to temperature rising.

According to the configuration, the air introduction valve can be opened preceding the valve unit for lowering the raised pressure in the ink storage section.

Preferably, external air is introduced from the air hole when pressure inside the ink storage unit is varied due to temperature dropping.

According to the configuration, the air introduction valve can be opened preceding the valve unit for raising the pressure in the ink storage section.

Preferably, the ink storage unit may be an ink cartridge or a subtank to which a main tank replenishes ink.

Preferably, the air valve is a check valve.

Preferably, the ink storage unit includes:

a main tank;

a subtank communicated with the main tank via an ink replenishment passage;

a main tank connection unit detachably provided with an ink replenishment passage;

a decompressor pump for decompressing inside of the subtank to replenish ink from the main tank;

a pump connection unit detachably provided with a suction passage connecting the subtank and the decompressor pump;

a first valve provided between the pump connection unit and the subtank for opening/closing the suction passage;

an air hole provided with the subtank which is opened to communicate with atmosphere when the ink jet recording apparatus executes printing; and an air valve for opening/closing the air hole.

Here, when pressure in the subtank reaches for a predetermined value, the suction passage is opened prior to the ink flow passage.

If the pressure in the ink storage section becomes the predetermined pressure or more or the predetermined pressure or less, the valve provided on the subtank side of the pump connecting unit is opened preceding the valve unit. Thus, if the outside temperature rises and the pressure in the subtank becomes high because of expansion of ink or air or if the outside temperature lowers and the pressure in the subtank becomes low, breakage of the ink storage section can be prevented.

Ink drips from the recording head or inflow of air from the recording head can also be prevented.

Preferably, the ink flow passage is still closed even if the suction passage is opened.

Since the valve unit is also maintained closed if the valve being placed on the subtank side of the pump connecting unit is opened preceding the valve unit, ink drips from the nozzle of the recording head, etc., can be prevented.

Preferably, the air hole is opened prior to the ink flow passage when the pressure in the subtank exceeds the predetermined value, and the suction passage is opened prior to the ink flow passage when the pressure in the subtank lowers the predetermined value.

Preferably, the ink flow passage is still closed even if the suction passage or the air hole is opened.

Preferably, the ink storage unit includes a second valve detachably provided on the ink replenishment passage at least between the main tank connection unit and the subtank for opening/closing the ink replenishment passage.

Preferably, the second valve is opened according to a pressure difference between the inside and the outside of the subtank when the internal pressure of the subtank becomes a predetermined value or less.

Preferably, the air valve is opened according to a pressure difference between the inside and the outside of the subtank when the internal pressure of the subtank becomes a predetermined value or more.

Preferably, the first valve is opened according to a pressure difference between the inside and the outside of the subtank when the internal pressure of the subtank becomes a predetermined value or less.

Owing to the configuration, breakage of the ink storage section can be prevented, ink drips from the recording head or inflow of air from the recording head can also be prevented.

BRIEF DESCRIPTION OF THE DRAWINGS

In the accompanying drawings:

FIGS. 15A and 15B are side views and FIG. 15C is an enlarged view to show an ink flow passage;

DETAILED DESCRIPTION OF THE PREFERRED EMBODIMENTS

Referring now to the accompanying drawings, there are shown first to third embodiments of an ink jet recording apparatus adopting a recording head cleaning control method according to the invention in order.

Figure 23:
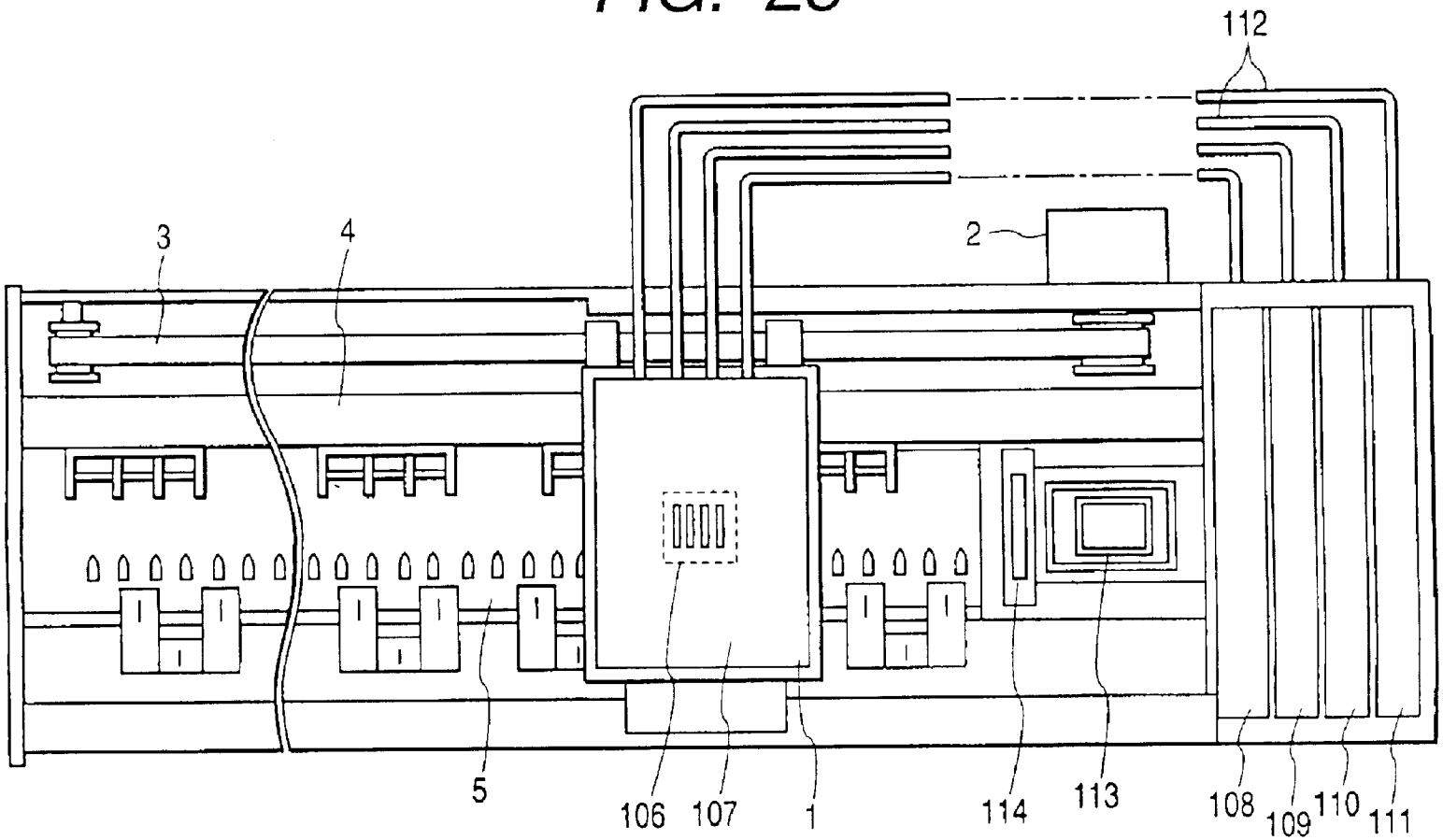
FIG. 23 is a top view to show a sixth embodiment of an ink jet recording apparatus that can incorporate the invention.

The invention can be applied to both a recording apparatus of a type wherein an ink cartridge placed on a carriage is used as an ink storage section (see FIG. 1) and a recording apparatus of a type wherein a separate main tank (ink cartridge) is placed in the main body of the recording apparatus and a subtank is mounted on a carriage (see FIG. 23). First, the invention will be discussed based on the recording apparatus of the former type.

Figure 1:
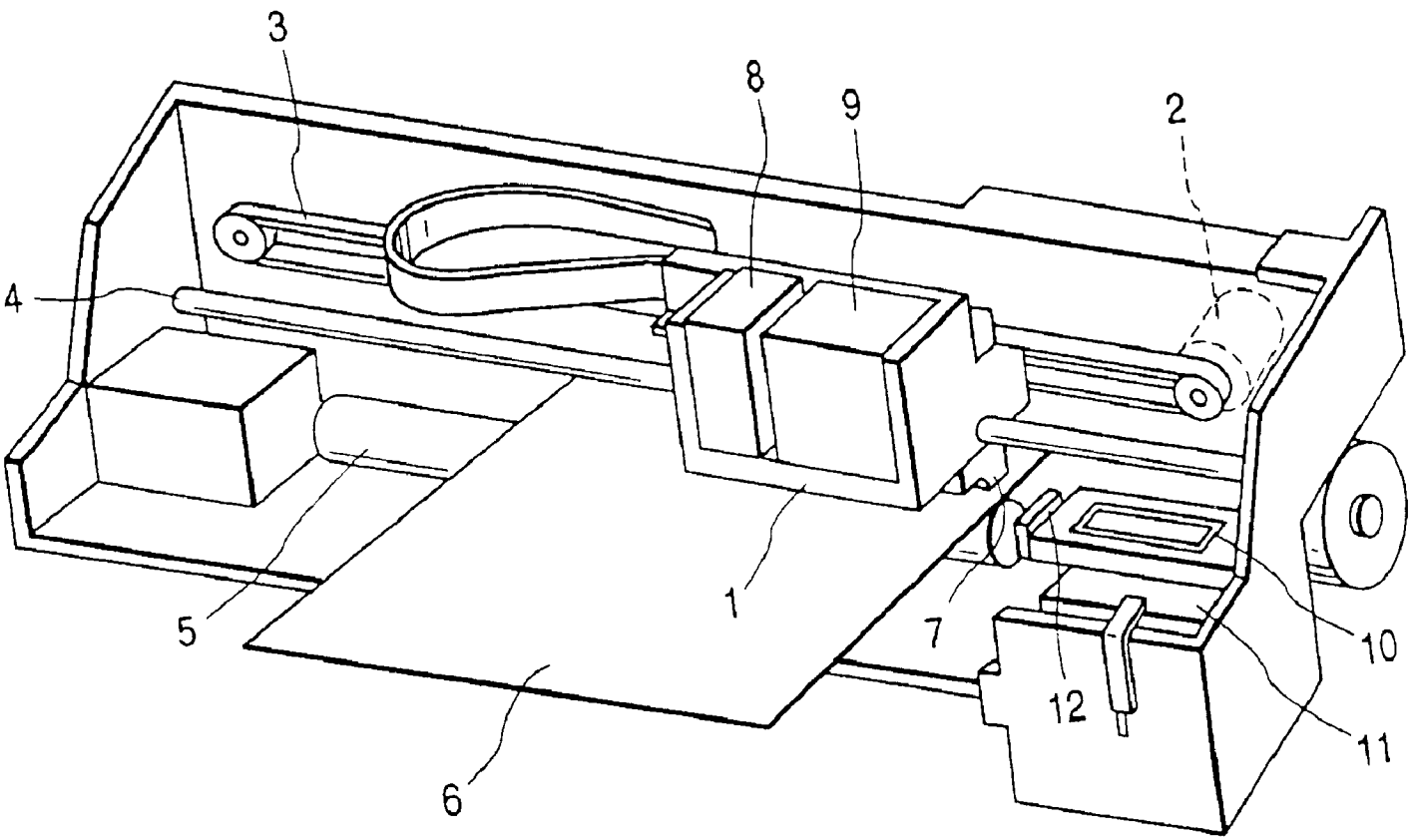
FIG. 1 is a perspective view to show the basic configuration of an ink jet recording apparatus.

FIG. 1 is a perspective view to show the basic configuration of an ink jet recording apparatus to which the first to third embodiments of the invention can be applied.

In the figure, numeral 1 denotes a carriage. The carriage 1 is guided by a guide shaft 4 and is reciprocated in the axial direction of a platen 5 via a timing belt 3 reciprocated by drive of a carriage motor 2.

A recording head 7 is mounted on the side of the carriage 1 facing recording paper 6 and a black ink cartridge 8 and a color ink cartridge 9 for supplying ink to the recording head 7 are placed detachably above the recording head 7.

In the figure, numeral 10 denotes capping unit placed at a home position of a non-print area. The capping unit 10 is formed as a size capable of sealing nozzle orifices made in a nozzle formation face of the recording head 7.

A suction pump 11 for giving negative pressure to the internal space of the capping unit 10 is placed below the capping unit 10.

The capping unit 10 can move up and down as the carriage 1 moves to the home position. It functions as a lid for preventing the nozzle orifices from being dried during the halt period of the recording apparatus, functions as an ink receptacle during the flushing operation of jetting ink drops by applying a drive signal not involved in print to the recording head, and functions as cleaning member for causing negative pressure from the suction pump 11 to act on the recording head 7 for sucking and discharging ink from the nozzle orifices of the recording head 7.

A wiping member 12 made of an elastic plate of rubber, etc., is placed contiguous to the capping unit 10 and projects to the move path of the recording head 7 as required for wiping the nozzle formation face of the recording head 7 after ink is sucked by the capping unit 10, for example.

Figure 2:
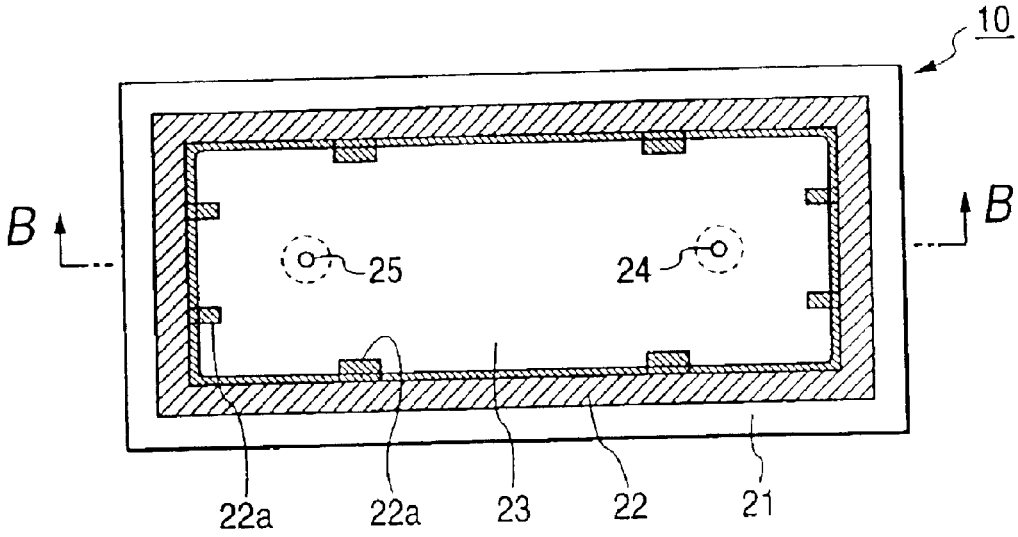
FIG. 2 is a top view of capping unit placed in the recording apparatus shown in FIG. 1.
Figure 3:
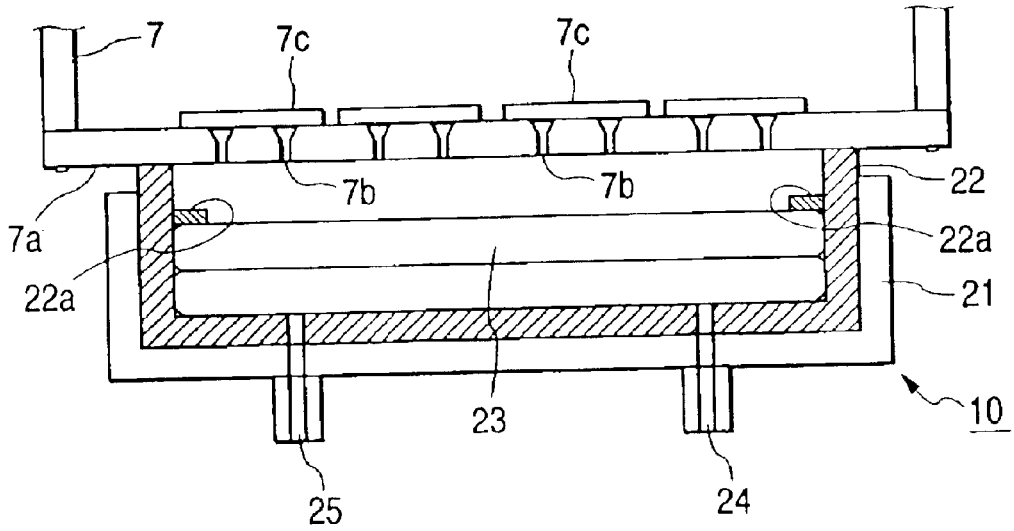
FIG. 3 is a sectional view of the capping unit taken on line B—B in FIG. 2.

Next, FIGS. 2 and 3 schematically show the capping unit 10.

FIG. 2 shows the capping unit 10 as a top view thereof and FIG. 3 is a sectional view taken on line B—B in FIG. 2 to show a state in which the capping unit 10 seals the recording head 7 shown in a cross-sectional state. In FIGS. 2 and 3, the capping unit 10 is made up of a quadrate cap case 21 opened on the top face and a cap member 22 placed in the cap case 21 and formed of an elastic member having ink resistance like a cap.

The cap member 22 is formed so that its upper margin projects a little from the cap case 21.

An ink absorber 23 made of a porous material excellent in ink resistance and ink absorbability is housed in the inner bottom part of the cap member 22.

The ink absorber 23 is retained in the cap member 22 by a plurality of retainers 22*a* projected in a horizontal direction, molded integrally with the cap member 22.

Further, an ink suction port 24 and an air hole 25 are placed so as to pierce the bottom parts of the cap case 21 and the cap member 22.

The ink suction port 24 and the air hole 25 are placed with a predetermined spacing therebetween along almost the center in the length direction of the capping unit 10 when the capping unit 10 is viewed from the top face.

The ink suction port 24 is connected to the suction pump 11 via a tube (not shown) and the air hole 25 is connected to an air valve 26 (described later) via a tube (not shown).

On the other hand, the capping unit 10 is moved up in association with a move of the carriage 1 to the home position, whereby it is placed in a capping state sealing a nozzle formation face 7*a* of the recording head 7 as shown in FIG. 3. The air valve 26 is also closed in association with a move of the carriage 1 to the home position.

The recording head 7 is formed with nozzle orifices 7*b* for separately jetting black, cyan, magenta, and yellow inks by the action of piezoelectric vibrators 7*c* placed corresponding to the nozzle orifices 7*b*.

Therefore, the air valve 26 connected to the air hole 25 in the capping unit 10 is closed and the suction pump 11 connected to the ink suction port 24 is operated, whereby negative pressure can be applied to the internal space of the capping unit 22.

Thus, the cleaning action of sucking and discharging ink from the nozzle orifices 7*b* in the recording head 7 is executed.

The air valve 26 connected to the air hole 25 is opened and the suction pump 11 is operated, whereby ink discharged into the capping unit 22 is sucked to the side of the suction pump 11 and the sucked ink can be discharged into a waste ink tank 27.

Figure 4B:
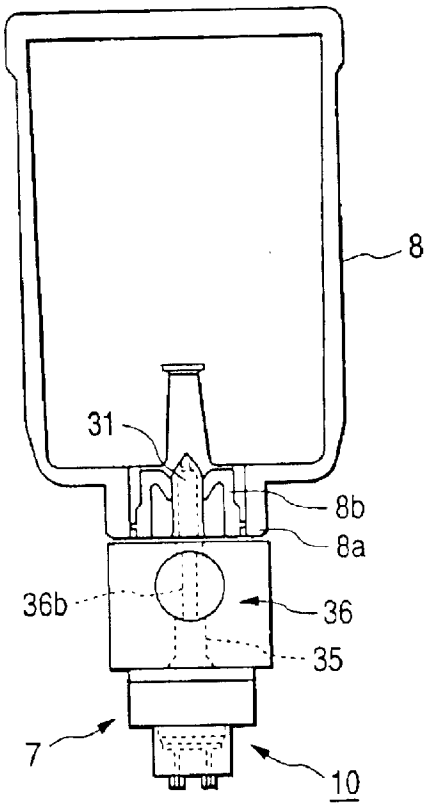
FIGS. 4A and 4B are sectional views to show a configuration example of a valve unit placed between a recording head and an ink cartridge.
Figure 4A:
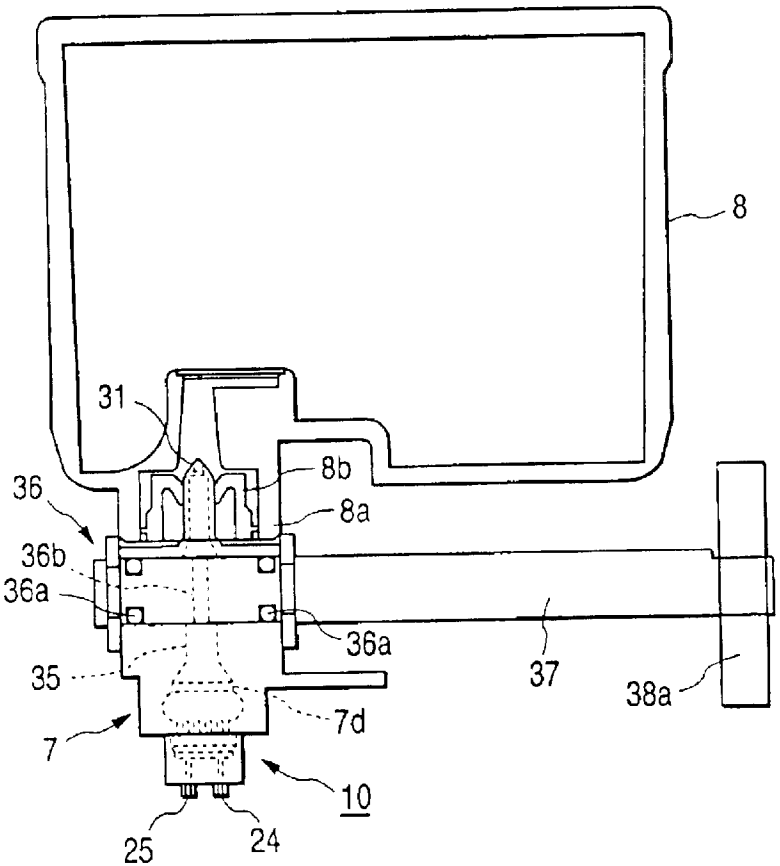

Next, FIGS. 4A and 4B show a configuration example of a valve unit 36 placed between the recording head 7 and the ink cartridge as the ink storage section (in the figure, the black ink cartridge 8).

FIGS. 4A and 4B are sectional views of the valve unit viewed from the orthogonal direction.

FIGS. 4A and 4B show a state in which the nozzle formation face of the recording head is sealed by the capping unit 10 moving up from below.

The ink cartridge 8 generally has a film member (not shown) put on an ink supply port 8*a* for preventing an ink solvent from volatilizing during storage.

To load a new ink cartridge 8 into the recording apparatus, the ink supply port 8*a* of the ink cartridge 8 is pointed downward facing a hollow ink supply needle 31 upright upward from the rear face of the recording head 7 and is pushed into, whereby the ink cartridge 8 can be loaded.

As the operation is performed, the ink supply needle 31 pierces the film member put on the ink supply port 8*a* and is brought into intimate contact with a rubber sealing member 8*b* placed in the ink cartridge 8 and is bonded to the sealing member 8*b*, whereby ink is supplied from the ink cartridge 8 to the recording head 7.

As shown in FIGS. 4A and 4B, the valve unit 36 for opening and closing an ink supply passage 35 between the ink cartridge 8 and the nozzle orifices of the recording head 7 is placed above the recording head 7.

In the valve unit 36 of the recording apparatus shown in FIGS. 4A and 4B, a shaft 37 inserted so as to cross the ink flow passage 35 can be rotated and hermeticity is held by a pair of O-rings 36*a*.

The part of the shaft 37 crossing the ink flow passage 35 is formed with an ink through hole 36*b* in a direction orthogonal to the axial direction of the shaft.

Therefore, a gear 38 placed on the shaft 37 is rotated by an actuator (not shown) and the ink through hole 36*b* and the ink flow passage 35 are aligned, whereby the valve unit 36 is opened, and the ink through hole 36*b* and the ink flow passage 35 are not aligned, whereby the valve unit 36 is closed.

A filter member 7*d* is placed in the ink flow passage 35 between the valve unit 36 and the nozzle orifices in the recording head 7.

As shown in FIG. 4A, the filter member 7*d* is placed just below the valve unit 36 for removing foreign substances existing in ink supplied from the ink cartridge 8. When foreign substances occur because of rotation of the valve unit 36, etc., the filter member 7*d* can prevent the foreign substances from entering the recording head 7 for preventing a print fault of the recording head 7 from occurring.

The valve unit 36 shown in FIGS. 4A and 4B opens and closes the ink flow passage 35 between the black ink cartridge 8 and the black ink nozzle orifices in the recording head 7, for example. Likewise, the valve unit 36 is also placed in each ink supply passage of cyan, magenta, and yellow supplied from the color ink cartridge 9.

The valve unit 36 is not limited to the specific one as shown in FIG. 4 and a value unit of any other configuration can be used, needless to say.

Figure 5:
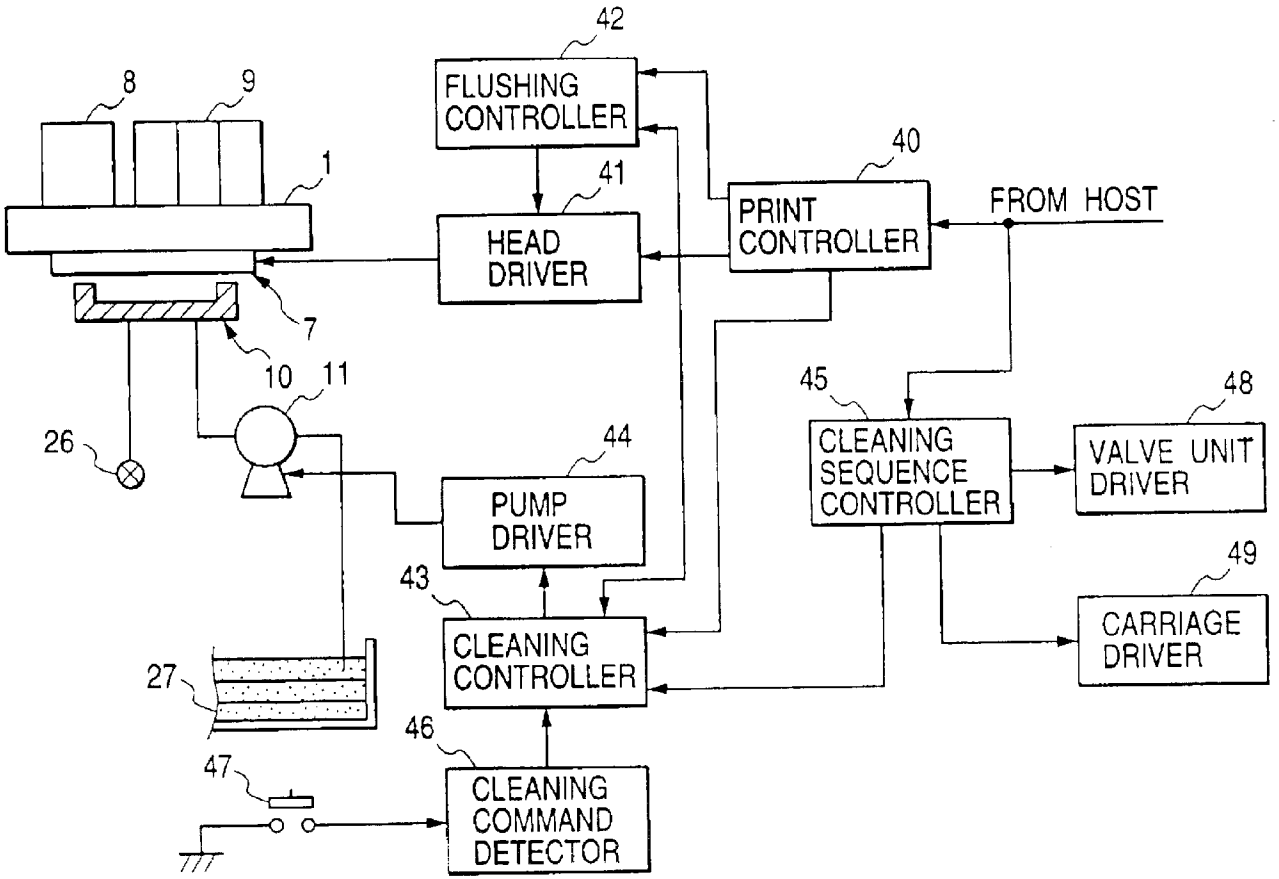
FIG. 5 is a block diagram to show an example of a control circuit installed in the recording apparatus according to the invention.

Next, FIG. 5 shows the configuration of a control circuit installed in the described recording apparatus. The carriage 1, the recording head 7, the ink cartridges 8 and 9, the capping unit 10, the suction pump 11, the air valve 26, and the waste ink tank 27 previously described with reference to FIGS. 1 to 4 are denoted by the same reference numerals in FIG. 5 and therefore will not be discussed again in detail.

In FIG. 5, numeral 40 denotes a print controller for preparing bit map data based on print data supplied from a host computer and causing a head driver 41 to generate a drive signal based on the bit map data for jetting ink from the recording head 7.

The head driver 41 also receives a flushing command signal from a flushing controller 42 in addition to the drive signal based on the print data and outputs a drive signal for flushing operation to the recording head 7.

Numeral 43 denotes a cleaning controller. A pump driver 44 operates in response to a command from the cleaning controller 43 for driving and controlling the suction pump 11.

A cleaning command signal is supplied to the cleaning controller 43 from the print controller 40, a cleaning sequence controller 45, and a cleaning command detector 46.

A command switch 47 is connected to the cleaning command detector 46. If the user pushes the command switch 47, for example, the cleaning command detector 46 is operated for executing manual cleaning operation.

Upon reception of a command signal from the host computer, the cleaning sequence controller 45 can send a control signal to the cleaning controller 43, a valve unit driver 48, and a carriage driver 49.

The valve unit driver 48 sends a control signal to the actuator for driving the gear 38 placed on the shaft 37 shown in FIG. 4 for opening or closing the valve unit 36. The carriage driver 49 drives the carriage motor 2 shown in FIG. 1 for moving the carriage 1 to the home position, for example, and causes the capping unit 10 to cap the recording head 7.

Figure 6:
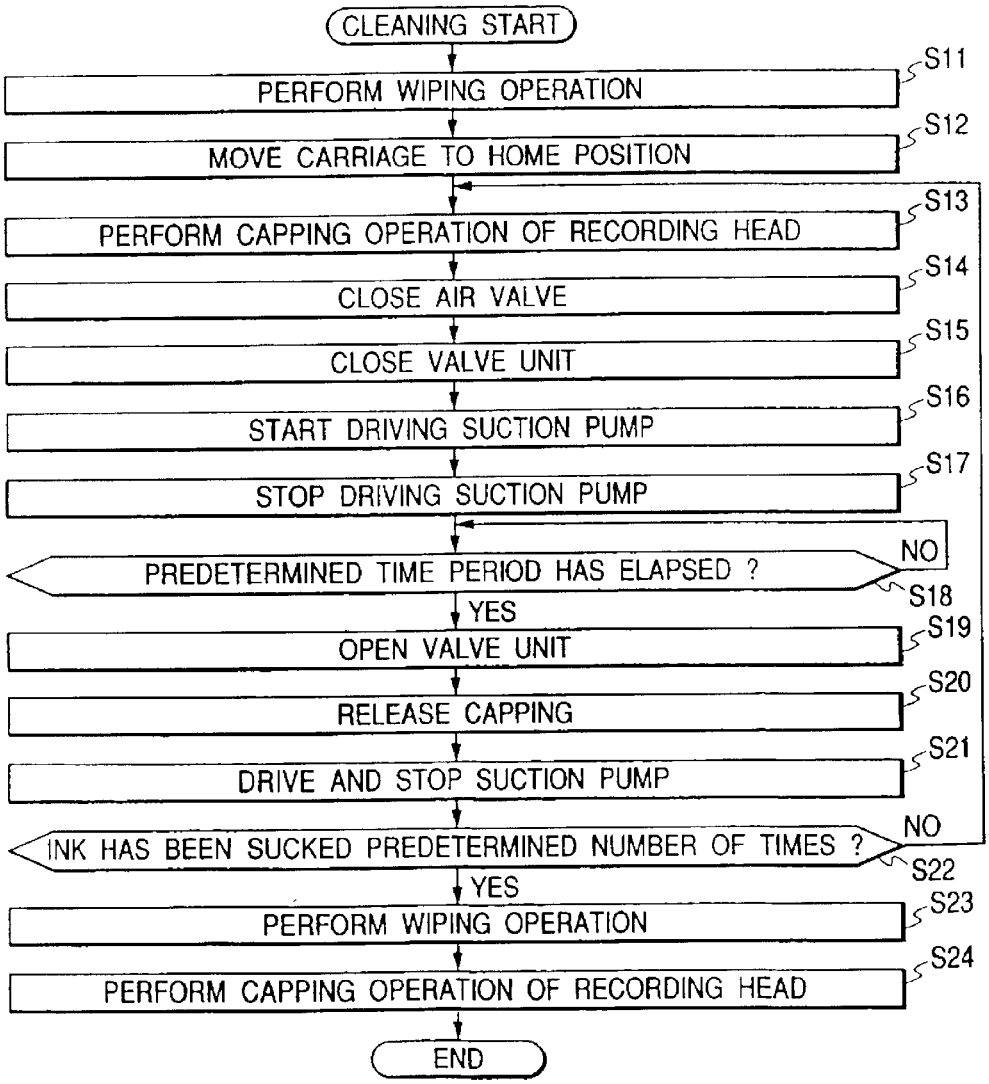
FIG. 6 is a flowchart to show a head cleaning control sequence in a first embodiment of the invention executed by the control circuit shown in FIG. 5.

FIG. 6 is a flowchart to show the cleaning operation of the recording head of the described recording apparatus in the first embodiment of the invention. The cleaning operation sequence in the first embodiment will be discussed with reference to FIG. 6.

For example, if a cleaning command is received on utilities in the host computer, a control signal is sent from the host computer to the cleaning sequence controller 45 as shown in FIG. 5, and the cleaning operation is started.

When the cleaning operation is started, the nozzle formation face of the recording head 7 is wiped by the wiping member 12 at step S11.

To do this, the cleaning sequence controller 45 sends a control signal to the carriage driver 49 and while the carriage 1 is moved toward the home position, the wiping member 12 projects to the move path of the recording head 7 and wipes the nozzle formation face of the recording head 7.

Thus, paper dust, etc., deposited on the nozzle formation face of the recording head 7 is removed.

Subsequently, at step S12, the carriage 1 furthermore moves to the home position side and at step S13, the capping unit 10 caps the nozzle formation face of the recording head 7 accordingly.

At the same time, at step S14, the air valve 26 communicating with the air hole 25 in the capping unit 10 is also closed.

In this state, at step S15, the valve unit 36 is closed.

To do this, the cleaning sequence controller 45 shown in FIG. 5 sends a control signal to the valve unit drive controller 48.

Subsequently, at step S16, driving the suction pump 11 is started.

To do this, the cleaning sequence controller 45 shown in FIG. 5 sends a control signal to the cleaning controller 43, which then sends a control signal to the pump driver 44.

The suction pump 11 normally uses a so-called tube pump for giving so-called stroke action to a tube placed like a circular arc by a roller moving on a circular arc path.

Therefore, negative pressure in the internal space of the capping unit 10 gradually increases in the presence of the volume provided by the internal space of the tube and the internal space of the capping unit 10.

When the negative pressure in the internal space of the capping unit 10 reaches the maximum, driving the suction pump 11 is stopped at step S17 and in this state, a wait is made for expiration of a predetermined time at step S18.

Thus, negative pressure is applied into the ink flow passage 35 from the nozzle orifices of the recording head 7 to the valve unit 36 over the predetermined time.

After the expiration of the predetermined time, the value unit 36 is opened at step S19.

The sequence controller 45 manages the predetermined time and sends a control signal to the valve unit drive controller 48, thereby executing the opening operation of the valve unit 36.

Figure 7:
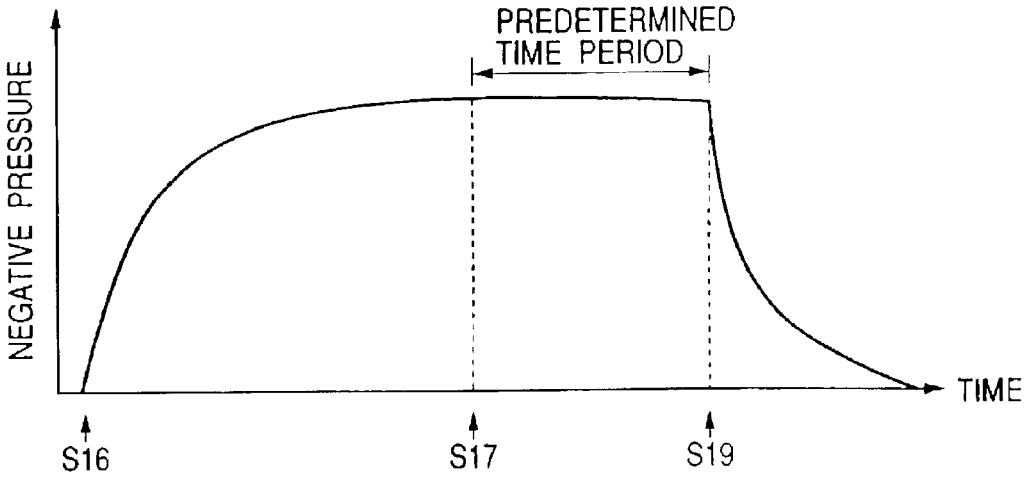
FIG. 7 is a characteristic drawing to show a negative pressure application state in the first embodiment of the invention in the control sequence shown in FIG. 6.

FIG. 7 shows the state of the negative pressure in the internal space of the capping unit 10 at steps S16 to S19 in the first embodiment of the invention.

That is, in the first embodiment of the invention, the negative pressure in the internal space of the capping unit 10 rises following the track like a quadratic curve at the same time as driving the pump is started, as shown in FIG. 7.

When the negative pressure reaches the maximum, driving the suction pump is stopped and in this state, a wait is made for expiration of the predetermined time.

During the expiration of the predetermined time, the negative pressure acts on the inside of the ink flow passage 35 from the nozzle orifices of the recording head 7 to the valve unit 36. Therefore, the deaeration degree of ink existing in the ink flow passage 35 from the nozzle orifices to the valve unit 36 rises because of the negative pressure and minute bubbles generated accordingly are accumulated as air bubbles and grow with other air bubbles in one body.

Since the value unit 36 is opened after the expiration of the predetermined time as described above, a fast ink flow occurs in the ink flow passage from the ink cartridge 8, 9 to the recording head 7, and the air bubbles grown in the flow passage together with the ink having increased viscosity are discharged to the side of the capping unit 10 together with the ink.

The negative pressure in the internal space of the capping unit 10 is canceled accordingly.

In this case, in the configuration in which the filter member 7*d* is placed in the ink flow passage 35 between the valve unit 36 and the nozzle orifices as shown in FIG. 4, air bubbles accumulate upstream from the filter member 7*d* and generally are extremely hard to discharge, but air bubbles produced by the deaeration action as negative pressure is applied for the predetermined time grow with the air bubbles existing upstream from the filter member 7*d* in one body and are pushed out because of the ink flow, as described above.

Therefore, in the recording apparatus comprising the filter member 7*d* placed as described above, adopting the described sequence can contribute to more improving of the bubble discharge effect.

Subsequently, capping the recording head 7 by the capping unit is released at step S20.

At step S21, the suction pump 11 is temporarily driven and is stopped.

Thus, ink discharged into the capping unit 10 passes through the suction pump 11 and is discharged into the waste ink tank 27.

Subsequently, at step S22, whether or not ink has been sucked as many times as a predetermined number of times is determined. If the number of times ink has been sucked is less than the predetermined number of times, steps S13 to S21 are repeated.

If it is determined at step S22 that ink has been sucked as many times as the predetermined number of times, the wiping operation is performed at step S23, namely, the wiping member 12 wipes ink deposited on the nozzle formation face of the recording head 7. The recording head 7 is sealed by the capping unit 10 and enters a state waiting for print data to arrive.

In the sequence shown in FIG. 6, the valve unit is closed at step S15 after the recording head is capped at step S13, but the steps may be executed at the same time or step S15 may be executed before step S13 is executed.

In the sequence shown in FIG. 6, whether or not ink has been sucked as many times as the predetermined number of times is determined at step S22, but ink need not be sucked more than once if a sufficient cleaning result can be provided by executing one ink suction operation.

As is clear from the description made so far, according to the ink jet recording apparatus and the recording head cleaning control method in the recording apparatus according to the first embodiment of the invention, the valve unit for opening and closing the ink flow passage is placed between the ink cartridge and the recording head and opening and closing the valve unit are controlled in association with the recording head cleaning operation, whereby negative pressure is accumulated. Thus, the air bubbles entering the recording head, for example, when the ink cartridge is replaced can be efficiently discharged accompanying a fast ink flow.

Moreover, the valve unit driver operates so as to retain the negative pressure accumulation state for the predetermined time and open the valve unit after the expiration of the predetermined time. Thus, the air bubbles produced by the deaeration action as the negative pressure is applied for the predetermined time grow with other air bubbles in one body and are pushed out in a stroke because of the ink flow.

Therefore, it is made possible to provide a high-reliability ink jet recording apparatus capable of effectively suppressing occurrence of a print failure in a recording head.

Next, an ink jet recording apparatus and a recording head cleaning control method in the recording apparatus in a second embodiment of the invention will be discussed.

Figure 8:
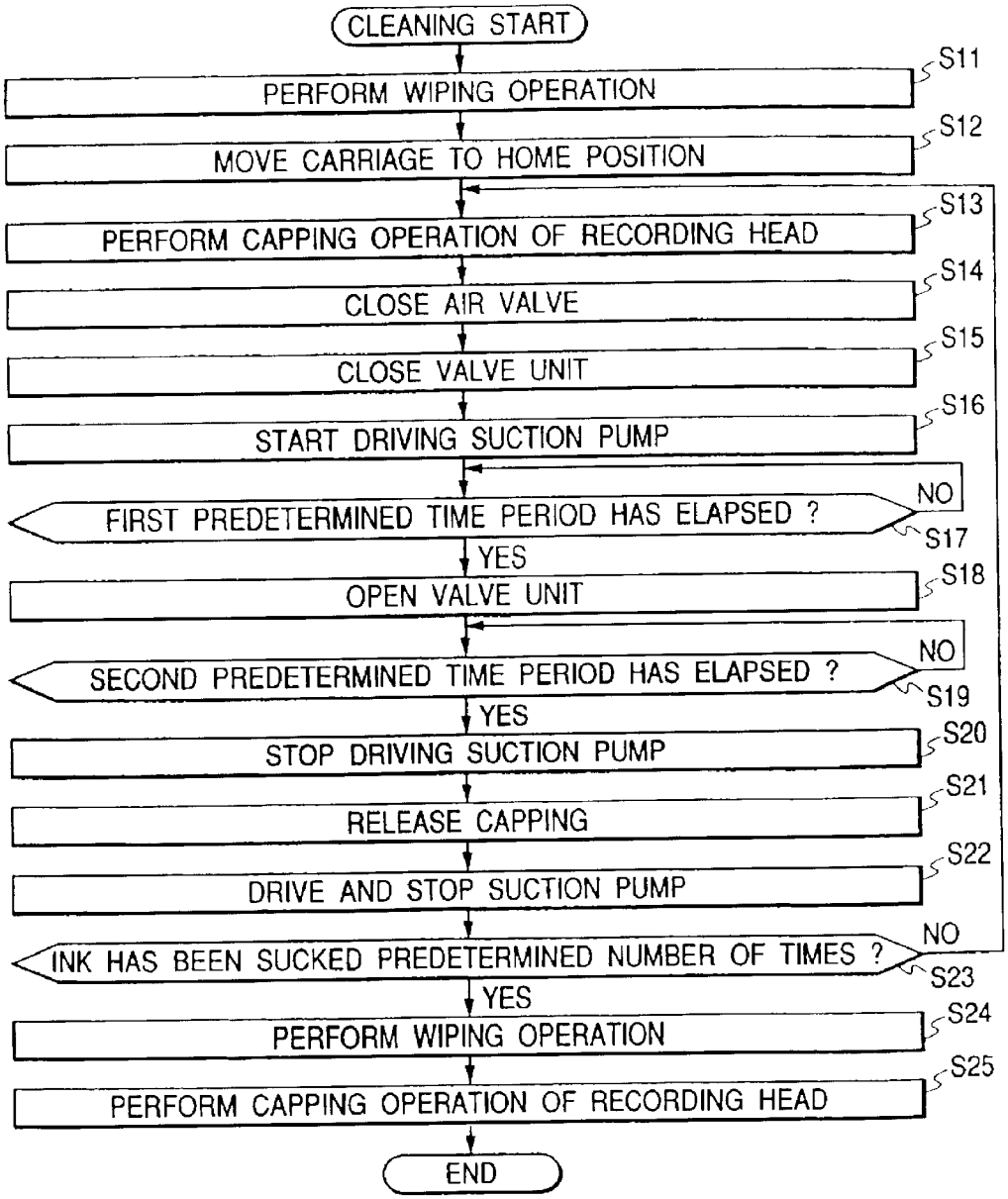
FIG. 8 is a flowchart to show a head cleaning control sequence in a second embodiment of the invention executed by the control circuit shown in FIG. 5.

FIG. 8 is a flowchart to show the recording head cleaning operation in a second embodiment of the invention, executed in the configuration of the recording apparatus previously described. The cleaning operation sequence in the second embodiment will be discussed with reference to FIG. 8.

For example, if a cleaning command is received on utilities in the host computer, a control signal is sent from the host computer to the cleaning sequence controller 45 as shown in FIG. 5, and the cleaning sequence controller 45 outputs various control signals, whereby the cleaning operation is started.

First, the cleaning sequence controller 45 sends a control signal to the carriage driver 49, whereby the carriage 1 is driven along a guide shaft 4 and is moved to the home position side.

Thus, at step S11, the wiping member 12 wipes the nozzle formation face of the recording head 7.

Subsequently, at step S12, the carriage 1 furthermore moves to the home position side and at step S13, the capping unit 10 caps the nozzle formation face of the recording head 7 accordingly.

At the same time, at step S14, the air valve 26 communicating with the air hole 25 in the capping unit 10 is also closed.

In this state, at step S15, the valve unit 36 is closed.

To do this, the cleaning sequence controller 45 shown in FIG. 5 sends a control signal to the valve unit drive controller 48.

Subsequently, at step S16, driving the suction pump 11 is started.

To do this, the cleaning sequence controller 45 shown in FIG. 5 sends a control signal to the cleaning controller 43, which then sends a control signal to the pump driver 44.

In this state, at step S17, a wait is made for expiration of a first predetermined time after driving of the suction pump 11 is started. When the negative pressure given to the capping unit 10 reaches the maximum or its vicinity, at step S18, the valve unit 36 is opened.

In this case, the sequence controller 45 manages the first predetermined time and sends a control signal to the valve unit drive controller 48, thereby executing the opening operation of the valve unit 36.

After the valve unit 36 is opened, a wait is made for expiration of a second predetermined time at step S19. If it is determined at step S19 that the second predetermined time has elapsed, the suction pump 11 is stopped at step S20.

In this case, the sequence controller 45 manages the second predetermined time and sends a control signal to the cleaning controller 43, thereby stopping the driving operation of the suction pump 11.

Figure 9:
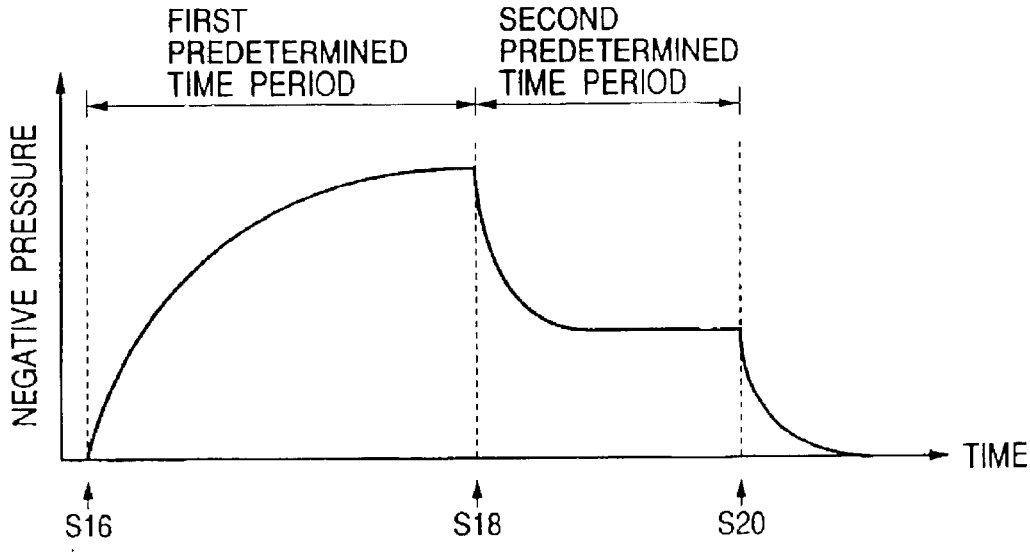
FIG. 9 is a characteristic drawing to show a negative pressure application state in the second embodiment of the invention in the control sequence shown in FIG. 8.

FIG. 9 shows the change state of the negative pressure applied to the capping unit in the control sequence at steps S16 to S20 in the second embodiment of the invention.

That is, when driving of the suction pump 11 is started, the negative pressure in the internal space of the capping unit 10 rises following the track like a quadratic curve, as shown in FIG. 9. When the first predetermined time has elapsed and the negative pressure reaches the maximum or its vicinity, the valve unit 36 is opened.

Thus, the negative pressure rises abruptly.

However, since driving of the suction pump 11 is continued, the negative pressure does not rise to the atmospheric pressure and remains in a predetermined negative pressure state.

When the second predetermined time has elapsed since opening of the valve unit 36, driving the suction pump is stopped and the negative pressure rises to the atmospheric pressure abruptly.

As understood in the negative pressure characteristic in the second embodiment of the invention shown in FIG. 9, the valve unit 36 is opened when the first predetermined time has elapsed, whereby a fast ink flow occurs in the ink flow passage from the ink cartridge to the nozzle orifices of the recording head 7.

The air bubbles remaining in a stuck state in the ink flow passage can be peeled from the ink flow passage by the fast ink flow.

Since driving of the suction pump 11 is also continued for sucking ink successively in the period of the second predetermined time, the peeled air bubbles can be discharged following the ink flow.

For example, in the configuration in which the filter member **7*d* is placed in the ink flow passage 35 between the valve unit 36 and the nozzle orifices as shown in FIG. 4, air bubbles accumulate upstream from the filter member 7*d* and generally are extremely hard to discharge, but the above-described effect is produced, thus the air bubbles remaining upstream from the filter member 7*d* can be pulled to the side of the filter member 7*d* by the fast ink flow and can be discharged through the filter member 7*d*** as the suction pump is driven successively.

Referring again to FIG. 8, capping the recording head 7 by the capping unit 10 is released at step S21.

At step S22, the suction pump 11 is temporarily driven and is stopped.

Thus, ink discharged into the capping unit 10 and remaining therein passes through the suction pump 11 and is discharged into the waste ink tank 27.

Subsequently, at step S23, whether or not ink has been sucked as many times as a predetermined number of times is determined. If the number of times ink has been sucked is less than the predetermined number of times, steps S13 to S22 are repeated.

If it is determined at step S23 that ink has been sucked as many times as the predetermined number of times, the wiping operation is performed at step S24, namely, the wiping member 12 wipes ink deposited on the nozzle formation face of the recording head 7.

At step S25, the recording head 7 is sealed by the capping unit 10 and enters a state waiting for print data to arrive.

In the sequence in the second embodiment of the invention shown in FIG. 8, the valve unit is closed at step S15 after the recording head is capped at step S13, but the steps may be executed at the same time or step S15 may be executed before step S13 is executed.

In the sequence in the second embodiment of the invention shown in FIG. 8, driving the suction pump is started at step S16 after the valve unit is closed at step S15, but step S16 may be executed before step S15 is executed.

Figure 10:
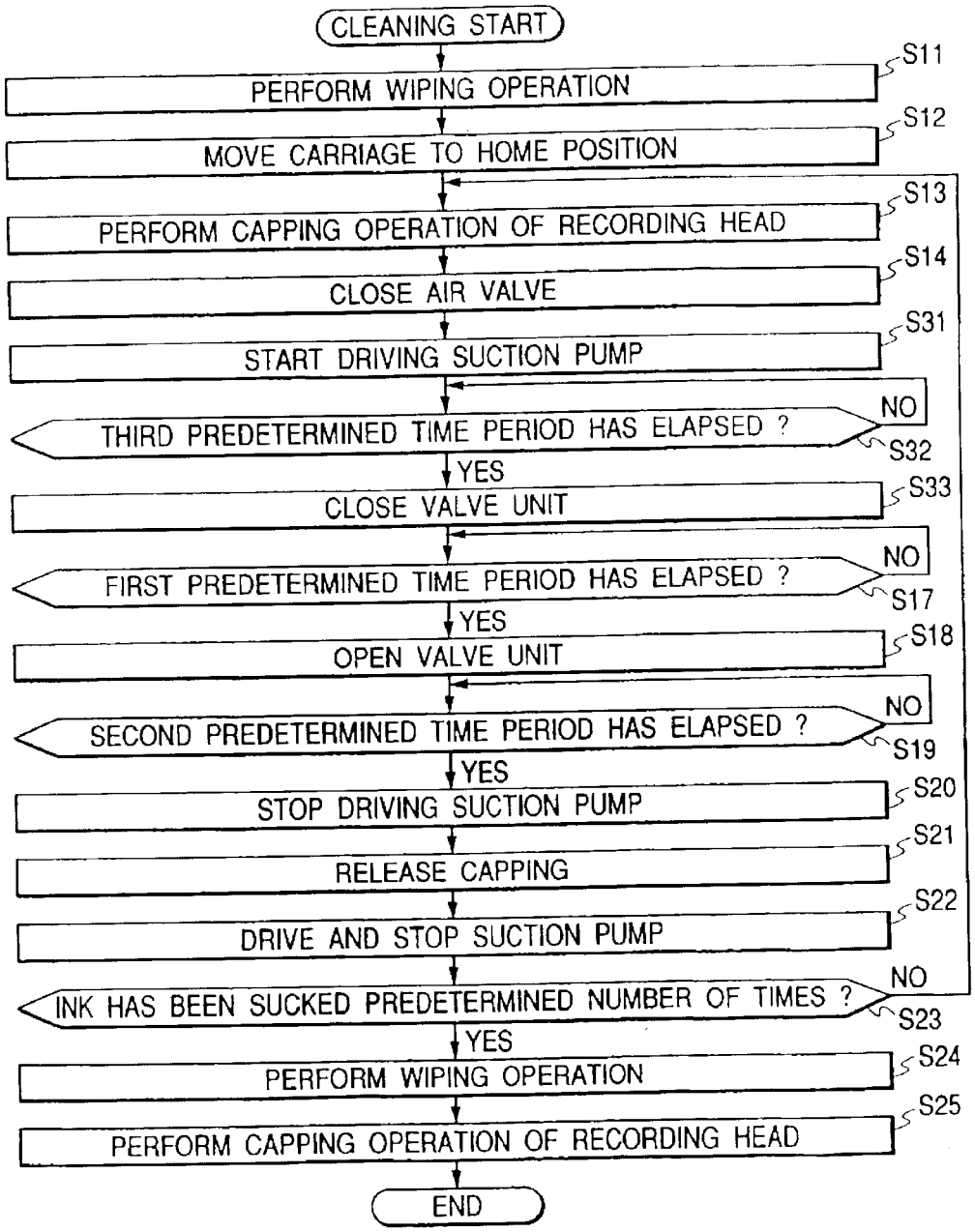
FIG. 10 is a flowchart to show a head cleaning control sequence in a third embodiment of the invention.

Next, FIG. 10 shows a control sequence in a third embodiment of the invention, a modification of the sequence in the second embodiment.

In the control sequence in the third embodiment of the invention shown in FIG. 10, steps S31 to S33 are executed in place of steps S15 and S16 shown in FIG. 8.

That is, when the recording head 7 is capped and the atmospheric valve 26 is closed at steps S13 and S14, driving the suction pump 11 is started at step S31 following step S14.

Thus, negative pressure is given to the internal space of the capping unit.

In this state, at step S32, a wait is made for expiration of a third predetermined time and if it is determined that the third predetermined time has elapsed, the valve unit 36 is closed at step S33.

Subsequently, a control sequence similar to that at steps S17 and later previously described with reference to FIG. 8 is executed.

If the control sequence in the third embodiment shown in FIG. 10 is adopted, the suction pump is driven early, so that the negative pressure in the internal space of the capping unit can be raised rapidly.

Figure 11:
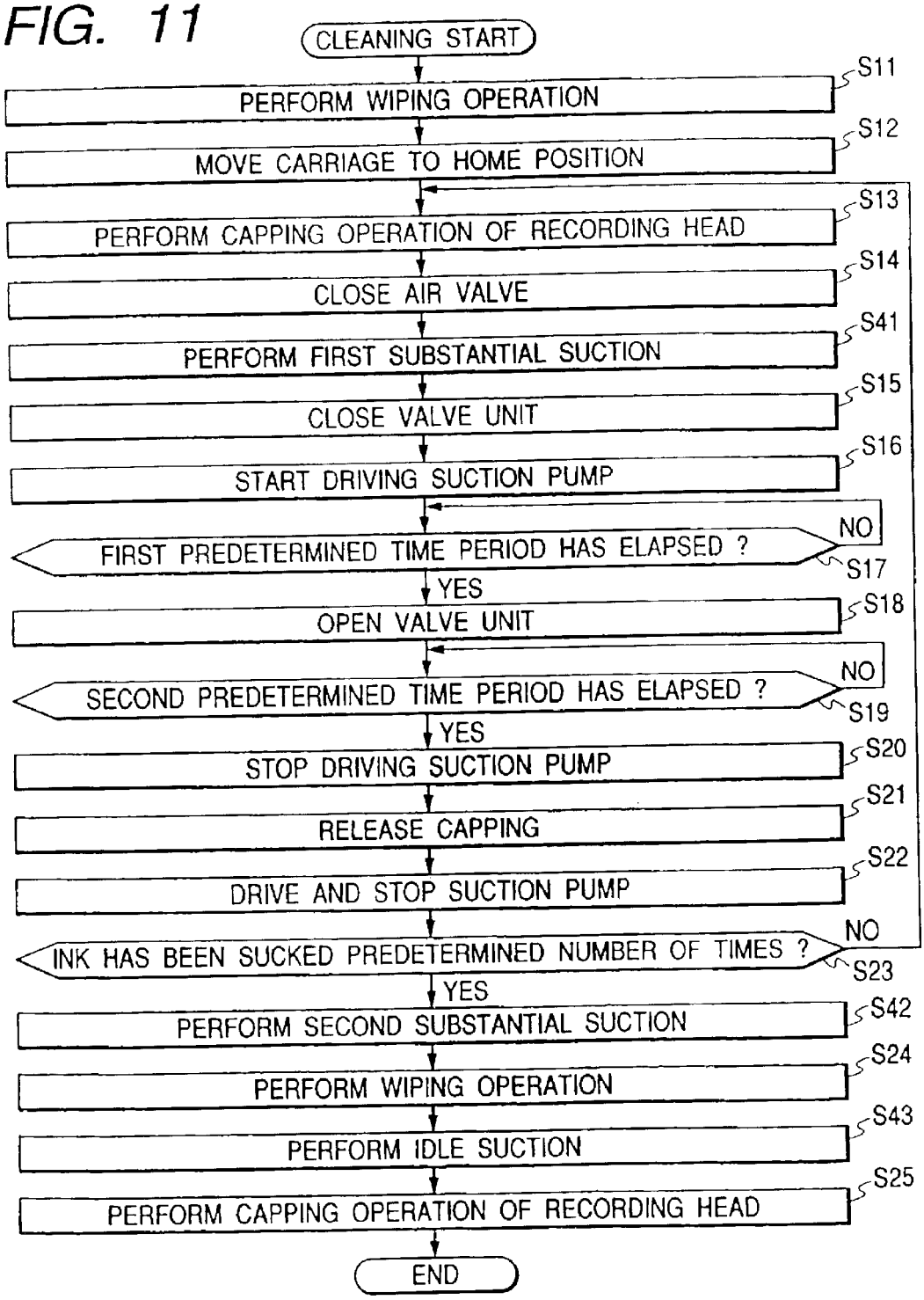
FIG. 11 is a flowchart to show another example of the head cleaning control sequence in the second embodiment of the invention.

Next, FIG. 11 shows a control sequence comprising preferred control steps added to the control sequence in the second embodiment shown in FIG. 8.

In the control sequence in FIG. 11, the capping unit 10 seals the nozzle orifices of the recording head 7 and the atmospheric open valve 26 is closed at steps S13 and S14 and in this state, a first substantial suction step is executed as step S41.

That is, the first substantial suction step is executed before steps S15 and S16 at which the valve unit 36 is closed and the suction pump is driven.

At the first substantial suction step (S41), ink is sucked and discharged with the valve unit 36 open. The first substantial suction step (S41) is executed at the timing, whereby the air bubbles remaining upstream from the filter member 7*d* can be collected just near the filter member 7*d*.

After this, the control sequence of closing the valve unit 36, then opening the valve unit 36 under accumulated pressure is executed, whereby the air bubbles collected just near the filter member 7*d* pass through the filter member 7*d* by an instantaneous fast ink flow.

Therefore, the discharge effect of the air bubbles in the ink flow passage can be more enhanced by executing step S41.

After the valve unit 36 is opened at step S18 while driving of the suction pump is continued, preferably second substantial suction is further executed for sucking and discharging ink from the recording head by sealing the nozzle orifices and driving the suction pump.

The second substantial suction step is shown as step S42 in FIG. 11.

At the second substantial suction step (S42), the suction speed is set equal to or lower than the suction speed (driving speed of the suction pump 11) at the first substantial suction step (S41).

The second substantial suction step (S42) is thus executed, whereby the ink flow passage is made neat after the powerful cleaning operation with the valve unit 36 open while driving of the suction pump is continued.

As shown in FIG. 11, after the second substantial suction step (S42) is executed, idle suction operation is further executed at step S43 for discharging ink from the capping unit in a release state of sealing the recording head.

The idle suction operation is executed, whereby the ink sucked and discharged into the capping unit by performing the second substantial suction operation is fed into the waste ink tank 27.

If the first substantial suction step (S41), the second substantial suction step (S42), and the idle suction step (S43) shown in FIG. 11 are added, for example, to the control sequence in the third embodiment shown in FIG. 10, similar effects can be produced.

In this case, preferably the first substantial suction step (S41) is inserted following step S14 in FIG. 10 and is executed, and the second substantial suction step (S42) and the idle suction step (S43) are inserted following steps S23 and S24 shown in FIG. 10 respectively and are executed.

In the control sequences shown in FIGS. 8, 10, and 11, whether or not ink has been sucked as many times as the predetermined number of times is determined at step S23, but ink need not be sucked more than once if a sufficient cleaning result can be provided by executing one ink suction operation.

According to the ink jet recording apparatus adopting the cleaning control method according to the second embodiment, the third embodiment of the invention, the valve unit for opening and closing the ink flow passage is placed between the ink storage section and the recording head, the suction pump is driven with the valve unit closed, and the valve unit is opened in a state in which negative pressure is accumulated in the internal space of the capping unit, so that a fast ink flow can be generated in the ink flow passage at the instant at which the valve unit is opened.

Subsequently, the suction pump drive state is continued over the predetermined time after the valve unit is opened, thus the air bubbles peeled from the ink flow passage can be effectively discharged following the ink flow.

Thus, it is made possible to provide a high-reliability ink jet recording apparatus capable of suppressing occurrence of a print failure in a recording head.

Next, a fourth embodiment of the ink jet recording apparatus of the type shown in FIG. 1 using each ink cartridge mounted on the carriage as the ink storage section and comprising a preferred valve unit will be discussed.

That is, the valve unit in the embodiment dissolves the following problems of the valve unit in the related art: Since a shaft is inserted into an ink flow passage and is rotated, a gap occurs in any part other than the ink flow passage and desired negative pressure cannot be provided; because of recent tendency to increase the number of nozzle orifices, the suction pump has an insufficient capability to provide desired negative pressure; and the like.

Since the valve unit in the related art comprises O-rings used to enable rotation of the shaft inserted so as to cross the ink flow passage and retain the hermetic state, when the shaft is rotated, a large torque is required and a high-capability drive motor is required.

Consequently, the ink jet recording apparatus having the valve unit in the related art cannot sufficiently meet the demand of manufacturing at lower costs.

The valve unit in the preferred embodiment also overcomes the problem.

It also has the advantage that the valve unit can reliably remove air bubbles remaining in the upper part of the filter in the ink flow passage and air bubbles remaining in the recording head.

Figure 12B:
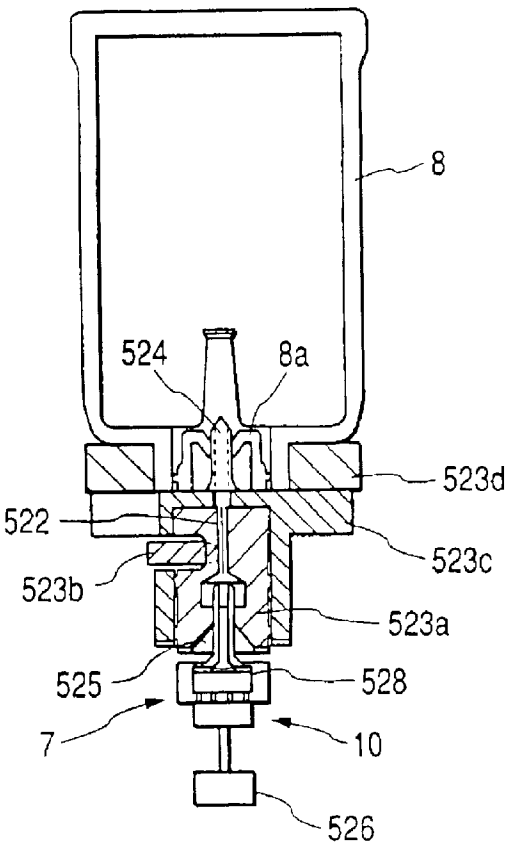
FIGS. 12A and 12B are sectional views to show the configuration of a valve unit in a fourth embodiment according to the invention.
Figure 12A:
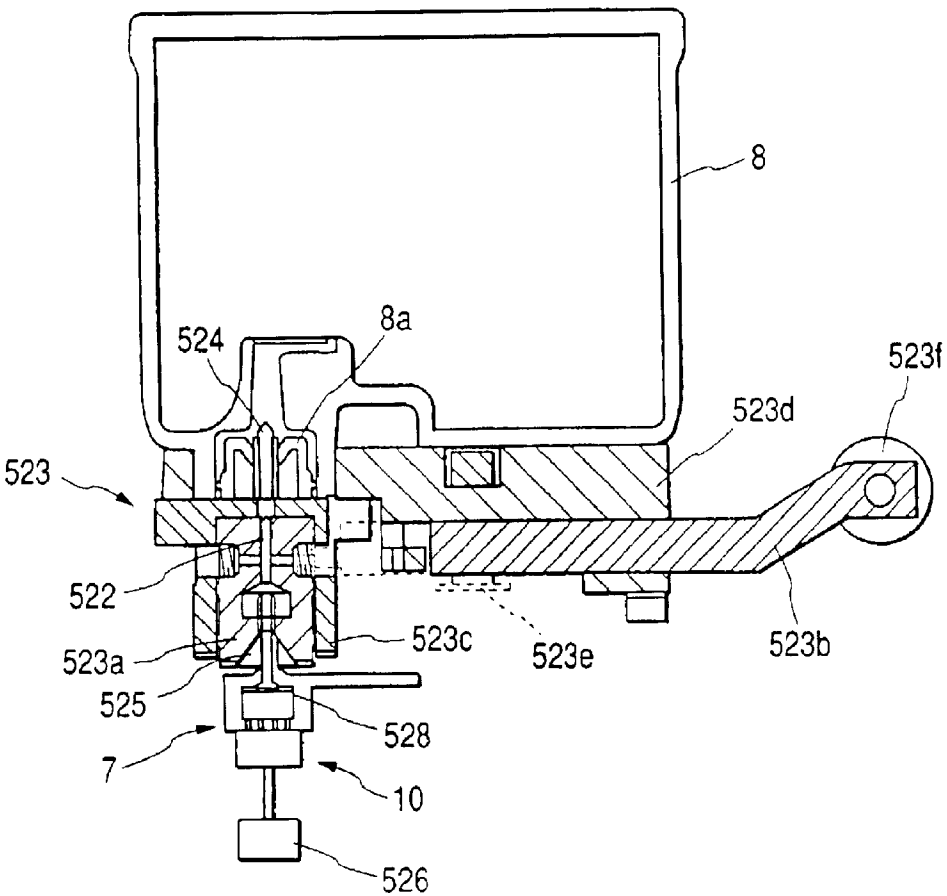

FIGS. 12A and 12B show the valve unit in the embodiment placed between recording head and ink cartridge (in the figure, black ink cartridge 8); FIGS. 12A and 12B are sectional views of the valve unit viewed from the orthogonal direction.

Figure 13:
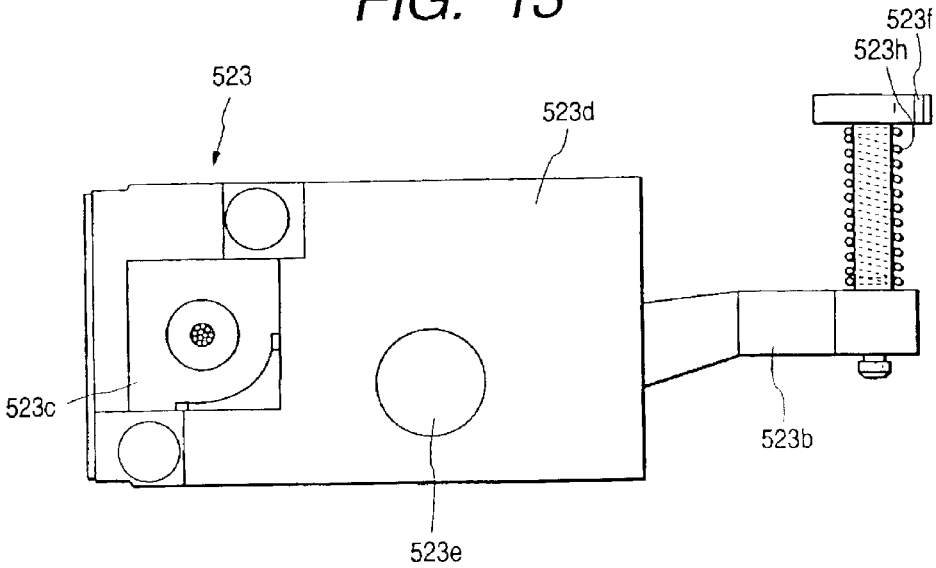
FIG. 13 is a top view of the valve unit shown in FIG. 12.

FIG. 13 is a plan view of the valve unit from the top thereof (a plan view with the ink cartridge removed).

Figure 14:
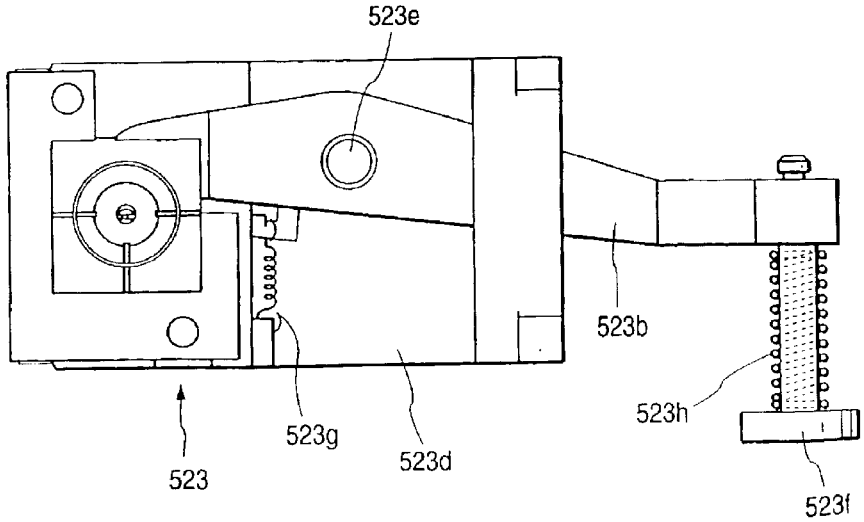
FIG. 14 is a bottom view of the valve unit shown in FIG. 12.

FIG. 14 is a plan view of the valve unit from the bottom thereof (recording head side).

Figure 15A:
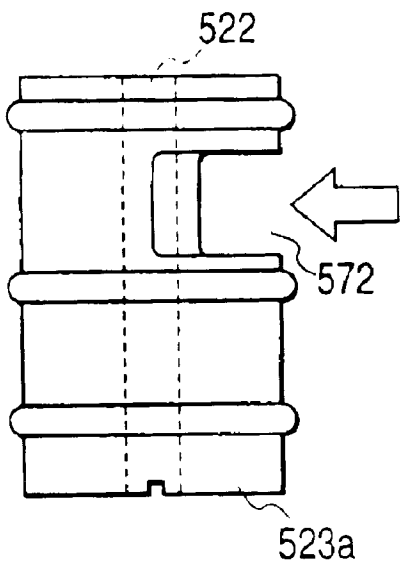
FIGS. 15A to 15C are drawings to show the shape of a sealing member used with the valve unit shown in FIG. 12.
Figure 15B:
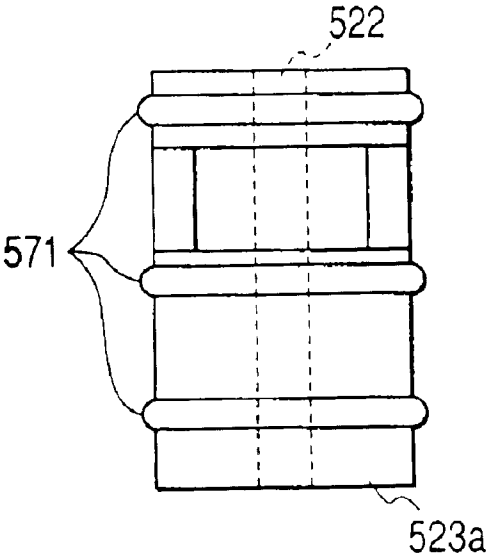
Figure 15C:
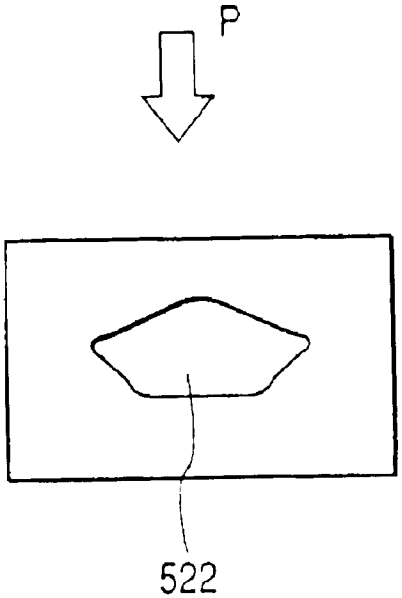

FIGS. 15A to 15C are drawings to show the shape of a valve body used with the valve unit.

Figure 16:
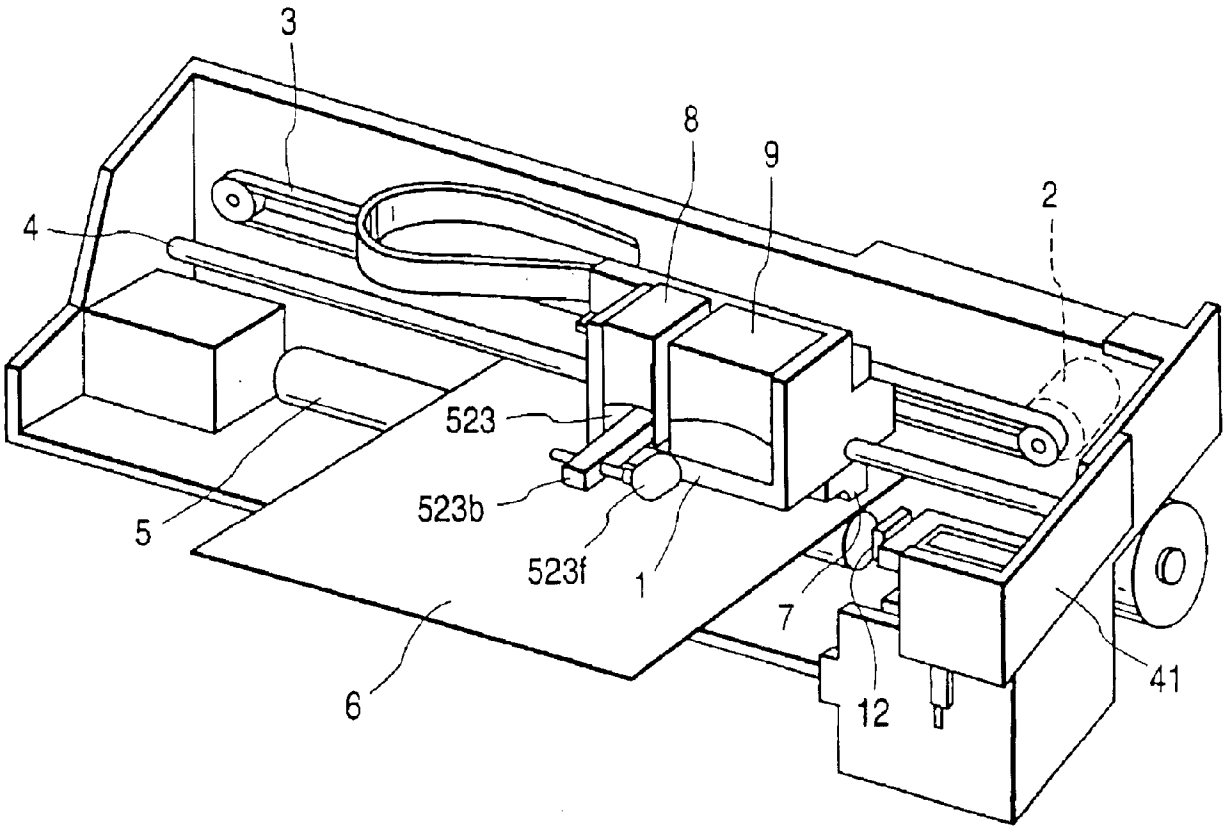
FIG. 16 is a perspective view to show the general configuration of the main body of ink jet recording apparatus of the invention comprising the valve unit shown in FIG. 12.

FIG. 16 is a schematic drawing of ink jet recording apparatus of the invention comprising the valve unit.

In the figure, numeral 1 denotes a carriage. Ink cartridges 8 and 9 are mounted detachably on the top face of the carriage 1 and an ink jet recording head 7 for jetting ink drops in response to a print signal is fixed to the side of the carriage 1 facing recording paper 6.

The carriage 1 is guided by a guide shaft 4 and is reciprocated in the axial direction of a platen 5 by the drive force of a carriage motor 2 via a timing belt 3.

A capping unit 10 is placed in a non-print area (home position) formed in the right end part of the figure in the move path of the carriage 1. The capping unit 10 is formed so that it can seal the nozzle formation face of the recording head 7 when the recording head 7 moves just above.

A suction pump 11 as a suction member for supplying negative pressure to the internal space of the capping unit 10 is placed below the capping unit 10.

The capping unit 10 functions as a lid for preventing the nozzle orifices of the recording head 7 from being dried during the halt period of the recording apparatus, functions as an ink receptacle during the flushing operation of idly jetting ink drops by applying a drive signal not involved in print to the recording head 7, and functions as the ink suction member for causing negative pressure from the suction pump 11 to act on the recording head 7 for sucking and discharging ink.

A wiping member 12 made of an elastic plate of rubber, etc., is placed in the proximity of the capping unit 10. When the carriage 1 moves to and from the side of the capping unit 10, the wiping member 12 performs the wiping operation of wiping the nozzle formation face of the recording head 7.

Valve unit 523 is formed between the ink cartridge 8 and the recording head 7, as shown in FIGS. 12A and 12B.

The valve unit 523 comprises a valve body 523*a* forming an ink flow passage 522, a rotatable lever 523*b* placed so as to come in contact with the valve body 523*a*, a cover 523*c* housing the valve body 523*a*, a base 523*d* to which the valve body 523*a*, the lever 523*b*, and the cover 523*c* are attached, a pin 523*e* for attaching the lever 523*b* to the base 523*d* for rotation, a pin lever 523*f* attached slidably to one end of the lever 523*b*, a valve spring 523*h* touching at one end to the lever 523*b* and at an opposite end to the pin lever 523*f*, and a return spring 523*g* attached at one end to the lever 523*b* and at an opposite end to the base 523*c*.

Next, the valve body 523*a* forming a part of the valve unit 523 will be discussed with reference to FIGS. 15A to 15C.

The valve body 523*a* has an outside shape roughly like a circular cylinder and a pentagonal ink flow passage as shown in FIG. 15C is formed along the axial line.

FIG. 15A is a front view, FIG. 15B is a side view, and FIG. 15C is an enlarged view of the ink flow passage.

In FIG. 15C, the rectangular frame surrounding the ink flow passage indicates an enlargement and does not indicate the outside shape of the valve body 523*a*.

The valve body 523*a* is formed of an elastic substance of rubber, etc., and can be deformed diametrically by external pressure P from the side wall direction.

Three sealing members 571 each being semicircular in cross section in circumferential direction are provided on the outer periphery in up and down direction (axial direction).

When the valve body 523*a* is housed in the cover 523*c*, the semicircular sealing members 571 come in intimate contact with the inner wall of the cover 523*c* for providing hermeticity.

As shown in FIG. 15A, on the side wall of the valve body 523*a*, a pressed portion 572 pressed by the lever 523*b* is of a lightening hole structure and the outside shape (outer diameter) of the valve body 523*a* is small in the portion.

Therefore, the side wall of the pressed portion 572 becomes thin. Thus, upon pressurization by the lever 523*b*, the pressed portion 572 becomes easily deformed and the side wall can close the ink flow passage 522.

Specifically, a pressure of about 200 gf is applied to the pressed portion 572, whereby the ink flow passage 522 is closed.

Thus, the valve body 523*a* is of a lightening hole structure and the sealing members are provided on the outer periphery for enabling the valve body 523*a* to be housed in the cover 523*c* in intimate contact, so that the pressed portion 572 (flow passage closing part) of the valve body 523*a* to which external pressure is applied becomes deformed more easily, the restoring force is enhanced, and ink can be prevented from entering any other part than the ink flow passage 522.

To open or close the ink flow passage 522 of the valve body 523*a*, external pressure is applied to the valve body 523*a* or the external pressure to the valve body 523*a* is released through the pin lever 523*f*, the valve spring 523*h*, and the lever 523*b*, as shown in FIGS. 12, 13, and 14.

The lever 523*b* acting directly on the valve body 523*a* consists of a supporting point attached to the base 523*d* by the pin 523*e* for rotation, a power point coming in contact with the valve body 523*a* for pressurization, and an application point to which the pin lever 523*f* and the valve spring 523*h* are attached.

That is, when the pin lever 523*f* is pushed and the valve spring 523*h* is compressed, the lever 523*b* receives the force and rotates on the pin 523*e*. Consequently, one end part of the lever 523*b* in contact with the valve body 523*a* presses the side wall of the valve body 523*a* for closing the ink flow passage.

Thus, the lever 523*b* comprises the supporting point, the power point, and the application point spaced from each other at predetermined distances, whereby the load on the power point required for closing the ink flow passage in the valve body 523*a* can be lightened and the ink flow passage can be closed by desired external pressure.

The load acting on the pin lever 523*f* acts to close the ink flow passage in the valve body 523*a* as described above. However, once the ink flow passage is closed, the load becomes unnecessary load imposed on the lever 523*b*, the valve body 523*a*, and the valve unit 523; the fear of breaking the valve unit 523 occurs.

To prevent it, the valve spring 523*h* is provided for the pin lever 523*f*.

That is, the valve spring 523*h* absorbs the unnecessary load after the. lever 523*b* closes the ink flow passage 522 in the valve body 523*a* and the load imposed on the lever 523*b* and the valve body 523*a* can be adjusted.

Consequently, the unnecessary load imposed on the valve body 523*a* and the lever 523*b* after the ink flow passage 522 in the valve body 523*a* is closed can be lightened and the valve unit 523 can be prevented from being broken.

The return spring 523*g* is placed so as to cause the lever 523*b* to act on the side of the valve body 523*a* and the application point side of the lever 523*b* can be made to always wait at the same position relative to the valve body 523*a*.

The portion in contact with the valve body 523*a* on the application point side of the lever 523*b* is made an acuminate shape for raising pressure to the seal rubber.

However, the tip thereof is rounded for preventing damage to the side wall of the valve body 523*a*.

An ink supply needle 524 is provided on the ink cartridge 8 side of the valve unit 523, as shown in FIGS. 12A and 12B.

On the other hand, ink supply needle 524 placed on the recording head 7 fits the ink flow passage of the recording head 7 side in the valve body 523*a*.

When the ink cartridge 8 is mounted, the ink supply needle 524 is inserted into an ink supply port formed in seal rubber 8*a* of the ink cartridge 8, the ink flow passage 522 from an ink chamber of the ink cartridge 8 to the recording head 7 is formed, and ink can be supplied to the recording head 7.

Further, the capping unit 10 for accumulating negative pressure generated by the suction pump and a pressure pool 526 placed for accumulating negative pressure are downstream from the nozzle orifices, so that they serve sucking ink more effectively. A filter 528 is placed downstream from the ink supply needle 524, whereby the foreign substances of dust, etc., can be prevented from entering the recording head 7.

The described valve unit 523 is formed on the carriage 1 as shown in FIG. 16. The main body of the ink jet recording apparatus is formed with a pad 41.

When the carriage 1 moves to the non-print area and the pin lever 523*f* strikes against the pad 41, the side wall of the valve body 523*a* is pressurized through the pin lever 523*f*, the valve spring 523*h*, and the lever 523*b*.

In the valve body 523*a*, the ink flow passage 522 is formed and is closed by external pressure P, closing the valve unit 523.

On the other hand, when the carriage 1 moves to the print area, the pad 41 and the pin lever 523*f* are brought away from each other and the pressure P applied to the valve body 523*a* through the pin lever 523*f*, the valve spring 523*h*, and the lever 523*b* is released. At this time, the valve body 523*a*, which is formed of an elastic substance, is opened by the restoration force of the elastic substance.

Figure 17B:
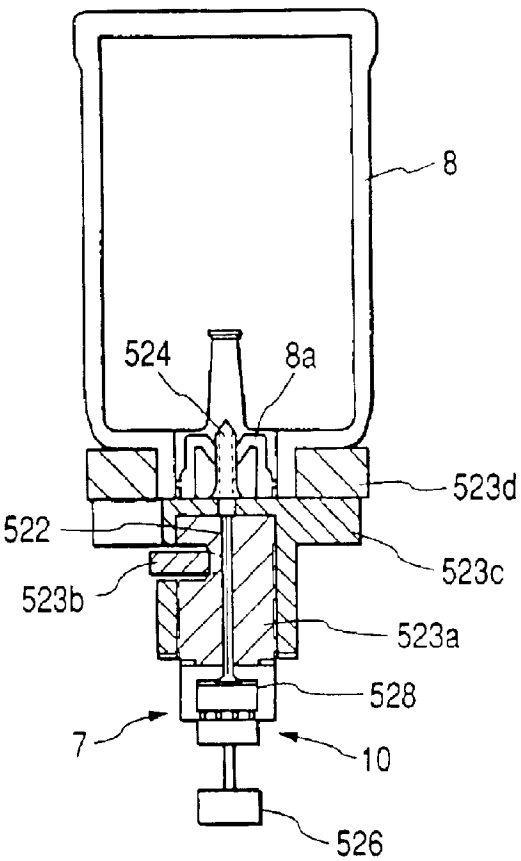
FIGS. 17A and 17B are sectional view to show a configuration example of a valve unit in a fifth embodiment according to the invention.
Figure 17A:
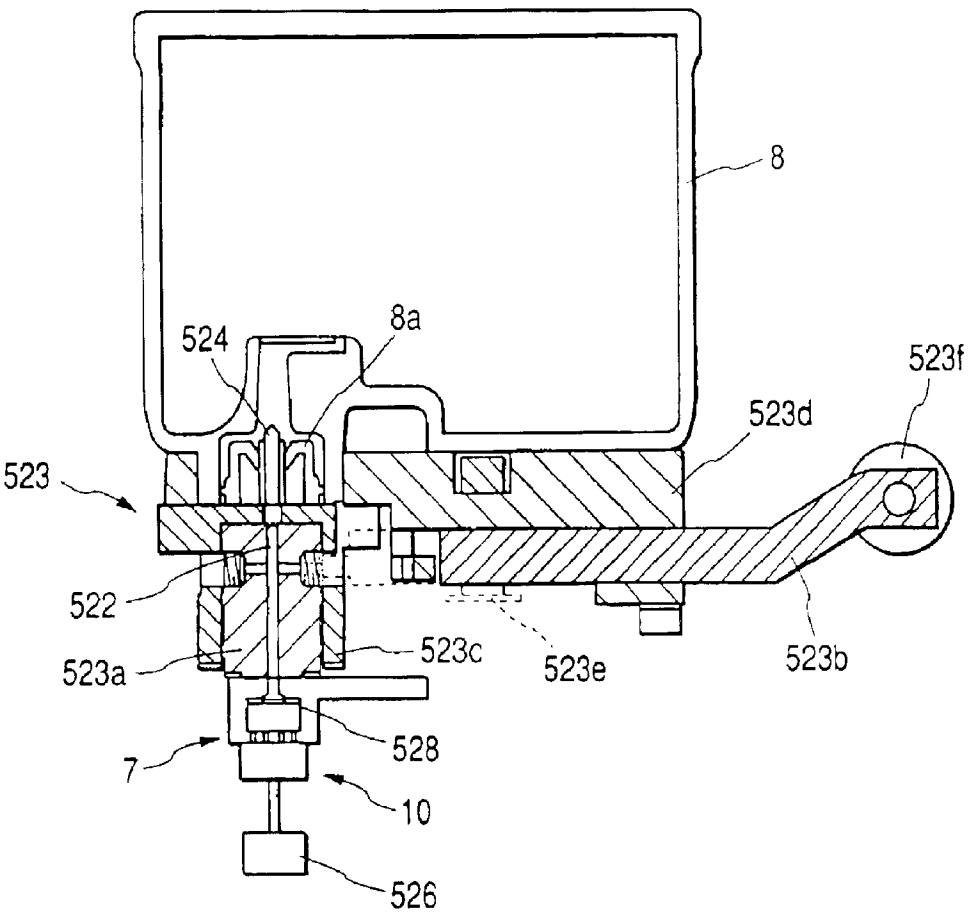
Figure 18A:
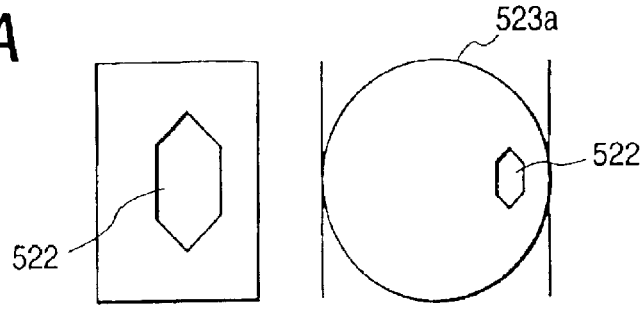
FIGS. 18A to 18D are sectional views to show cross-sectional shapes of another ink flow passage of sealing member.
Figure 18B:
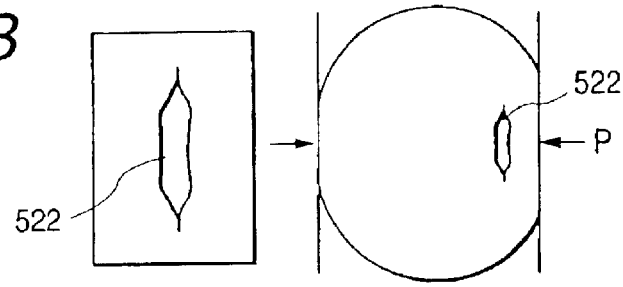
Figure 18C:
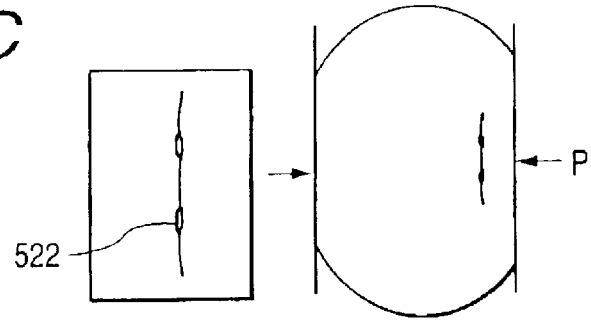
Figure 18D:
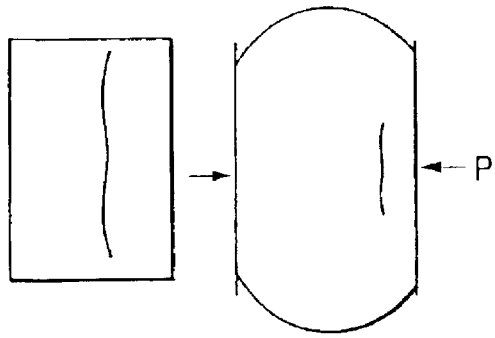
Figure 19A:
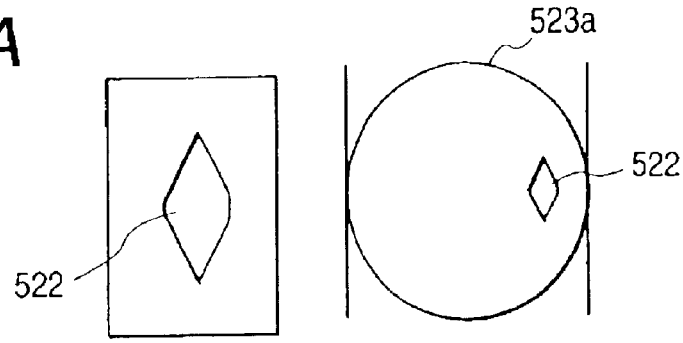
FIGS. 19A to 19D are sectional views to show cross-sectional shapes of another ink flow passage of sealing member.
Figure 19B:
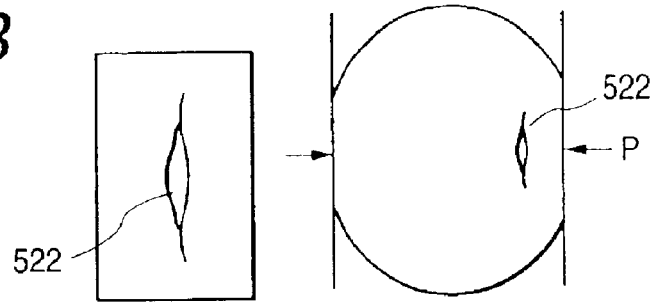
Figure 19C:
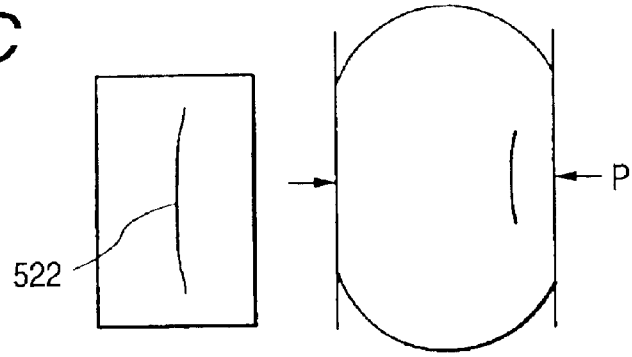
Figure 19D:
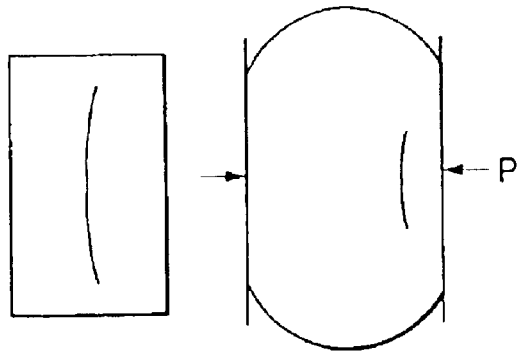
Figure 20A:
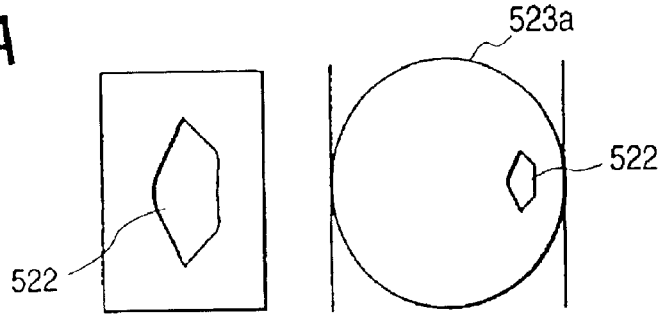
FIGS. 20A to 20D are sectional views to show cross-sectional shapes of another ink flow passage of sealing member.
Figure 20B:
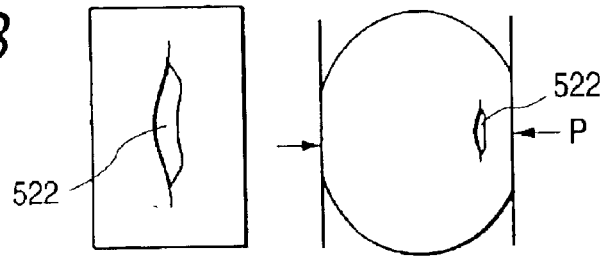
Figure 20C:
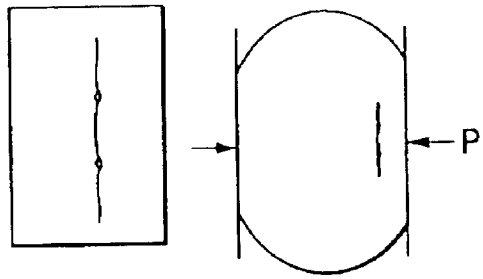
Figure 20D:
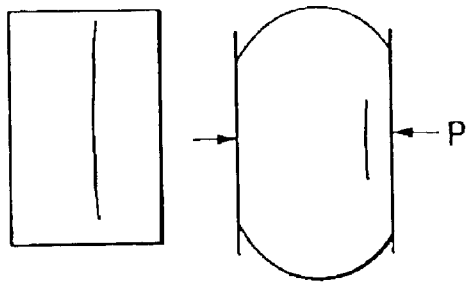
Figure 21A:
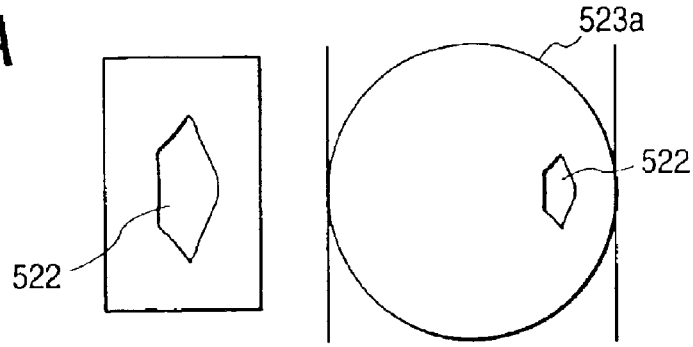
FIGS. 21A to 21C are sectional views to show cross-sectional shapes of another ink flow passage of sealing member.
Figure 21B:
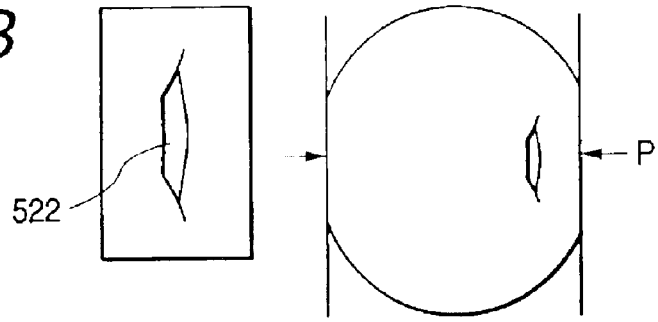
Figure 21C:
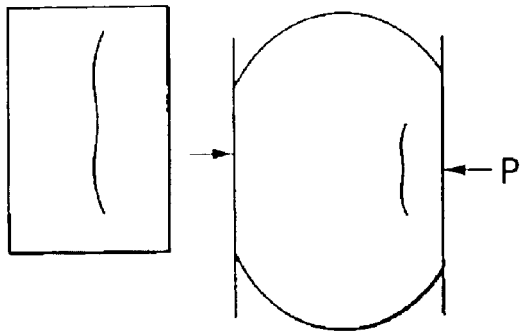

In the above-described embodiment, the valve unit 523 is formed as a separate body from the recording head 7. However, the valve body 523*a* may be formed integrally with the recording head 7 on the top face thereof, as shown in FIGS. 17A and 17B. In this case, the ink supply needle 524 can be eliminated.

In the description of the above-described embodiment, the valve body 523*a* is formed with the pentagonal ink flow passage, as shown in FIG. 15C. However, the ink flow passage is not limited to it and may have any of the shapes shown in FIGS. 18 to 21.

The ink flow passages are gradually closed as shown in from FIGS. 18A to 18D, from FIGS. 19A to 19D, from FIGS. 20A to 20D and FIGS. 21A to 21C.

Each of the rectangular frames shown in FIGS. 18 to 21 is enlargement of the shape of the ink flow passage in the corresponding state.

The ink flow passage 522 in the valve body 523*a* shown in FIG. 18 is formed like a hexagon long in a direction perpendicular to the application direction of the external pressure P.

The ink flow passage 522 in the valve body 523*a* shown in FIG. 19 is formed like a so-called rhombus having a long diagonal line perpendicular to the application direction of the external pressure P.

The apex in the application direction of the external pressure P is shaped like R (curved face) and the apex in the direction perpendicular to the application direction of the external pressure P is shaped like a square.

Further, the ink flow passage 522 in the valve body 523*a* shown in FIG. 20 is formed like a so-called pentagon having one side positioned in a parallel direction to the line perpendicular to the application direction of the external pressure P on the side wall surface side (outer side) and one apex positioned facing the one side on the center side (inner side). The apex positioned on the center side (inner side) is rounded and other apexes are shaped each like a square.

Further, the ink flow passage 522 in the valve body 523*a* shown in FIG. 21 is formed like a so-called pentagon having one apex positioned on the side wall surface side (outer side) and one side positioned in parallel with the line perpendicular to the application direction of the external pressure P on the center side (inner side), contrary to that in FIG. 20.

The apex positioned on the center side (inner side) is rounded and other apexes are shaped each like a square.

Particularly, for the ink flow passage shown in FIG. 21, the tip on the side (side wall surface side) to which the external pressure is applied asymmetrically with respect to the line perpendicular to the application direction of the external pressure P is rounded, the opposite side is shaped like a so-called trapezoid, and the intersection point is shaped like a square. Thus, as compared with the valve bodies 523*a* shown in FIGS. 18 to 20, the crush amount until the ink flow passage is closed can be lessened and consequently the closing load can be decreased.

Next, a suction method of ink from the recording head in the described ink jet recording apparatus will be discussed with reference to a flowchart of FIG. 22.

Figure 22:
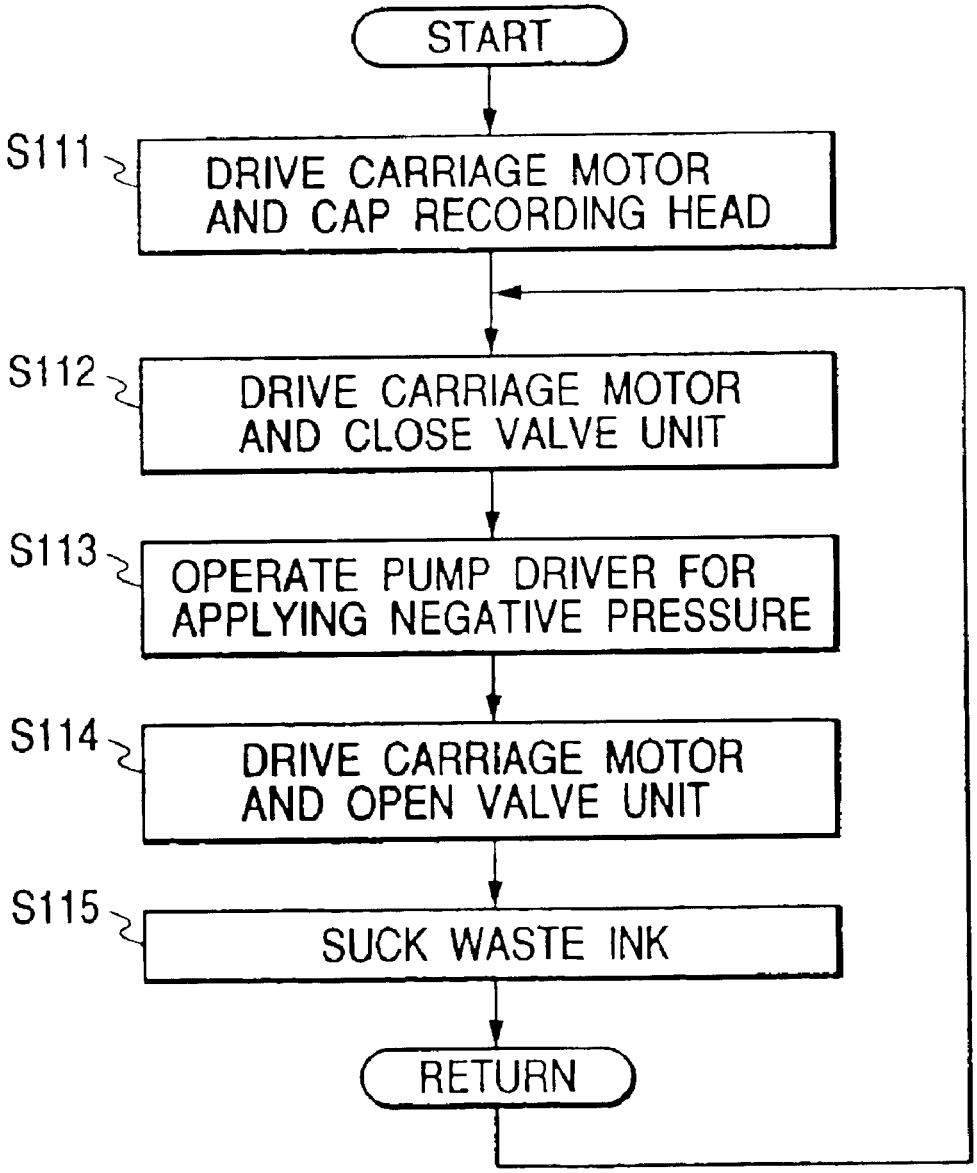
FIG. 22 is a flowchart to show an example of an operation flow executed in a recording apparatus comprising valve unit in the fourth and fifth embodiments.

FIG. 22 shows an example of an ink suction method of powerful cleaning using the valve unit, for example.

At step S111 shown in FIG. 22, the carriage motor 2 is driven for moving the carriage 1 to the non-print area and the recording head is capped.

Subsequently, at step S112, the carriage motor 2 is driven for moving the carriage 1 to the non-print area until the pad 41 of the main body of the recording apparatus and the pin lever 523*f* of the valve unit 523 interfere and the ink flow passage 522 formed in the valve body 523*a* is closed, and the valve unit 523 is closed.

Subsequently, at step S113, the pump driver is operated for applying negative pressure to the nozzle orifices, etc.

Subsequently, at step S114, the carriage motor 2 is driven for moving the carriage 1 to the print area until the pad 41 of the main body of the recording apparatus and the pin lever 523*f* of the valve unit 523 do not interfere, and the valve unit 523 is opened.

As the valve unit 523 is opened, the negative pressure state is opened to the atmosphere instantaneously and the air bubbles in the upper part of the head filter or entering the recording head are discharged from the nozzle orifices together with discharging of ink.

Thus, the valve unit 523 according to the invention is closed at step S112 and negative pressure is applied at step S113, whereby it is made possible to generate negative pressure higher than negative pressure applied by normal pump between the valve unit 523 and the suction pump 11, and a large negative pressure can be generated even by a low-capability pump, so that it is made possible to make low noise, miniaturize the recording apparatus, and manufacture it at low costs.

Sufficient negative pressure is applied between the valve unit 523 and the suction pump 11 at step S113 and when the valve unit 523 is opened at step S114, only the atmospheric open part of the ink cartridge is opened to the atmosphere, so that a quick ink flow occurs from the ink cartridge 8 to the suction pump side.

Thus, the air bubbles moves in the head rapidly following the ink flow and are discharged speedily from the nozzle orifices together with ink.

If the negative pressure is set to $-0.3$ kgf/cm$^2$ with respect to the atmosphere in the closed value state, the bubbles in the upper part of the head filter are expanded and pass through the head filter before the valve unit is opened. After this, if the valve unit is closed, the expanded air bubbles are restored to the former state downstream from the head filter and are discharged to the outside along the ink flow.

Steps S112 to S114 are repeated more than once, whereby it is made possible to discharge air bubbles that cannot be discharged by executing the steps once.

In this case, if the valve unit 523 is opened at step S114 or applied negative pressure becomes atmospheric pressure at step S114 and then again the process is returned to step S112 and the valve unit 523 is closed, applying the negative pressure can be continued until the negative pressure applied at step S113 becomes atmospheric pressure, and the dischargeability of air bubbles can be enhanced.

Further, if before the applied negative pressure is restored to atmospheric pressure after the valve unit 523 is opened at step S114, again the process is returned to step S112 and the valve unit 523 is closed, a pulsation state can be entered as pressure. Also in this case, the dischargeability of air bubbles can be enhanced.

Before the valve unit 523 is closed at step S112, the suction step is executed for sucking ink into the capping unit 10 and the suction pump 11, then the valve closing step (step S112), the suction step (step S113), and the valve opening step (S114) are executed.

The suction step is thus executed before the valve unit 523 is closed, whereby the capping unit 10 and the suction pump 11 are filled with ink, so that negative pressure can be raised rapidly at the subsequent suction step.

Further, the valve unit 523 is opened at step S114 while the suction step (step S113) is being executed.

In this case, negative pressure is always applied to the nozzle orifices, so that air bubbles hard to discharge can also be discharged.

Further, any valve where ink suction is not required is closed, whereby unnecessary ink discharging can be decreased.

The ink discharge amount can also be decreased by closing the valve unit 523 and sucking from the suction pump.

Next, cleaning the ink jet recording head using the valve unit described above will be discussed.

First, after the negative pressure applied into the cap and the recording head 7 is opened at step S114, the valve unit 23 is again closed and remains closed until completion of the wiping operation.

At this time, ink and air bubbles discharged at step S114 remain in the capping unit 10 and are deposited on a nozzle plate of the recording head 7.

However, since the valve unit 523 is closed, the discharged ink and air bubbles can be prevented from flowing backward from the nozzle orifices and at the wiping time, the wiper can be prevented from pushing the air bubbles into the nozzle orifices.

Therefore, destruction of a meniscus formed in the nozzle orifices can be prevented.

It is effective to handle the valve unit also when the ink cartridge is replaced.

That is, the valve unit corresponding to the ink cartridge to be replaced is closed before the ink cartridge is replaced.

To replace the ink cartridge, it is feared that the meniscus of the nozzle orifices may be destroyed due to a shock when a new cartridge is mounted or volume change; the ink cartridge is replaced after the valve unit is closed, whereby the meniscus can be protected when the ink cartridge is replaced.

To replace the ink cartridge, it is made possible to skip the replacement cleaning operation after the ink cartridge is replaced.

In addition, the valve unit 523 is closed in the halt state of the ink jet recording apparatus, during transport thereof, etc.

At this time, the ink flow passage is closed upstream from the nozzle orifices in the valve unit 523.

Thus, drips of ink when the recording apparatus halts can be prevented.

The meniscus can also be protected against a shock during transport of the ink jet recording apparatus.

In the description of the above embodiments of the invention, the recording apparatus comprising the ink cartridge mounted detachably on the carriage (FIG. 1) has been covered.

However, the invention is applied to other recording apparatus than the described recording apparatus.

For example, the invention can also be applied to a recording apparatus of a type wherein a separate main tank (ink cartridge) is placed in the main body of the recording apparatus and a subtank is mounted on a carriage.

FIG. 23 is a plan view to show a sixth embodiment of the ink jet recording apparatus of the type that can incorporate the invention.

In the figure, numeral 1 denotes a carriage. The carriage 1 is driven via a timing belt 3 by a carriage motor 2 and can be reciprocated in the length direction of a paper feed member 5 through a guide shaft 4.

An ink jet recording head 106 is mounted on the side of the carriage 1 facing recording paper 6.

Subtanks 107 as ink storage sections for supplying ink to the recording head 106 are placed on the carriage 1.

In the embodiment, four subtanks 107 are provided in a one-to-one correspondence with black, yellow, magenta, and cyan inks to temporarily store the inks in the subtanks.

Black, yellow, magenta, and cyan inks are supplied to the subtanks 107 from main tanks 108 to 111 as ink cartridges placed at the end of the recording apparatus via tubes 112.

On the other hand, a capping unit 113 for sealing the nozzle formation face of the recording head 106 is placed in a non-print area (home position) on the move path of the recording head 106.

When the carriage 1 moves to the home position, the capping unit 113 can move upward following the move of the carriage 1 for sealing the nozzle formation face of the recording head 106.

The capping unit 113 functions as a lid for sealing the nozzle formation face of the recording head 106 for preventing nozzle orifices from being dried during the halt period of the recording apparatus and functions as an ink receptacle during the flushing operation of idly jetting ink drops by applying a drive signal not involved in print to the recording head 106, and has a function of executing the cleaning operation of causing negative pressure produced by a suction pump (described later) to act on the recording head 106 for sucking and discharging ink from the recording head 106.

As described later, one end of a tube in the suction pump (tube pump) as a decompressor is connected to the internal space of the capping unit 13.

A wiping member 114 comprising an elastic plate of rubber, etc., is placed in the proximity of the print area side in the capping unit 113 so that the wiping member 114 can move forward and backward with respect to the move track of the recording head 106. When the carriage 1 moves to and from the side of the capping unit 113, the wiping member 114 can wipe and clean the nozzle formation face of the recording head 106.

The ink jet recording apparatus shown in FIG. 23 is a comparatively large-scaled recording apparatus mainly provided for offices or business application. To handle a large amount of print, the ink jet recording apparatus needs to comprise large-capacity ink cartridges. Thus, main tanks as ink cartridges are loaded into a cartridge holder placed on the side of the main body of the recording apparatus, for example.

The subtanks are placed on the carriage on which the recording head is mounted, ink is supplied from the main tanks to the subtanks via ink supply tubes, and ink is supplied from the subtanks to the recording head.

Figure 24:
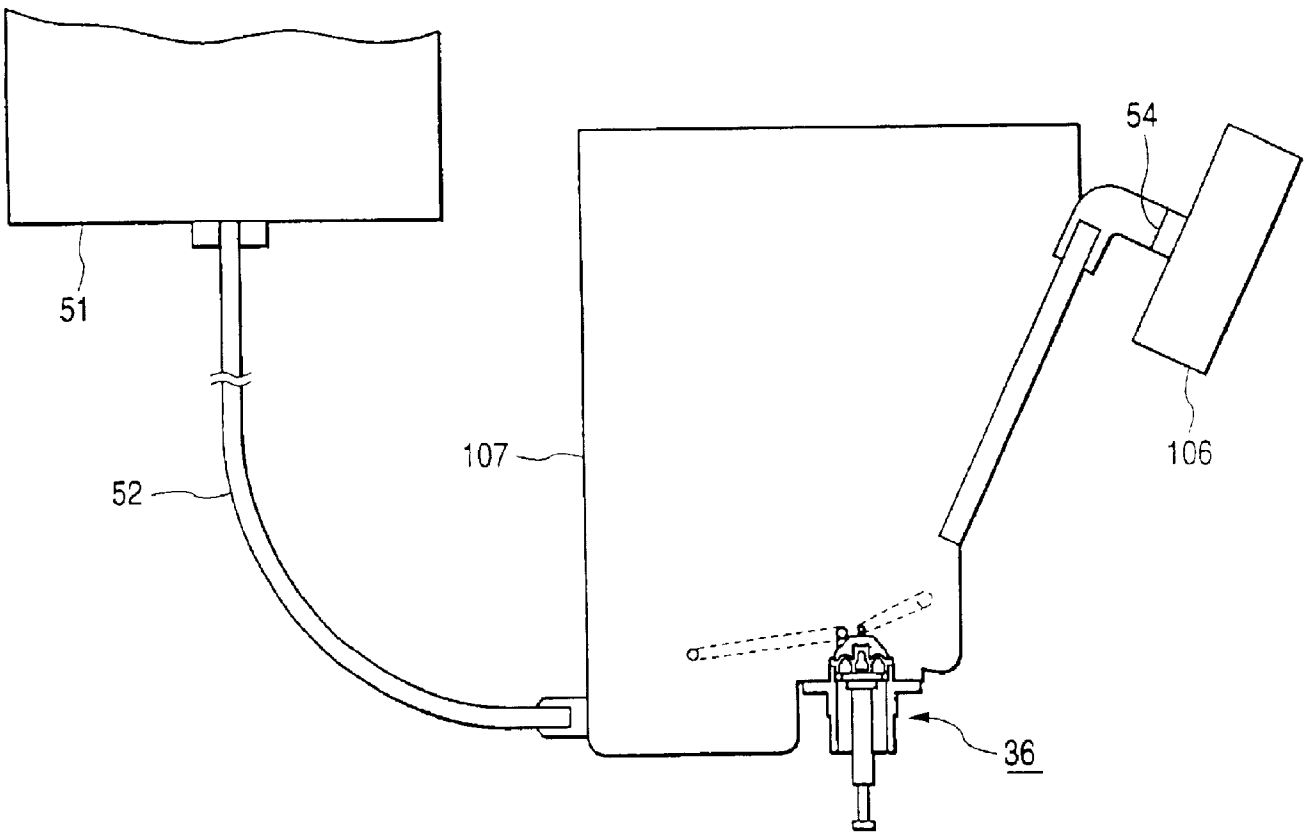
FIG. 24 is a schematic drawing to describe the configuration of the recording apparatus shown in FIG. 23.

That is, as shown in FIG. 24, an ink cartridge 51 is stored in a cartridge holder (not shown) placed in a part of the recording apparatus and ink is supplied from the ink cartridge 51 via a tube 52 to the subtank 30107 as the ink storage section placed on the carriage.

A valve unit 36 for opening and closing the ink flow passage is placed between the subtank 30107 and the recording head 106.

In this case, a filter member 54 is placed in the ink flow passage from the valve unit 36 to the recording head 106 and ink is supplied through the filter member 54 to the recording head 106.

Figure 25:
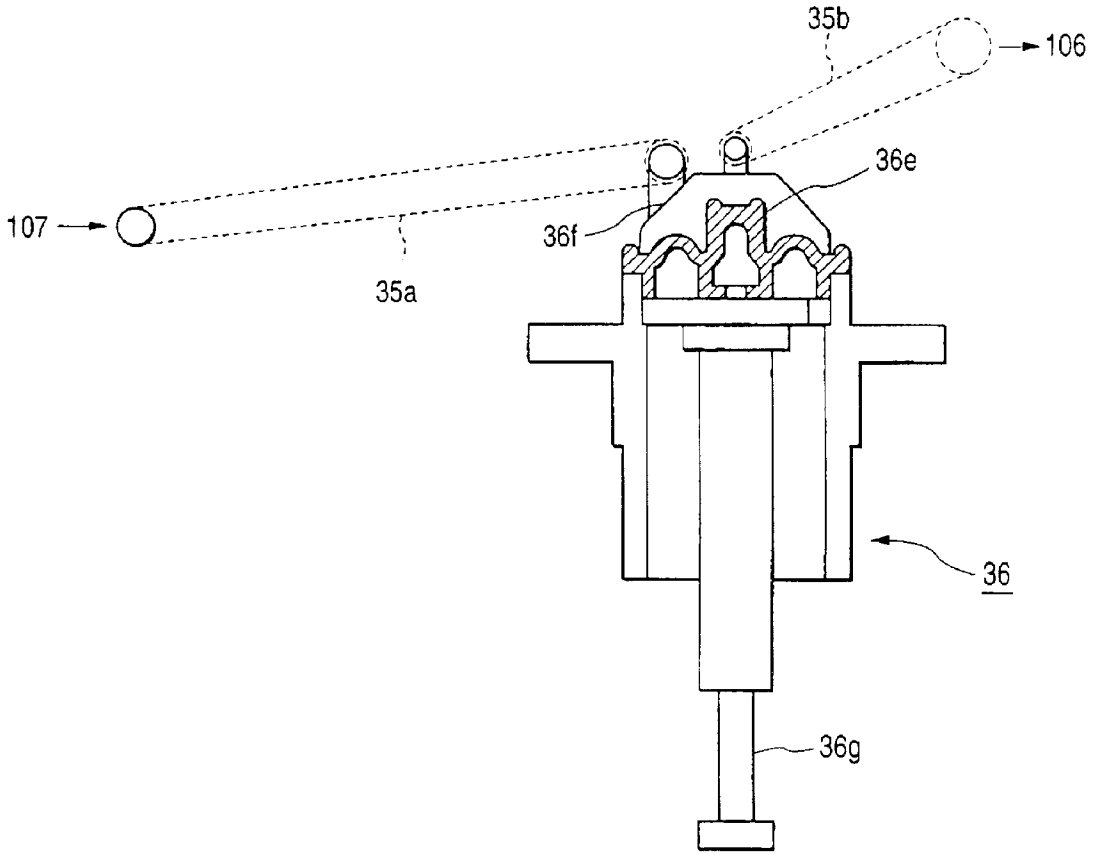
FIG. 25 is an enlarged sectional view to show an example of a valve unit in the recording apparatus shown in FIG. 23.

The valve unit 36 adopts a diaphragm valve 36*e* as shown on an enlarged scale in FIG. 25.

The diaphragm valve 36*e* is placed in a cup-like housing 36*f* placed between an ink flow passage 35*a* from the subtank 30107 and an ink flow passage 35*b* from the diaphragm valve 36*e* to the recording head 106.

A valve shaft 36*g* for supporting almost the center of the diaphragm valve 36*e* is driven axially by an actuator (not shown), whereby the center of the diaphragm valve 36*e* is moved up and down and the valve is opened and closed in the housing 36*f*.

That is, the state shown in FIG. 25 is an open valve state. When the valve shaft 36*g* is driven upward in the figure, the center of the diaphragm valve 36*e* closes the ink flow passage 35*b* to the recording head 106, formed on the housing 36*f* and a closed valve state is entered.

The configuration is preferably adopted for a comparatively large-scaled recording apparatus for handling a large paper width and a comparatively small amount of ink is always stored in each subtank, whereby inertia resistance for the reciprocating carriage can be decreased. The advantages similar to those described above can also be provided by adopting the control sequence shown in FIG. 8, 10, or 11 in the described recording apparatus.

Next, a seventh embodiment of ink jet recording apparatus of the invention will be discussed.

This preferred embodiment of ink jet recording apparatus of the invention, first an ink jet recording apparatus comprising a valve unit high in durability and capable of providing a reliable opening/closing action with a comparatively small actuating force will be discussed.

The embodiment discussed here can be applied to both a recording apparatus of a type wherein an ink cartridge placed on a carriage is used as an ink storage section (see FIG. 1) and a recording apparatus of a type wherein a separate main tank is placed in the main body of the recording apparatus and a subtank is mounted on a carriage (see FIG. 23); the latter type is taken as an example in the description to follow.

Figure 26:
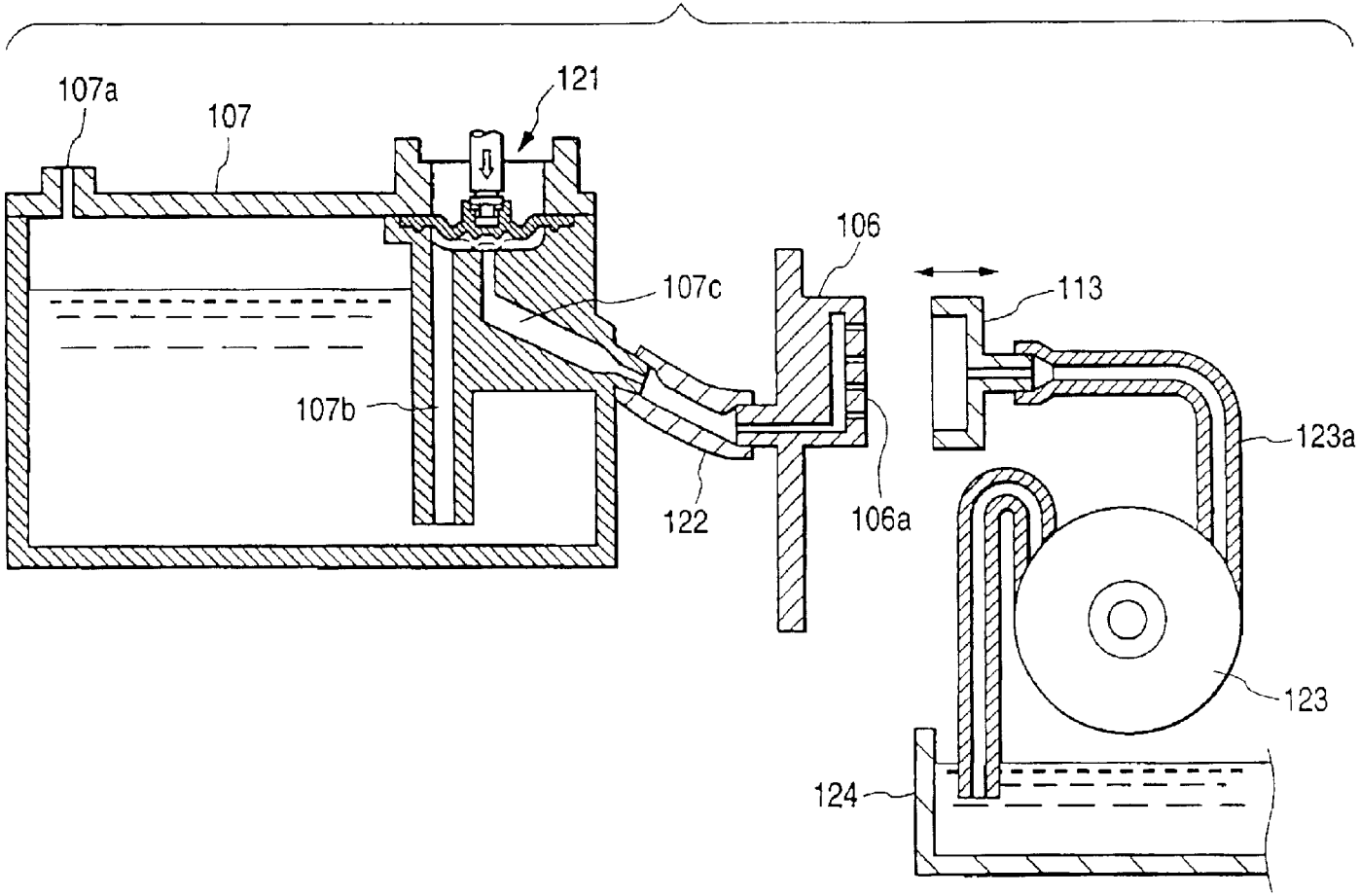
FIG. 26 is a sectional view to show a seventh embodiment of a cleaning control mechanism.

FIG. 26 is a schematic drawing to show an ink supply passage from a subtank to a recording head of a recording apparatus incorporating the embodiment and a discharge passage from capping unit to a waste ink tank.

In FIG. 26, numeral 107 denotes one subtank as an ink storage section. The subtank 30107 is formed in a part with an ink entrance port 107*a* for receiving supply of ink from one ink cartridge corresponding to the subtank 30107.

The subtank 30107 is also formed with an ink guide passage 107*b* for guiding ink from the vicinity of the bottom part, and an ink derivation passage 107*c* through a valve unit 121 (described later).

A connection tube 122 is connected at one end to the ink derivation passage 107*c* and at an opposite end to the recording head 106, thereby forming an ink supply passage from the subtank to the recording head.

On the other hand, a tube 123*a* forming a part of a suction pump (tube pump) 123 is connected at one end to the internal space of capping unit 113 and an opposite end of the tube through the suction pump is placed so as to face the inside of a waste ink tank 124.

In the configuration, when the cleaning operation is performed, a nozzle formation face 106*a* of the recording head 106 is sealed by the capping unit 113 and negative pressure is applied from the suction pump 123.

Ink discharged into the capping unit 113 by performing the cleaning operation is discharged into the waste ink tank 124 placed on the discharge side of the suction pump 123.

Figure 27:
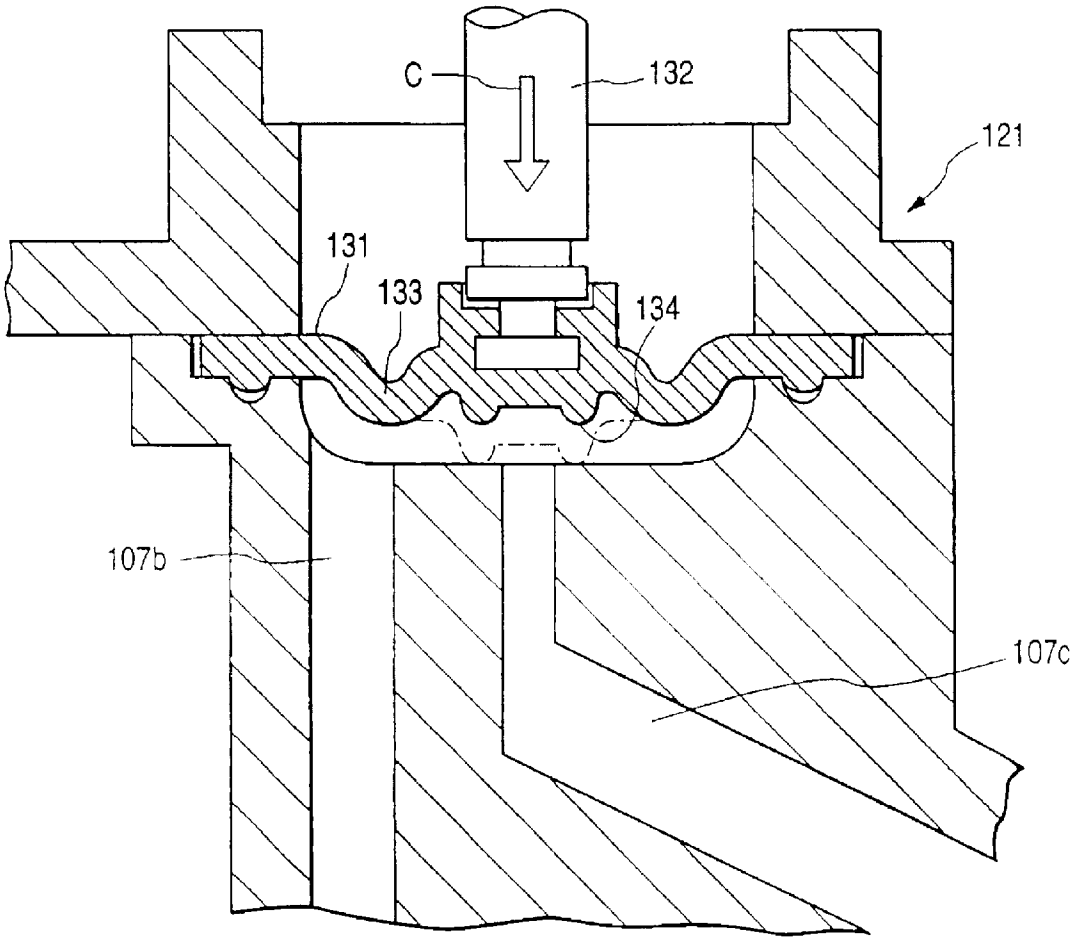
FIG. 27 is an enlarged sectional view to show a valve unit adopted in the embodiment shown in FIG. 26.

FIG. 27 shows the configuration of the valve unit 121 placed in the subtank 30107 on an enlarged scale.

A diaphragm 131 formed of a flexible material of rubber, etc., almost like a disc is attached to the valve unit 121 shown in FIG. 27 with the peripheral margin of the diaphragm 131 sandwiched between an upper case and a lower case forming the subtank 30107.

The ink guide passage 107*b* formed in the subtank 30107 is opened in a part in the circumferential direction on one side of the diaphragm 131 (in the figure, the bottom side of the diaphragm), and the communication hole, namely, the ink derivation passage 107*c* is opened in a position opposed to the center of the diaphragm 131.

One end part of a rod 132 as an actuation body is attached to the center on an opposite side of the diaphragm 131 (in the figure, the top side of the diaphragm) so that it is buried in the diaphragm 131. The rod 132 is driven by an actuator (not shown) in the C direction in the figure.

A bend part 133 is formed like a ring between the center and the peripheral margin of the diaphragm 131. When the rod 132 is driven axially, mechanical resistance in the move action of the center of the diaphragm 131 through the bend part 133 is lessened.

Further, an annular convex 134 is formed almost at the center on the bottom side of the diaphragm 131. The center of the diaphragm 131 is deformed in a direction orthogonal to the side (plane) direction by press pressure of the rod 132 and the opening toward the communication hole, namely, the ink derivation passage 107*c* for forming the ink flow passage to the recording head can be closed by the annular convex 134 as indicated by the chain line.

The described valve unit 121 holds an open valve state at the normal time with the diaphragm 131 placed in the state shown in FIG. 27.

When the rod 132 is driven in the arrow direction A by the actuator, the center of the diaphragm 131 moves down via the annular bend part 133 and the opening toward the ink derivation passage 107*c* is closed by the annular convex 134 as indicated by the chain line, as described above.

In this case, the rod 132 can deform a little the center of the diaphragm 131 to set a closed valve state and the press pressure of the rod 132 is released, whereby an open valve state can be set by the restoration force of the diaphragm 131. Therefore, the actuation force of the actuator required for the opening or closing operation of the valve unit 121 needs to be only a little.

The valve unit 121 is placed in the closed valve state in a state in which the nozzle formation face 106*a* of the recording head 106 is sealed by the capping unit 113 and negative pressure is received from the suction pump 123; the valve unit 121 is placed in the open valve state in a state in which negative pressure is accumulated in the ink flow passage from the diaphragm 131 to the recording head 106.

Such an operation sequence is executed, whereby a fast ink flow can be generated in the ink flow passage instantaneously just after the valve unit 121 is opened, and air bubbles existing in the ink flow passage together with ink having increased viscosity can be easily discharged into the side of the capping unit 113.

In a state in which the valve unit 121 is closed and negative pressure is received from the suction pump 123, the diaphragm 131 receives the negative pressure and the opening toward the ink derivation passage 107*c* is sealed more reliably by the annular convex 134 for maintaining a reliable valve closing function.

Further, the operation of opening and closing the valve by the diaphragm 131 in the described configuration can lead to extremely small volume change of the recording head involved in the operation of opening and closing the valve and a problem of destroying a meniscus of ink formed in the nozzle orifices of the recording head can be circumvented.

Figure 28:
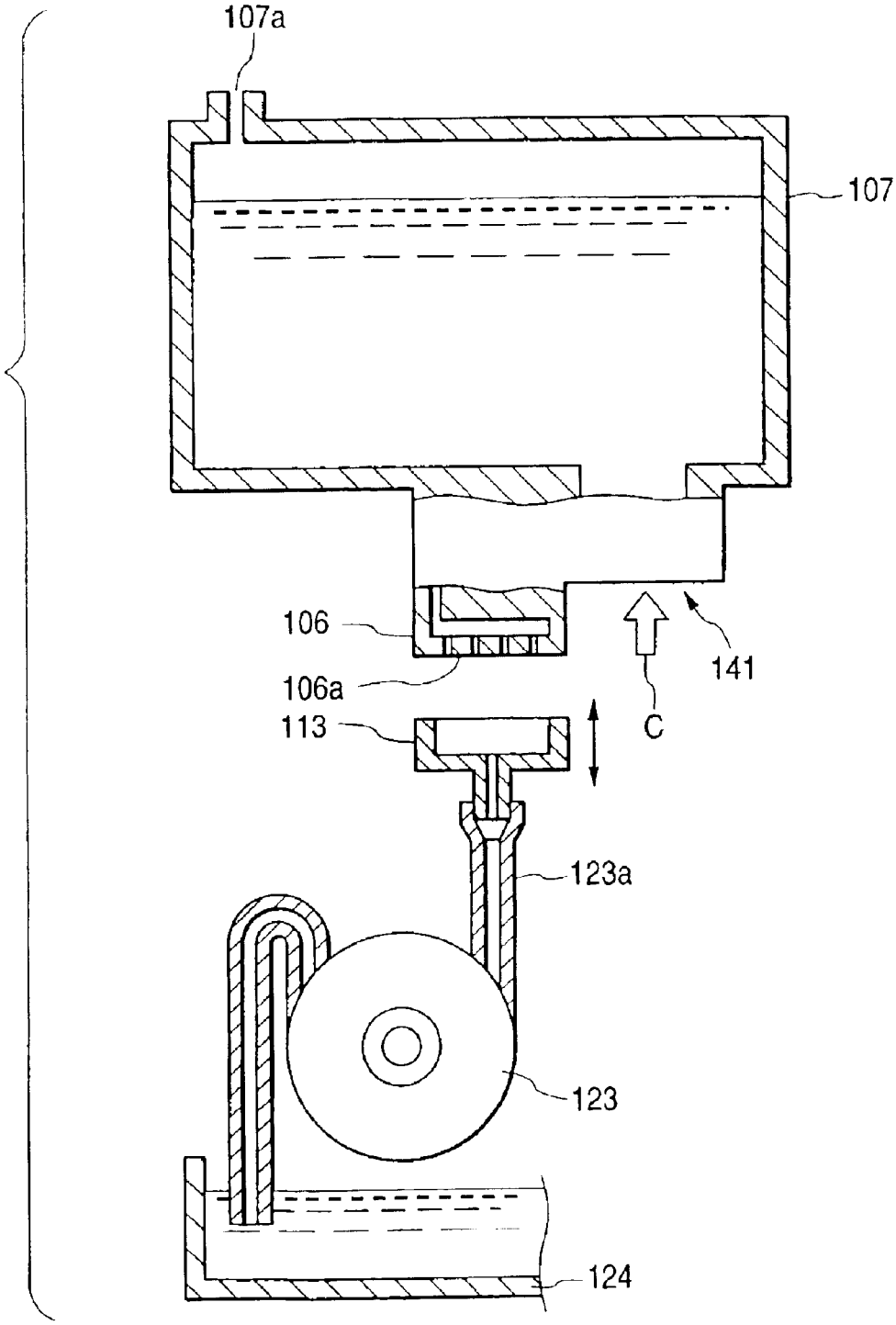
FIG. 28 is a sectional view to show an eighth embodiment of a cleaning control mechanism.

Next, FIG. 28 shows an eighth embodiment as valve unit; it is a schematic drawing to show an ink supply passage from a subtank as an ink storage section to a recording head and a discharge passage from capping unit to a waste ink tank like FIG. 26.

Parts identical with or similar to those previously described with reference to FIG. 26 are denoted by the same reference numerals and therefore will not be discussed again.

A valve unit 141 in the embodiment shown in FIG. 28 is placed in a bottom part of a subtank 30107 as an ink storage section for supplying ink to a recording head 106 formed integrally with them.

Figure 29:
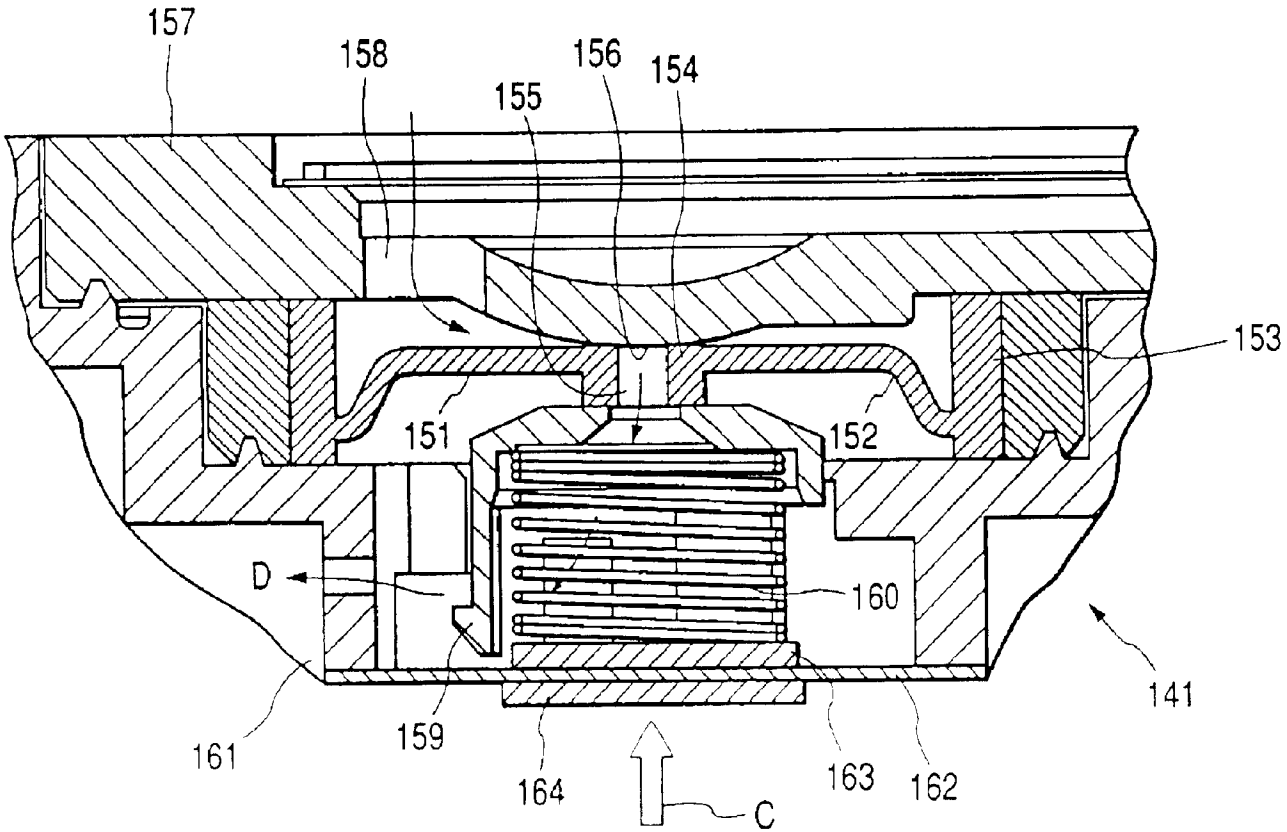
FIG. 29 is a sectional view to show a valve unit preferably adopted in the embodiment shown in FIG. 28.

FIG. 29 shows the configuration of the valve unit 141 placed in the bottom part of the subtank 30107 on an enlarged scale.

As shown in FIG. 29, the valve unit 141 comprises a diaphragm 151 made of a flexible material, such as rubber. The diaphragm 151 has a peripheral margin formed integrally with an annular retention member 153 via a bend part 152.

A thick valve body 154 is formed integrally almost at the center of the diaphragm 151 and is formed with a through hole 155 made from one side to an opposite side as an ink flow passage from the subtank 30107 to the recording head 106.

A wall member 156 formed a little like a sphere is placed upstream from the valve body 154 formed almost at the center of the diaphragm 151, namely, in the bottom part of the subtank 30107, and a part of a member 157 for forming the wall member 156 in one piece is formed with a through hole 158 allowing ink to be introduced into the valve body 154 from the subtank 30107.

On the other hand, a coil-like spring member 160 for urging the valve body 154 toward the wall member 156 via a spring washer 159 all the time is placed downstream from the valve body 154 formed almost at the center of the diaphragm 151.

The spring member 160 is abutted at an opposite end against a plate body 163 put on a film member 162 attached so as to close the bottom face of the annular member 161. A press plate 164 is attached to a position opposed to the plate body 163 via the film member 162 and press pressure of an actuator (not shown) acts on the press plate 164 in the arrow C direction.

Therefore, according to the described valve unit 141, upon reception of the press pressure of the actuator in the arrow C direction, the valve body 154 formed almost at the center of the diaphragm 151 via the spring member 160 abuts the wall member 156 and acts so as to enter a closed valve state for blocking an ink flow from the upstream side to the downstream side.

When the press pressure of the actuator in the arrow C direction is not received, as shown in FIG. 29, the valve body 154 is brought into contact with the wall member 156 by adequate press pressure of the spring member 160 and therefore forms a check valve.

In this case, the valve body 154 forms a check valve as described above and also allows ink to flow in the arrow D direction while it is a little brought into or out of contact with the wall member 156 because of a predetermined or more pressure difference between the upper stream side and the downstream side of the diaphragm 151, namely, forms a pressure regulating valve.

Particularly, according to the configuration shown in the figure, the diaphragm 151 receives differential pressure in a wide area, becomes deformed downstream, and supplies ink from the subtank 30107 to the recording head 106 via a passage as indicated by the arrow D in response to slight ink consumption of the recording head. Therefore, the ink supply action can be carried out without causing successive load to act on the recording head.

According to the described configuration, the actuation force of the actuator required for the opening or closing operation of the valve unit 141 needs to be only a little. In addition, volume change of the recording head involved in the operation of opening and closing the valve can be made extremely small and a problem of destroying a meniscus of ink formed in the nozzle orifices of the recording head can be circumvented.

The valve unit 141 is placed in the closed valve state by press pressure of the actuator in the arrow A direction in a state in which a nozzle formation face 106*a* of the recording head 106 is sealed by the capping unit 113 and negative pressure is received from the suction pump 123; the valve unit 141 is placed in the open valve state in a state in which negative pressure is accumulated in the ink flow passage from the diaphragm 151 to the recording head 106.

Such an operation sequence is executed, whereby a fast ink flow can be generated in the ink flow passage instantaneously just after the valve unit 141 is opened, and air bubbles existing in the ink flow passage together with ink having increased viscosity can be easily discharged into the side of the capping unit 113.

Next, a ninth embodiment of an ink jet recording apparatus that can be applied to both the ink cartridge type and the subtank type like the eighth embodiment, is excellent in durability and reliability of the operation, does not cause pressure change in a recording head in the valve opening or closing operation, and comprises a valve unit in which air bubbles are hard to remain will be discussed.

Figure 30:
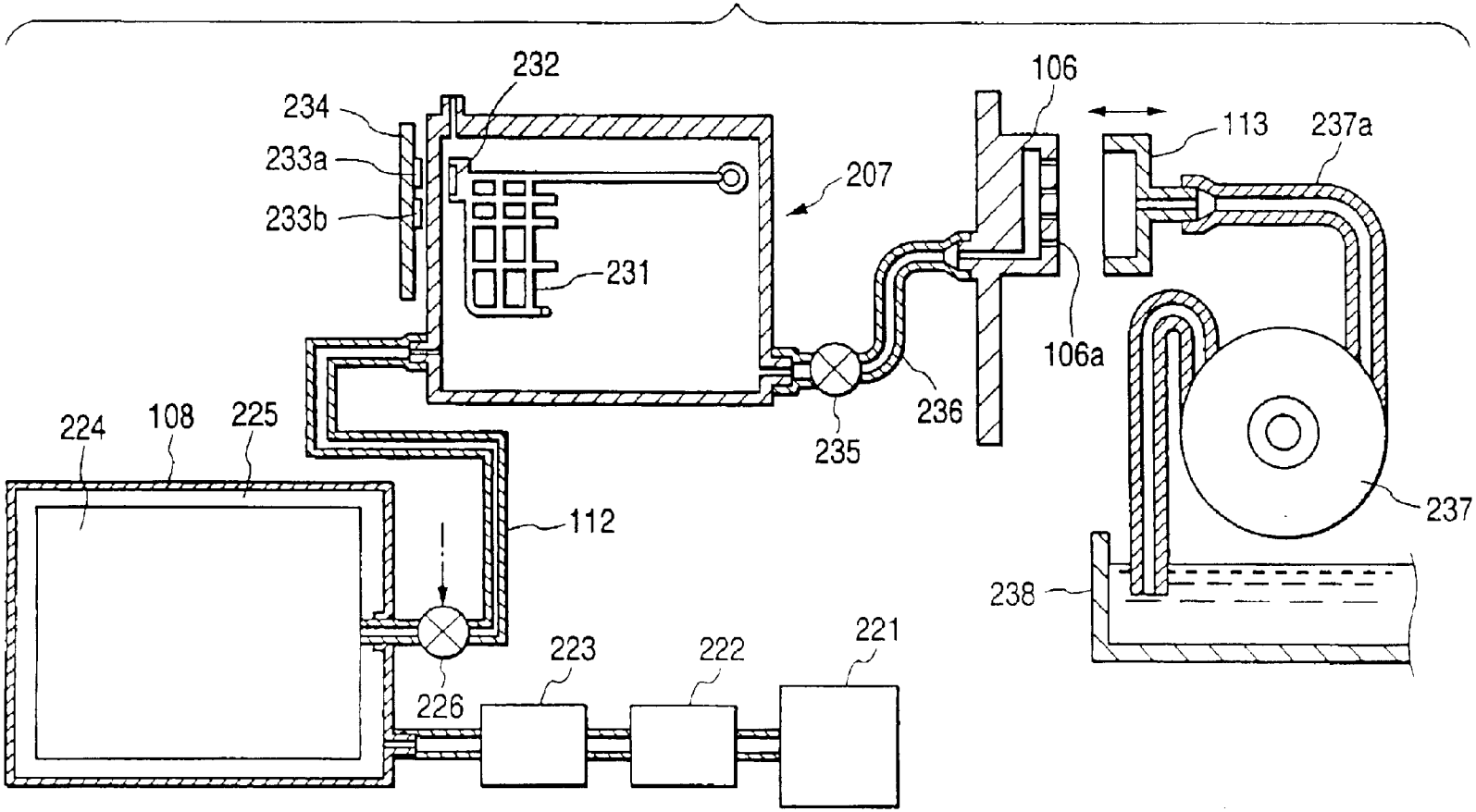
FIG. 30 is a schematic drawing to show an ink supply system from a main tank to a recording head in the recording apparatus according to a ninth embodiment of the invention.

FIG. 30 shows schematically a preferred ink supply system that can be installed in the recording apparatus of the type shown in FIG. 23.

In FIG. 30, numeral 221 denotes a compressor pump. Pressurized air produced by the compressor pump 221 is supplied to a pressure regulating valve 222 and the pressurized air regulated by the pressure regulating valve 222 is supplied via a pressure detector 223 to a main tank 108 (in FIG. 30, one of the main tanks is shown as a representative).

FIG. 30 shows a schematic configuration of the main tank 108. As shown here, the outer hull of the main tank 108 is formed in a hermetic state and an ink pack 224 formed of a flexible material encapsulating ink is housed in the main tank 108.

The space provided between the outer hull of the main tank 108 and the ink pack 224 forms a pressure chamber 225 and pressurized air via the pressure detector 223 is supplied to the pressure chamber 225.

According to the configuration, the ink pack 224 housed in the main tank 108 receives pressurization of the pressurized air and causes an ink flow to be produced from the main tank 108 to a subtank 207.

Therefore, ink pressurized in the main tank 108 is supplied to the subtank 207 mounted on a carriage via an ink replenishment valve 226 and an ink replenishment tube 112.

The configuration of the subtank 207 shown in FIG. 30 will be discussed in detail below. In the basic configuration of the subtank 207, a float member 231 is placed in the subtank 207 and a permanent magnet is attached to a part of the float member 231.

Magnetoelectric devices 233*a* and 233*b* typified by hall devices are placed on a board 234 and are attached to a side wall of the subtank 207.

According to the configuration, a magnetic force line of the permanent magnet 232 acts on the magnetoelectric devices 233*a* and 233*b* in accordance with the float position of the float member 231 responsive to the ink amount in the subtank 207.

Therefore, the ink amount in the subtank 207 can be detected based on electric output of the magnetoelectric devices 233*a* and 233*b*.

According to the described configuration, for example, if the ink amount in the subtank 207 lessens, the position of the float member 231 housed in the subtank 207 moves in the gravity direction and the position of the permanent magnet 232 also moves in the gravity direction accordingly.

Therefore, the ink replenishment valve 226 is opened in response to electric output of the magnetoelectric devices 233*a* and 233*b* as the permanent magnet 232 moves.

Thus, the ink pressurized in the main tank 108 is sent to the subtank 207 in which the ink amount lowers.

If the ink amount in the subtank 207 reaches a sufficient amount, the valve 226 is opened based on electric output of the magnetoelectric devices 233*a* and 233*b*.

Such a process is repeated, whereby ink is supplied from the main tank 108 to the subtank 207 intermittently, so that an almost constant amount of ink is always stored in each subtank.

Since the ink pressurized by air pressure in the main tank 108 is thus supplied to each subtank based on electric output based on the position of the float member placed in the subtank, ink replenishment response can be enhanced and the ink storage amount in the subtank can be managed appropriately.

From the subtank 207, ink is supplied to the recording head 106 via a valve unit 235 (described later) and a tube 236 connected thereto.

Ink drops are jetted from nozzle orifices 106*a* in a nozzle formation face of the recording head based on print data given to an actuator (not shown) of the recording head 106.

In FIG. 30, numeral 113 denotes capping unit. A tube 237*a* connected at one end to the capping unit 113 forms a part of a suction pump (tube pump) 237 as decompressor.

The tube 237*a* is connected at an opposite end to a waste ink tank 238 and waste ink sucked by the suction pump 237 is derived into the waste ink tank 238.

Figure 31:
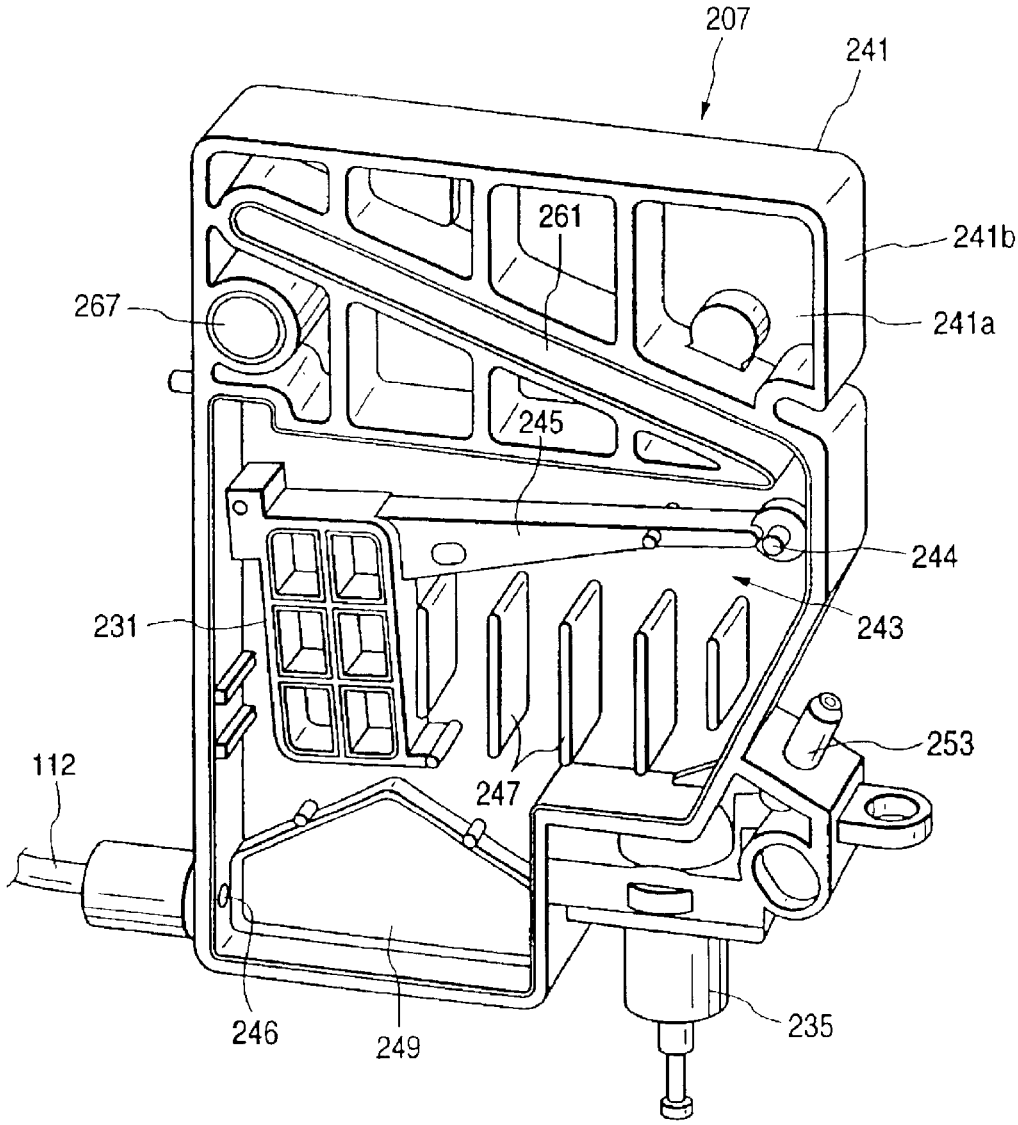
FIG. 31 is a perspective view of a subtank with a part thereof omitted, viewed from one side direction.
Figure 32:
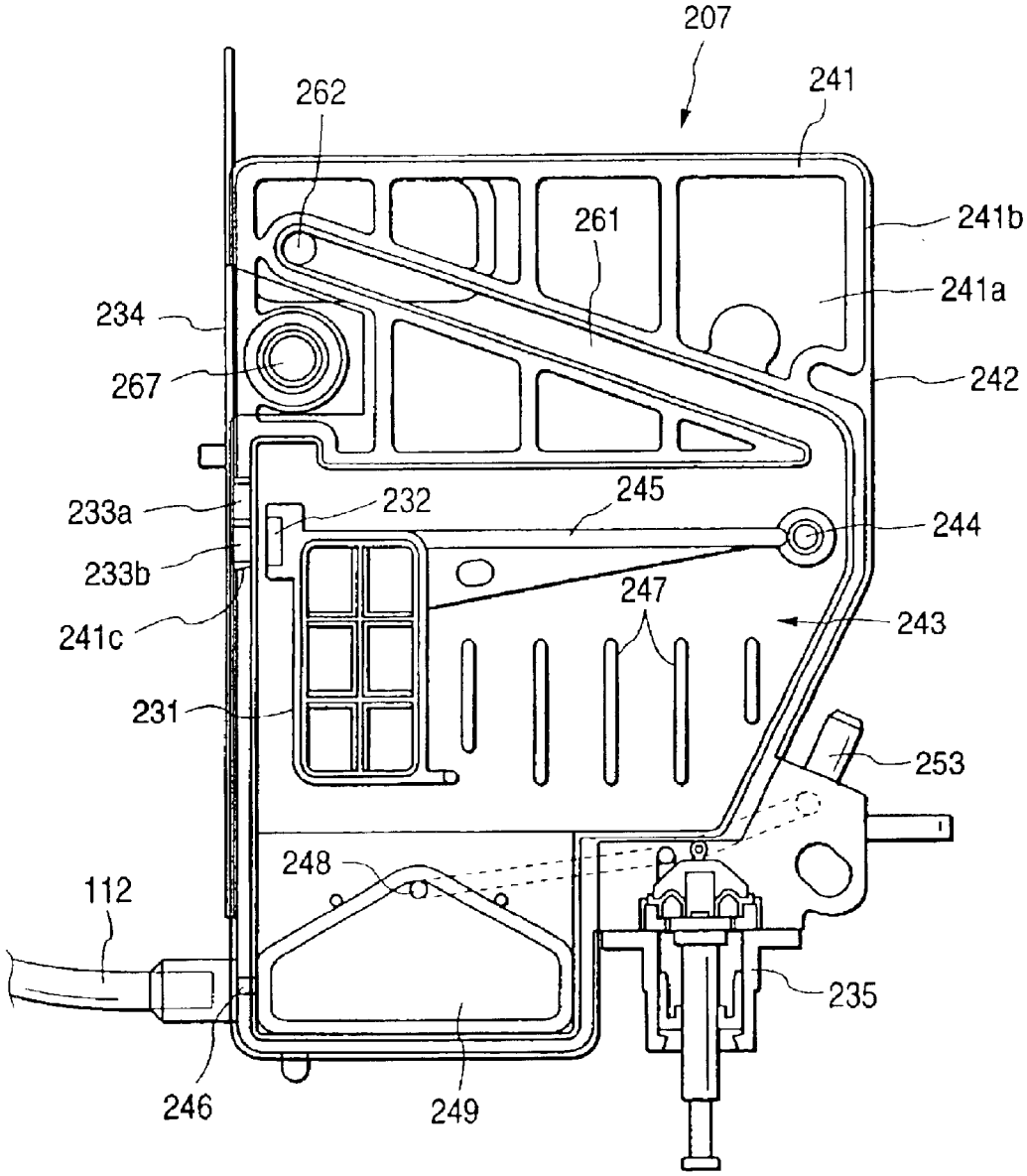
FIG. 32 is a perspective view of the subtank from one side direction.
Figure 33:
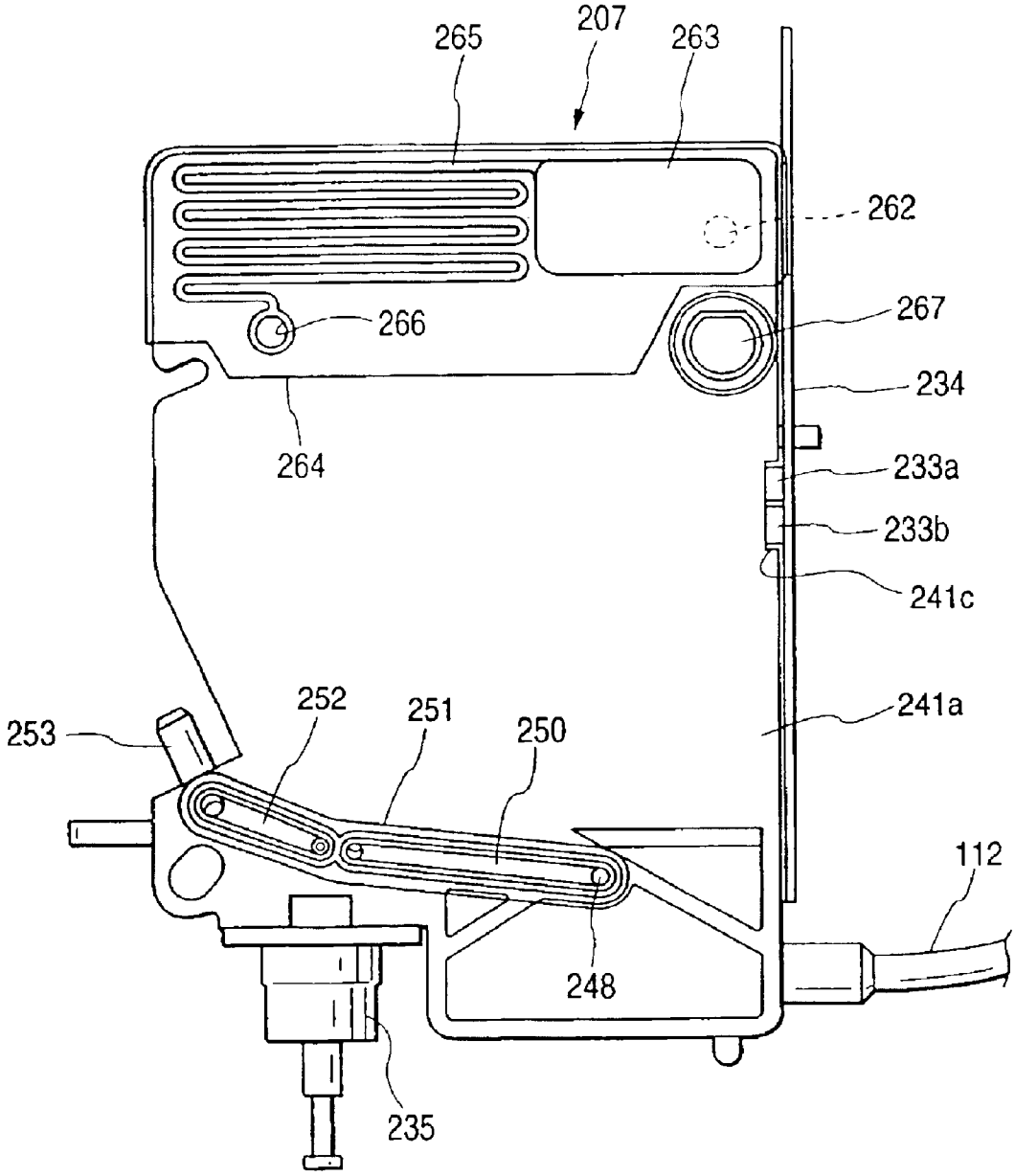
FIG. 33 is a rear view of the subtank from the rear direction.

FIGS. 31 to 33 show an embodiment of the described subtank 207. FIG. 31 is a perspective view of the subtank with a part thereof omitted, viewed from one side direction, and FIG. 32 is a perspective view of the subtank from the direction.

Further, FIG. 33 is a rear view of the subtank from the rear direction.

Parts identical with or similar to those previously described are denoted by the same reference numerals in FIGS. 31 to 33.

The subtank 207 is formed almost like a rectangular parallelepiped and the whole is made flat.

The outer hull of the subtank 207 is formed of a box-like member 241 comprising one side wall 241*a* and a peripheral wall 241*b* contiguous therewith molded in one piece. A film-like member 242 made of, for example, a transparent resin (see FIG. 32) is attached to the opening peripheral margin of the box-like member 241 in an intimate contact state by thermal welding and an ink storage space 243 is formed in the space surrounded by the box-like member 241 and the film-like member 242.

A support shaft 244 projecting toward the ink storage space 243 from the one side wall 241*a* forming a part of the box-like member 241 is formed integrally with the box-like member 241, and a float member 231 is placed so that it can rotate on the support shaft 244 in the gravity direction in the ink storage space 243.

In the embodiment, the support shaft 244 is placed in the proximity of the end part in the horizontal direction in the ink storage space 243 and float member 231 is formed integrally with a support arm 245 rotated on the support shaft 244 at a movable free end of the support arm 245.

As shown in FIG. 32, the above-mentioned permanent magnet 232 is attached to the movable free end of the support arm 245. When the support arm 245 is placed almost in a horizontal state, the permanent magnet 232 is placed in the proximity of an opposite end part in the horizontal direction in the ink storage space 243, namely, is brought closest to the hall devices 233*a* and 233*b* placed on the board 234, attached to the side wall of the subtank 207.

The hall device 233*a*, 233*b* is inserted into a positioning concave 241*c* made in the side wall of the subtank 207. As the positioning concave 241*c* is made, the side wall of the subtank 207 is made thinner, so that the distance between the move trace of the permanent magnet 232 attached to the float member 231 and each hall device 233*a*, 233*b* can be made shorter.

On the other hand, an ink replenishment port 246 is formed in a lower part of the subtank 207 in the gravity direction, namely, in the bottom of the peripheral wall 241*b* in the embodiment, and ink is supplied to the ink storage space 243 from the main tank 108 via the above-mentioned tube 112 connected to the ink replenishment port 246.

As the ink replenishment port 246 in the subtank 207 is formed in the lower part in the gravity direction as described above, ink from the main tank is supplied from the bottom of the ink storage space 243, so that occurrence of ink bubbles in the ink storage space 243 as ink is supplied is prevented.

A plurality of ribs for decreasing the occurrence degree of ink waves in the subtank as the carriage moves are placed in a portion circumventing the move areas of the float member 231 and the support arm 245 in the subtank 207. In the embodiment, the ribs 247 are formed integrally with the box-like member 241 on the base of the one side wall 241*a* so as to project toward the ink storage space 243 from the one side wall 241*a* of the box-like member 241 forming a part of the subtank 207, but may be formed as separate bodies.

As described above, the occurrence degree of ink waves in the subtank can be decreased in the presence of the ribs 247, so that the detection accuracy of the hall devices for detecting the storage amount of ink in the subtank 207 can be enhanced.

In the subtank 207, an ink derivation port 248 is formed near the ink replenishment port 246.

A filter member 249 for trapping foreign substances, shaped like a pentagon (home plate) is placed so as to cover the ink derivation port 248. Therefore, ink stored in the subtank 207 is guided into the ink derivation port 248 through the filter member 249.

Moreover, since the ink derivation port 248 is formed near the ink replenishment port 246, comparatively new ink introduced into the subtank 207 is derived immediately from the ink derivation port 248.

As shown in FIG. 33, the ink derived from the ink derivation port 248 is guided into a groove 250 formed in the rear face of the side wall 241*a* and leads to the above-mentioned valve unit 235 placed on the bottom of the subtank 207 via an ink derivation passage formed of a film-like member 251 thermally welded so as to cover the groove 250.

The ink is guided through the valve unit 235 into a groove 252 formed in the rear face of the side wall 241*a* and is made to lead to a connection port 253 of a tube 236 connected to the recording head 206 through an ink derivation passage (denoted by the same numeral 252 as the groove) formed of the above-mentioned film-like member 251 thermally welded so as to cover the groove.

On the other hand, as shown in FIGS. 31 and 32, a communication groove 261 communicating with the ink storage space 243 is formed in an inclination state in the upper half part of the subtank 207, and an air hole 262 piercing the side wall 241*a* of the subtank 207 to the rear face is made in the upper end part of the communication groove 261, namely, in a higher part of the subtank 207 in the gravity direction.

The air hole 262 is closed by a water repellent film 263 placed on the rear face of the subtank 207 and shaped almost like a rectangle for allowing the atmosphere to pass through and blocking the passage of ink, as shown in FIG. 33.

The water repellent film 263 is placed in such a manner that it is housed in a recess made in the rear face of the side wall 241*a* of the subtank 207, and is retained by a film member 264 thermally welded so as to cover the rear face of the upper part of the side wall 241*a*.

A meander groove 265 is formed in the rear face of the side wall 241 a via the water repellent film 263 and communicates at one end part with a closed-end hole 266 made in the side wall 241*a* of the subtank 207.

The meander groove 265 and the closed-end hole 266 are covered with the film member 264 in a hermetic state and therefore an air circulation resistance passage (denoted by the same numeral 265 as the meander groove) is formed of the meander groove 265 and the film member 264.

The film member 264 covering the closed-end hole 266 is destroyed with a sharp tool, etc., whereby the air hole 262 is allowed to communicate with the atmosphere via the air circulation resistance passage 265 formed like a meander.

Since the air hole 262 formed in the subtank 207 is covered with the water repellent film 263, if the whole recording apparatus is turned upside down, for example, by error, a problem of leaking ink in the subtank 207 can be circumvented in the presence of the water repellent film 263.

The closed-end hole 266 made in the end part of the air circulation resistance passage 265 is previously covered with the film member 264 in the hermetic state, whereby the subtank can be checked for liquid leakage (ink leakage) upon completion of the subtank as a single. Upon completion of the checking, the film member 264 covering the closed-end hole 266 is destroyed, whereby the original function can be provided.

The subtank 207 is formed with a through hole 267. The subtanks 207 are supported in a parallel state by one support shaft (not shown) piercing the through holes 267 for supporting the subtanks 207 for forming a subtank unit.

Figure 34:
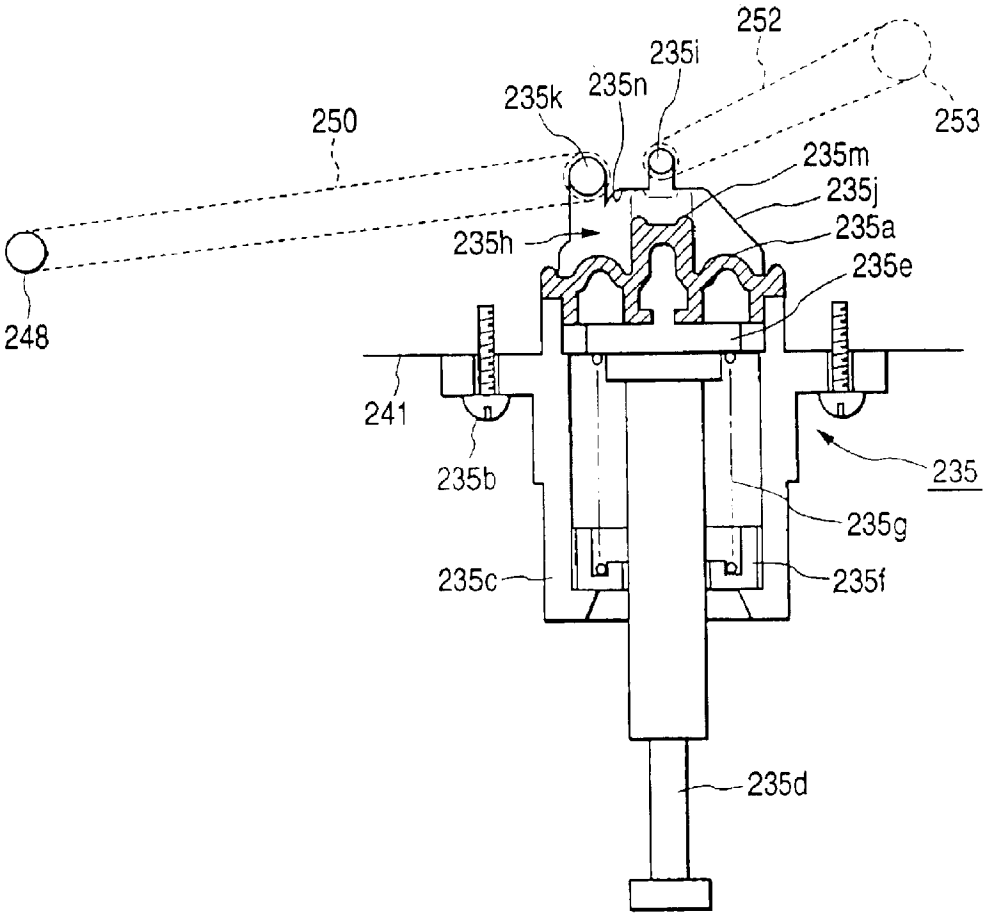
FIG. 34 is an enlarged sectional view to show an embodiment of a valve unit placed on a part of the subtank.

FIG. 34 is an enlarged sectional view to show the valve unit 235 placed on the subtank 207 described above.

The valve unit 235, which is placed between the subtank 207 as the ink storage section and the recording head 106 as described above, has a control function of opening and closing the ink flow passage of the recording head.

In a state in which the valve unit 235 is closed, negative pressure is given from a suction pump to the capping unit 113 sealing the nozzle formation face of the recording head 106 and in a state in which sufficient negative pressure is accumulated, the valve unit 235 is opened.

Under this control, a fast ink flow can be generated instantaneously in the ink flow passage from the subtank 207 to nozzle orifices 206*a* of the recording head, and the air bubbles remaining in the ink flow passage can be discharged effectively.

A diaphragm valve 235*a* made of a flexible material, such as a rubber material, is used with the valve unit 235, as shown in FIG. 34.

The diaphragm valve 235*a* is attached with the peripheral margin of the diaphragm valve 235*a* sandwiched between the box-like member 241 forming a part of the subtank 207 and a cylinder member 235*c* attached to the box-like member 241 by screws 235*b*.

One end part of a rod 235*d* as an actuation body is attached to the bottom side of the diaphragm valve 235*a* in the gravity direction. Upon reception of an axial drive force of the rod 235*d*, almost the center of the diaphragm valve 235*a* is deformed in a direction orthogonal to the side (plane) direction.

The rod 235*d* can move in the vertical direction in the cylinder member 235*c*. The center of the diaphragm valve

235*a* is urged to as to project upward as shown by the chain line by the action of a coil spring 235*g* placed between a disc-like body 235*e* formed on the rod 235*d* and a spring holder 235*f* placed on the inner bottom of the cylinder member 235*c*.

The top side of the diaphragm valve 235*a* in the gravity direction forms an valving control chamber 235*h* of the ink flow passage from the subtank 207 to the recording head 206.

An exit port 235*i* is formed in the valving control chamber 235*h* just above almost the center of the diaphragm valve 235*a*.

An annular abutment face 235*n* against which an annular convex 235*m* (described later) formed on the diaphragm valve 235*a* is abutted is formed in the surrounding of the exit port 235*i* in the valving control chamber 235*h*.

A slope 235*j* whose diameter gradually lessens toward the anti-gravity direction is formed contiguous with the surrounding of the annular abutment face 235*n*.

The inclination angle of the slope 235*j* is about 45 degrees with the anti-gravity direction in the embodiment; preferably it is in the range of ±15 degrees with respect to 45 degrees shown in the embodiment.

On the other hand, an entrance port 235*k* from the subtank 207 to the valving control chamber 235*h* is formed at a position circumventing the position just above the center of the diaphragm valve 235*a*, namely, is formed in a part of the slope 235*j* in the embodiment shown in FIG. 34.

Further, the above-mentioned annular convex 235*m* is formed integrally almost at the center of the diaphragm valve 235*a* facing the side of the valving control chamber 235*h*. As the diaphragm valve 235*a* becomes deformed upward, the annular convex 235*m* abuts the annular abutment face 235*n* formed in the surrounding of the exit port 235*i* and can close the exit port 235*i*.

In the described configuration, at the normal time, the center of the diaphragm valve 235*a* receives the action of the spring member 235*g* and is deformed so as to project upward and the annular convex 235*m* formed at the center of the diaphragm valve 235*a* abuts the annular abutment face 235*n* formed in the valving control chamber 235*h* and closes the exit port 235*i*, as indicated by the chain line in FIG. 34.

To print with the recording head 206, the rod 235*d* receives the drive force of an actuator (not shown) and is pulled downward, whereby the normally closed diaphragm valve 235*a* opens the exit port 235*i* formed in the valving control chamber 235*h* and is opened.

To execute the cleaning operation of the recording head, as described later, the diaphragm valve 235*a* also seals the nozzle orifices 206*a* of the recording head by the action of the capping unit 113 and in a negative pressure accumulation state, the diaphragm valve 235*a* is opened.

The described valve unit 235 can be opened by slightly pulling downward the center of the diaphragm valve 235*a* with the rod 235*d* and the diaphragm valve 235*a* can be closed by releasing the pulling of the rod 235*d*.

Therefore, the actuation force of the actuator required for the opening or closing operation of the valve unit 235 needs to be only a little.

The valve unit 235 is closed in a state in which the nozzle formation face 206*a* of the recording head 206 is sealed by the capping unit 113 and negative pressure is received from the suction pump; the valve unit 235 is opened in a state in which negative pressure is accumulated in the ink flow passage from the diaphragm valve 235*a* to the recording head 206.

Figure 35:
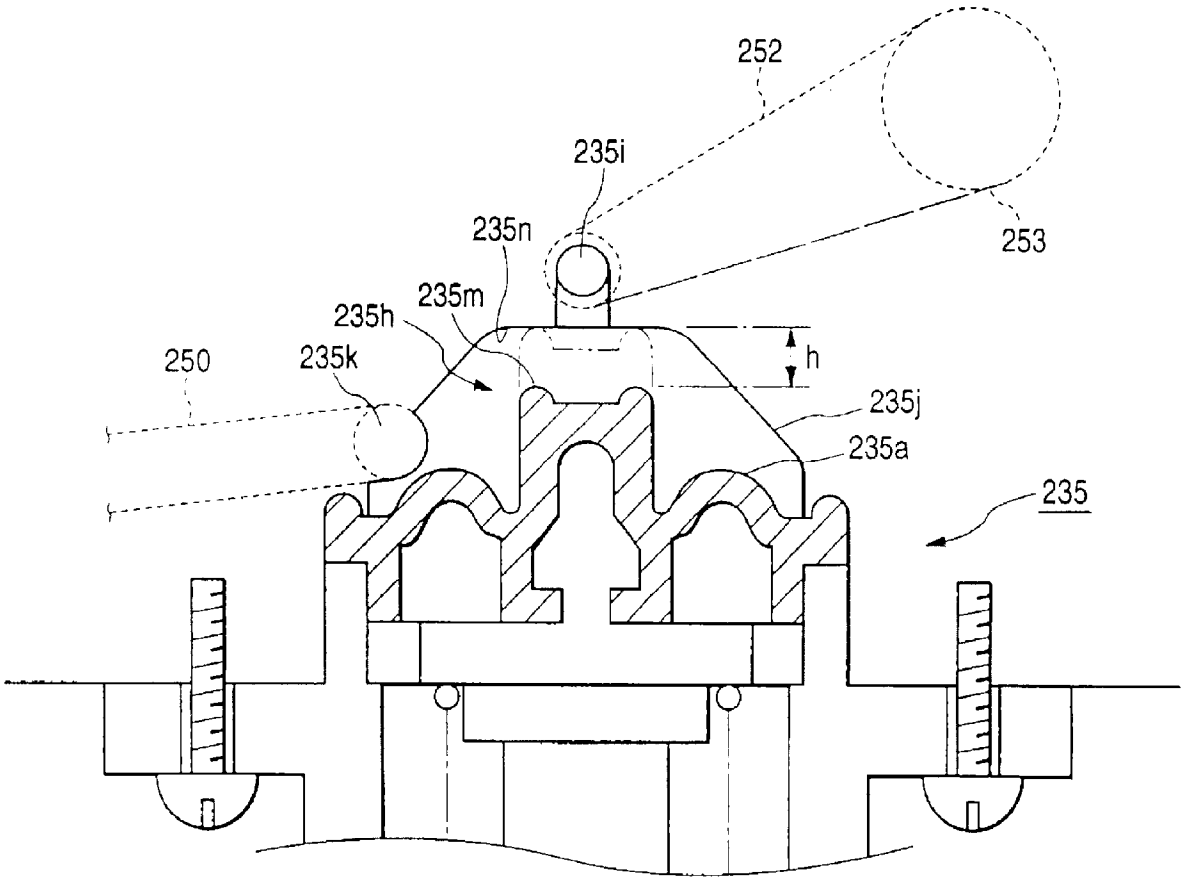
FIG. 35 is an enlarged sectional view of an open/closing control chamber portion to show a tenth embodiment of the valve unit.

Such an operation sequence is executed, whereby a fast ink flow can be generated in the ink flow passage instantaneously just after the valve unit 235 is opened, and air bubbles existing in the ink flow passage together with ink having increased viscosity, particularly air bubbles remaining in the valving control chamber 235*h* shown in FIG. 35 can be discharged into the side of the capping unit 113.

In this case, in the valve unit 235, the valving control chamber 235*h* is formed above the diaphragm valve 235*a* in the gravity direction, the exit port 235*i* from the valving control chamber 235*h* to the recording head 206 is formed just above almost the center of the diaphragm valve 235*a*, and the slope 235*j* whose diameter gradually lessens toward the anti-gravity direction is formed in the surrounding of the exit port 235*i*, so that the air bubbles remaining in the valving control chamber 235*h* can be guided into the vicinity of the exit port 235*i* by the float action.

Thus, it is made possible to enhance the discharge effect of the remaining air bubbles still more.

Since the annular convex 235*m* formed almost at the center of the diaphragm valve 235*a* facing the side of the valving control chamber 235*h* comes in intimate contact with the annular abutment face 235*n* formed in the valving control chamber 235*h* and closes the exit port 235*i* to the recording head, the annular convex 235*m* forms a flexible sealing face and the reliable valve opening/closing operation can be provided following the linear move operation of the rod 235*d*.

The annular abutment face 235*n* is made flat and preferably the face width is formed to the minimum width for allowing the annular convex 235*m* to come in intimate contact with the annular abutment face 235*n* when the diaphragm valve 235*a* is closed; this structure makes it possible to enhance the dischargeability of the air bubbles guided on the slope 235*j*.

According to the above-described configuration, if negative pressure is applied in the recording head capping state, the diaphragm valve 235*a* receives the negative pressure, the sealing property in the closed valve state is more enhanced, and the reliable valve closing function is maintained.

As the diaphragm valve is adopted, volume change of the recording head involved in the operation of opening and closing the valve can be made extremely small and a problem of destroying a meniscus of ink formed in the nozzle orifices of the recording head can be circumvented.

FIG. 35 shows a tenth embodiment of the valve unit 235; it is an enlarged sectional view of the valving control chamber 235*h* shown in FIG. 34.

Parts identical with or similar to those previously described with reference to FIG. 34 are denoted by the same reference numerals in FIG. 35.

In the embodiment shown in FIG. 35, the exit port 235*i* in the valving control chamber 235*h* is formed just above almost the center of the diaphragm valve 235*a*, and the entrance port 235*k* in the valving control chamber 235*h* from the ink storage section to the valving control chamber 235*h* is formed at a lower position in the gravity direction with respect to the exit port 235*i*.

The entrance port 235*k* is thus formed at a lower position in the gravity direction with respect to the exit port 235*i*, whereby an orderly ink flow can be generated in the valving control chamber 235*h* from the entrance port 235*k* to the exit port 235*i* of the upper part and the discharge action of the air bubbles remaining in the valving control chamber 235*h* can be promoted accordingly.

Preferably, a distance h between the annular abutment face 235*n* formed in the valving control chamber 235*h* and the convex 235*m* of the diaphragm valve 235*a* is set to 1.0 to 1.3 mm in the open state of the diaphragm valve 235*a* as shown in FIG. 35. If the distance h is less than 1.0 mm, a phenomenon in which the air bubbles remaining in the valving control chamber 235*h* are caught between the convex 235*m* of the diaphragm valve 235*a* and the annular abutment face 235*n* occurs, increasing the degree giving fault to the dischargeability of the air bubbles from the valving control chamber 235*h*.

If the distance h is less than 1.3 mm, when the diaphragm valve 235*a* is opened or closed, volume change of the valving control chamber 235*h* grows and particularly, useless pressure variation is given to the recording head 206.

On the other hand, as shown in FIGS. 34 and 35, the flow passage area of the ink derivation passage 252 from the exit port 235*i* in the valving control chamber 235*h* to the recording head is small just near the exit port 235*i* in the valving control chamber 235*h* and is increased as the ink derivation passage 252 is away from the valving control chamber 235*h*.

According to the configuration, the ink flow velocity at the exit port 235*i* in the valving control chamber 235*h* can be increased, contributing to enhancement of the dischargeability of the air bubbles in the valving control chamber 235*h*.

In the description of the above embodiments, the recording apparatus using the subtank for receiving supply of ink from the main tank and temporarily storing the ink as the ink storage section is taken as an example. For example, if the embodiment is adopted for a recording apparatus comprising an ink cartridge mounted directly on a carriage, similar advantages can be provided, needless to say.

Generally, top lid members of ink cartridges, subtanks, etc., are formed each with an air introduction port, thus an ink solvent is gradually evaporated through the air introduction port and the viscosity of the ink in the ink cartridge, the subtank, etc., is increased; this is a problem.

As a solution to the problem, it is considered that a valve unit placed in the flow passage between the ink cartridge, the subtank, etc., and a recording head and a valve placed in the air introduction port are both closed when they are not used.

However, if the ink cartridge or the subtank is hermetically sealed, the ink cartridge or the subtank (ink storage section) is broken, ink drips occur from the recording head, or air flows in through a recording head nozzle because of internal pressure change of the ink storage section caused by temperature change, namely, new problems occur and need to be solved.

An eleventh embodiment of the ink jet recording apparatus described below solves the technical problems.

In the embodiment described below, the ink storage section may be an ink cartridge or a subtank. First, an example of ink jet recording apparatus comprising a subtank as the ink storage section will be discussed.

Figure 36:
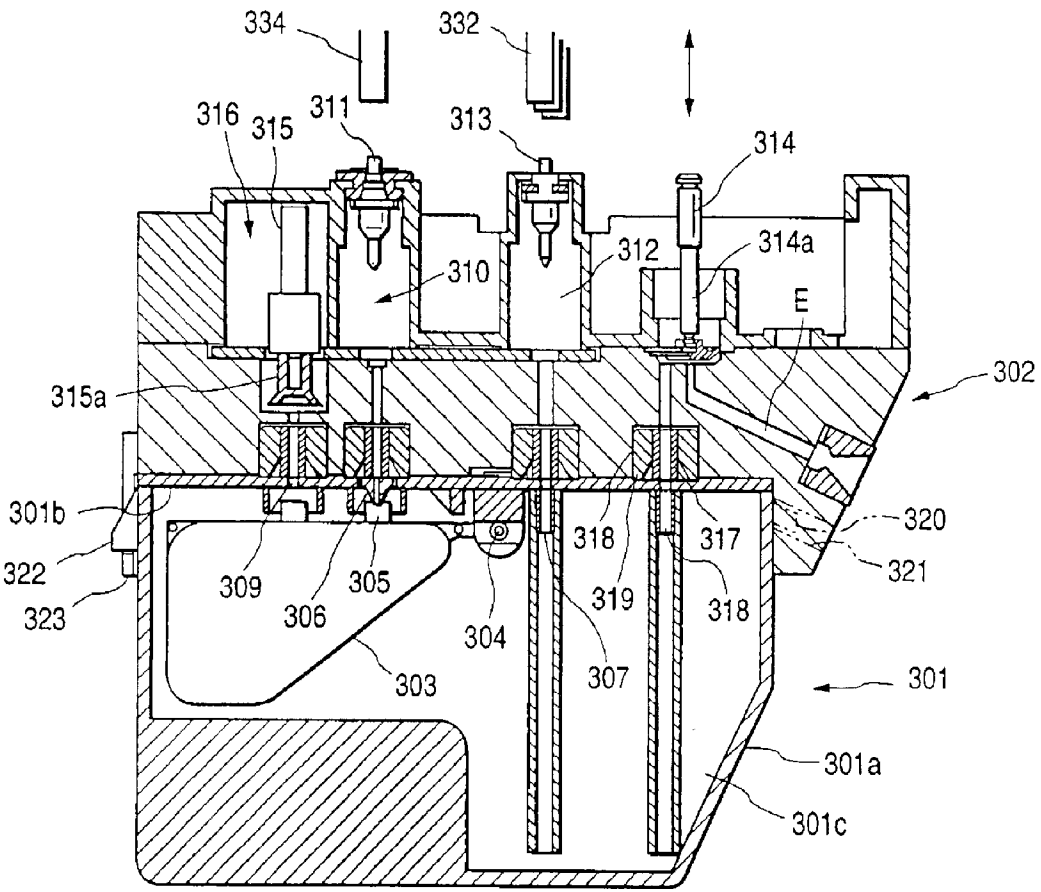
FIG. 36 is a sectional view to show the configuration of an eleventh embodiment of ink jet recording apparatus of the invention.

FIG. 36 is a sectional view to show the configuration of a subtank and a connecting unit on the subtank side in the eleventh embodiment.

A subtank 301 and a connecting unit 302 attached onto the subtank 301 are mounted on a carriage together with a recording head (described later) and are reciprocated in the width direction of recording paper (not shown).

Supply of ink is received from a main tank through the connecting unit 302 and ink can be supplied to the recording head.

The subtank 301 shown in the lower haft portion of FIG. 36 comprises a case 301*a* opened on the top and a lid 301*b* for closing the top, thereby forming an ink storage chamber 301 c whose inside is hermetically sealed.

A float member 303 floated up due to ink stored in the subtank 301 is placed in the subtank 301.

The float member 303 can be moved up and down in the gravity direction with a support shaft 304 formed integrally with the float member 303 as the rotation center.

A sealing member 305 is placed in an upper part of the subtank 301. It is floated up due to ink stored in the subtank 301 and abuts a valve body 306 forming an air valve placed in an upper part of the subtank 301, thereby closing a suction passage leading to a decompressor pump as described later.

An ink replenishment port 307 for receiving supply of ink from the main tank (described later) through the connecting unit 302 shown in the upper half portion is placed in the float member 303 and the subtank 301 is formed with an ink supply port 308 for supplying ink to the recording head (described later) through the connecting unit 302.

Further, an air introduction port 309 is placed in an upper part of the subtank 301 and air can be introduced through the air introduction port 309 as ink is consumed with printing.

Although FIG. 36 shows the configuration of one subtank, a plurality of subtanks of the same configuration (in the embodiment, six subtanks) are placed side by side in an orthogonal direction to the paper face corresponding to handled inks.

On the other hand, a common valve unit 311 connected to the decompressor pump through a suction space (also called suction port) 310 communicating with the valve body 306 is placed on the connecting unit 302.

The suction spaces 310 are formed communicating with crosswise corresponding to the subtanks in the orthogonal direction to the paper face and therefore the suction space 310 can be connected to a different connecting unit (described later) placed at an ink supply stage via the common valve unit 311.

The valve unit 311 is opened in connection to the different connecting unit placed at the ink supply stage.

In the connecting units 302, replenishment spaces 312 each for feeding ink into the ink replenishment port 307 are formed separately in a one-to-one correspondence with the subtanks 301, connection can be made to the different connecting unit (described later) placed at the ink supply stage via the valve unit 313 placed in each replenishment space 312.

Each valve unit 313 is also opened in connection to the different connecting unit placed at the ink supply stage.

In the connecting units 302, valve units 314 each opened and closed in the ink flow passage from the ink supply port 308 to the recording head are placed separately in a one-to-one correspondence with the subtanks 301.

When ink is supplied to the subtank 301 or power is turned off, the valve unit 314 is closed; otherwise, for example, during the printing, the valve unit 314 is opened for supplying ink to the recording head.

That is, when ink is supplied to the subtank 301 or power is turned off, a valve body 314*a* of the valve unit moves down, blocking an ink flow passage E for hermetically sealing ink in the recording head and in the ink flow passage E on the recording head side.

Otherwise, the valve body 314*a* is at an upper position and the ink flow passage E is opened, so that ink is supplied to the recording head.

Further, in the connecting units 302, air introduction valves 315 each opened and closed facing the air introduction port 309 are placed separately in a one-to-one correspondence with the subtanks 301.

When ink is supplied to the subtank 301 or power is turned off, the air introduction valve 315 is also closed; otherwise, for example, during the printing, the air introduction valve 315 is opened for placing the inside of the subtank 301 under atmospheric pressure for supplying ink to the recording head.

That is, when ink is supplied to the subtank 301 or power is turned off, a valve body 315*a* moves down, blocking the air introduction port 309 for hermetically sealing the subtank 301; otherwise, the valve body 315*a* is at an upper position and the subtank 301 communicates with the atmosphere.

The air introduction valve 315 is provided with a coil spring (not shown); when the pressure in the subtank 301 rises, the air introduction valve 315 is opened against the urging force of the coil spring.

An air introduction space 316 via the air introduction valve 315 is formed communicating with crosswise, and a part of the air introduction space 316 is opened to the atmosphere although not shown.

Between the subtank 301 and the connecting unit 302, for example, as shown in the structure of the portion of the ink supply port 308, a connection pipe extended in one piece from the subtank 301 is connected to an annular flexible sealing member 319 placed in a recess 318 formed in the connecting unit 302 so that it is pressed into the flexible sealing member 319.

This structure is also provided likewise in the ink replenishment port 307, the valve body 306, and the air introduction port 309.

In the embodiment shown in FIG. 36, a projection 320 formed from one side wall of the subtank 301 is inserted into an engagement hole 321 made in the connecting unit 302 and an engagement claw 323 formed on the connecting unit climbs over a projection 322 formed from an opposite side wall of the subtank 301, so that the subtank 301 and the connecting unit 302 are joined in one piece.

Figure 37:
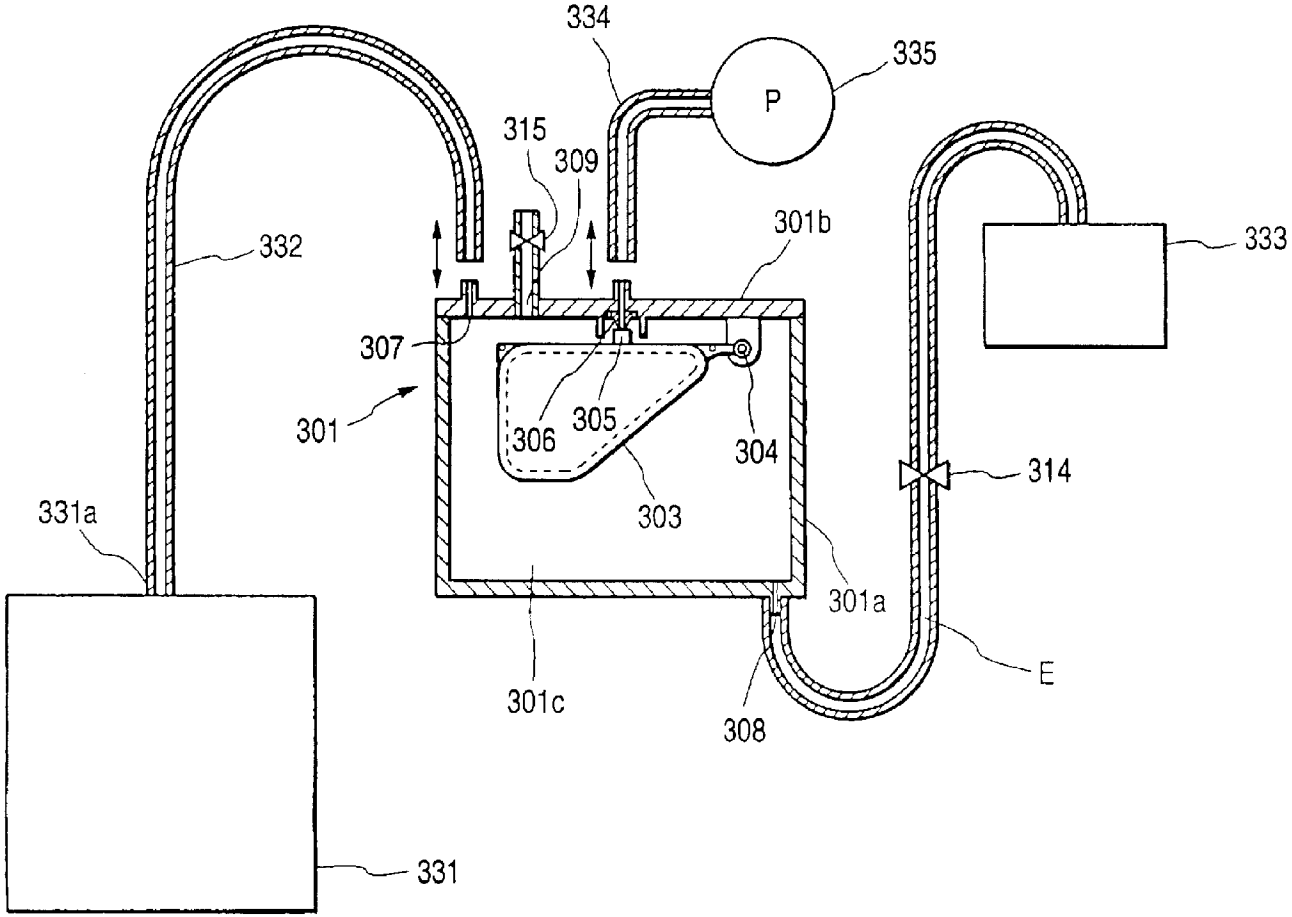
FIG. 37 is a schematic drawing to show the configuration of an ink supply system from a main tank to a recording head in the recording apparatus in FIG. 36.

FIG. 37 is a schematic drawing to show the basic configuration of one ink supply system for supplying ink from an ink cartridge as a main tank via the above-described subtank to a recording head.

In FIG. 37, the connecting unit 302 on the subtank side shown in FIG. 36 and the connecting unit at the ink supply stage (described later) connected to the connecting unit 302 are omitted.

In FIG. 37, numeral 331 denotes a main tank. The main tank 331 is loaded into a cartridge holder placed, for example, on the outside of the recording apparatus for supplying ink to the subtank 301 mounted on the carriage via an ink flow passage 332.

Also shown in FIG. 36, ink is supplied from the subtank 301 via the valve unit 314 to a recording head 333 and further the subtank 301 is also connected to a decompressor pump 335 via a common suction passage 334 communicating with the valve body 306 placed in the subtank 301.

Figure 38:
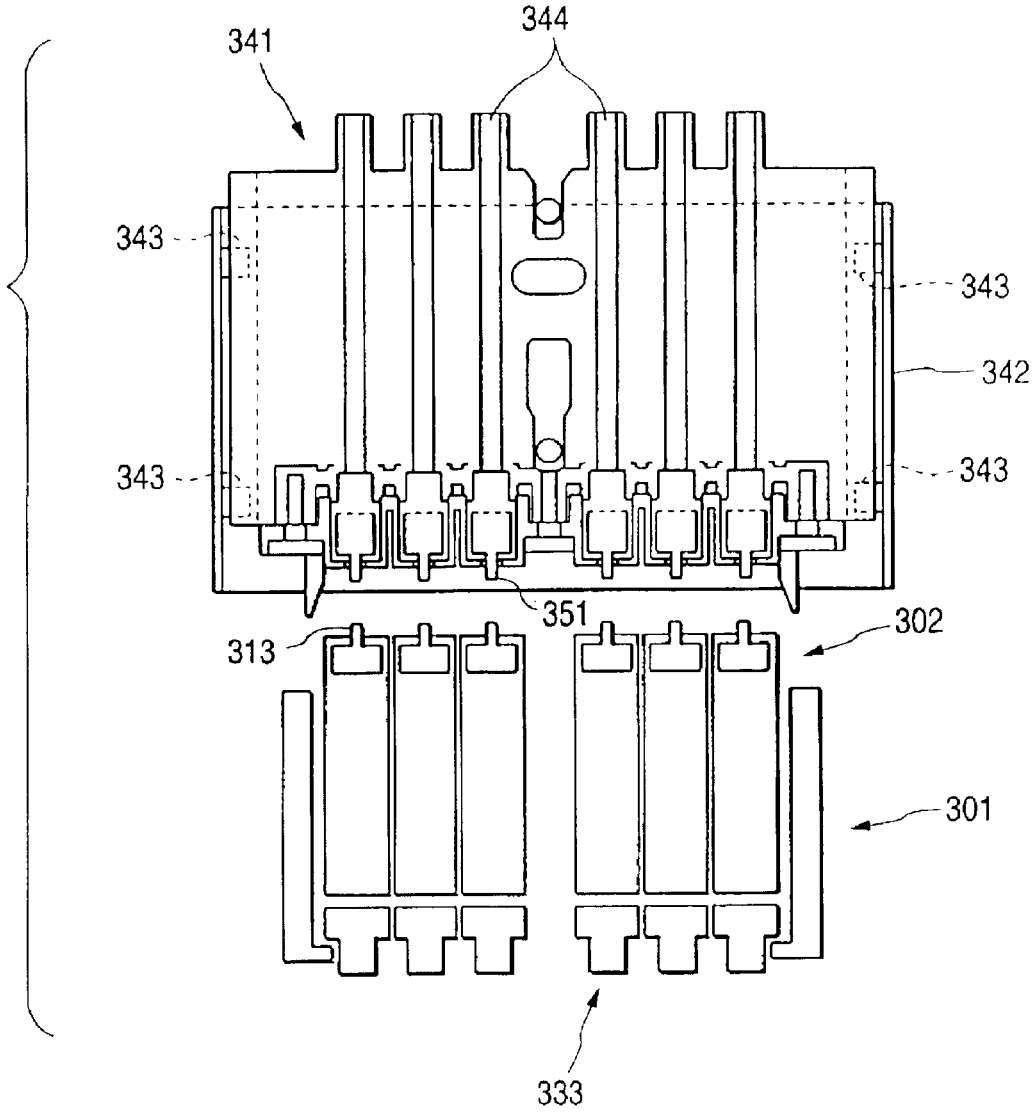
FIG. 38 is a side view to show the configuration of connecting units placed at an ink supply stage.

Next, FIG. 38 shows the configuration of connecting units placed between the main tank 331 and the subtank 301.

FIG. 38 draws six subtanks 301, the connecting units placed corresponding to the six subtanks 301, and a connecting unit 341 on the ink supply side placed at the ink supply stage.

That is, FIG. 38 shows a state viewed from a direction orthogonal to FIG. 36.

The connecting unit 341 on the ink supply side can be moved up and down by means of four guide projections 343 placed inward in a guide case 342. It is moved up and down in a predetermined range by a connecting unit drive motor (described later).

The connecting unit 341 is formed at upper end parts with connection openings 344, and opposite ends of ink flow passages 332 connected at one ends to the main tanks 333 storing six color inks are connected to the connection openings 344.

Figure 39:
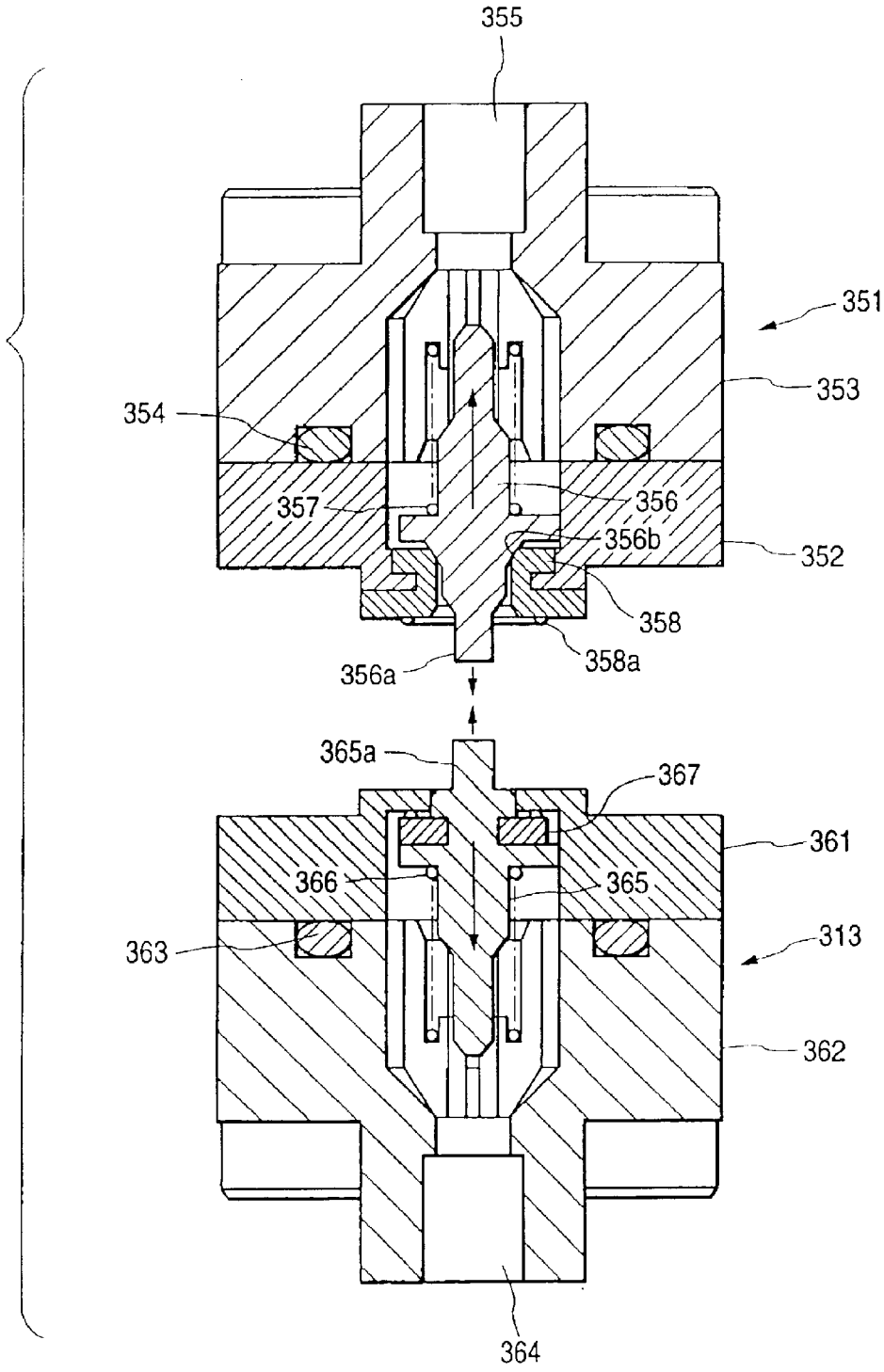
FIG. 39 is a sectional view to show the forms of valve units placed in the connecting units shown in FIG. 38.

Valve units 351 later described with reference to FIG. 39 are placed at lower end parts of the connecting unit 341.

On the other hand, the connecting units 302 are also placed on the sides of the subtanks 301 as previously described with reference to FIG. 36, and valve units 313 later described with reference to FIG. 39 are also placed at upper end parts of the connecting unit 302.

Although not shown in the figure, a suction passage connecting unit for connecting or disconnecting the suction passage 334 to the decompressor pump 335 and the suction port 310 is installed. Also in the connecting unit, connection or disconnection can be executed by a drive motor.

FIG. 39 is a sectional view to show the forms of the valve unit 351 in the connecting unit 341 placed at the ink supply stage and the valve unit 313 placed on the side of the subtank 301.

FIG. 39 shows a state in which both the valve units are separated from each other.

First, the valve unit 351 on the ink supply passage side comprises an outer hull formed by joining first and second cylindrical cases 352 and 353 axially, and an O-ring 354 is placed therebetween for placing the joint part in a hermetic state.

An opening 355 made in the upper end part in the figure communicates with the main tank through the connecting unit 341.

A rod 356 formed with a convex 356*a* on the connection end face side is placed slidably in the axial direction in the axial center part of the cylindrical cases 352 and 353. The convex 356*a* of the rod 356 is urged so as to project to the connection end face side (downward in the figure) by a coil spring 357 placed between a flange formed on the rod 356 and the second case 353.

The rod 356 is formed in a part with a tapered portion 356*b* and in the projection state of the rod 356, slopes of the tapered portion 356*b* are abutted against a sealing member 358.

Therefore, in the state shown in FIG. 39, the tapered portion 356*b* of the rod 356 can abut on the slopes the sealing member 358, providing sufficient hermeticity.

A part of the sealing member 358 is extended to the end face side in one piece and when both the valve units are connected, the end face of each valve unit is sealed by an extension 358*a* on the end face side.

According to such a shared structure, the number of parts of the sealing member 358 can be made one.

On the other hand, the valve unit 313 on the subtank side also comprises an outer hull formed by joining first and second cylindrical cases 361 and 362 axially, and an O-ring 363 is placed therebetween for placing the joint part in a hermetic state.

An opening 364 made in the lower end part in the figure communicates with the subtank side.

A rod 365 formed with a convex 365*a* on the connection end face side is placed slidably in the axial direction in the axial center part of the cylindrical cases 361 and 362. The convex 365*a* of the rod 365 is urged so as to project to the connection end face side (upward in the figure) by a coil spring 366 placed between a flange formed on the rod 365 and the second case 362.

A flat sealing member 367 formed like a ring is attached to the flange formed on the rod 365 and is abutted against the inner wall face of the cylindrical case 361 by the urging force of the coil spring 366, providing hermeticity.

In the projection state of the rod 365, the axial joint faces are brought into intimate contact with each other between the rod 365 and the cylindrical case 361 on the connection end face so as to prevent a gap from occurring therebetween.

According to the configuration, ink can be effectively prevented from remaining on the joint face.

It is desirable that the spring forces of the coil springs 357 and 366 are in rough balance.

As the spring forces of both the coil springs are in rough balance, the rods 356 and 365 move almost at the same time and at travel distances of the same degree and an ink flow passage is formed between the rods 356 and 365.

In the described configuration, as the print operation is continued, when the ink amount in the subtank 301 shown in FIG. 36 decreases and the ink end condition is reached, the float member 303 is sunk through the shaft 304.

Then, the carriage moves to the ink supply stage and the connecting units 302 on the sides of the subtanks 301 and the connecting unit 341 on the ink supply side placed at the ink supply stage are connected as shown in FIG. 38.

Although not shown in the figure, the suction port of the valve unit 306 is connected to the suction passage 334 leading to the decompressor pump 335 through a similar connecting unit.

In this state, the valve unit 314 from the subtank 301 to the recording head 333 is closed and the air introduction valve 315 is also closed. Thus, the convexs 356*a* and 365*a* of the valve units 351 and 313 shown in FIG. 39 strike against each other and the rods 356 and 365 move, whereby ink can be distributed.

On the other hand, the sealing member 305 placed on the float member 303 is away from the valve body 306, so that the inside of the subtank 301 is placed in a reduced pressure state by the operation of the decompressor pump 335.

Therefore, ink is supplied from the main tank 331 through the valve units 351 and 313 to the subtank 301.

When ink is thus supplied from the main tank 331 to the subtank 301 and the subtank is almost filled up with ink, the float member 303 floats up due to the ink and the sealing member 305 abuts the valve body 306 accordingly, placing the air valve in a closed valve state.

At this time, the sealing member 305 is sucked by the decompressor pump 335 and is brought into intimate contact with the valve body 306, and reducing pressure in the subtank 301 is stopped.

Therefore, ink supply from the main tank 331 to the subtank 301 is also stopped.

When all subtanks fill with inks, the connecting unit 341 placed at the ink supply stage and the connecting units 302 placed on the subtanks 301 are disconnected.

Thus, the valve units 351 and 313 placed in the connecting unit 341 placed at the ink supply stage and the connecting units 302 placed on the subtanks 301 are separated.

Therefore, the rods 356 and 365 placed in the valve units 351 and 313 are restored to the former state by the urging forces of the coil springs 357 and 366, and the ink flow passages in the valve units 351 and 313 are closed.

Thus, a phenomenon in which ink is leaked from the connection end part in the valve units 351 and 313 can be prevented.

In this state, the valve body 314*a* rises, the valve unit 314 from the subtank 301 to the recording head 333 is opened, the valve body 315*a* also rises, the air introduction valve 315 is also opened, and printing with the recording head 333 is started.

When the print operation with the recording head 333 is thus executed and ink in the subtank 301 decreases accordingly, ink is supplied at the ink supply stage in a similar manner to that described above and again the print operation with the recording head 333 is executed.

Figure 40:
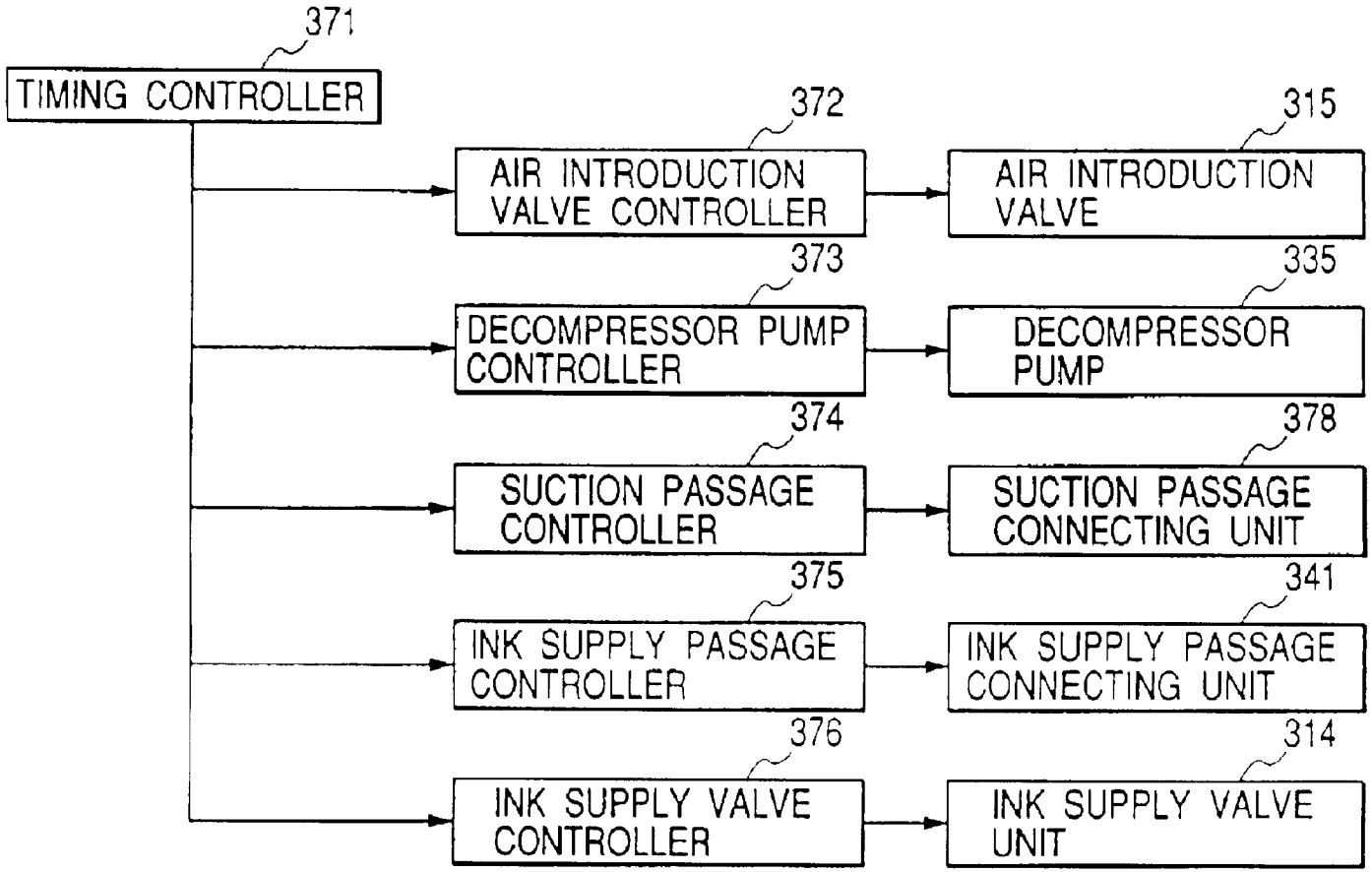
FIG. 40 is a block diagram to show the basic configuration of a control circuit for controlling an air introduction valve, an ink supply valve in a valve unit, etc., in the recording apparatus shown in FIG. 36.

Next, FIG. 40 is a block diagram to show the basic configuration of a control circuit for controlling the operation of the valve unit 314, the air introduction valve 315, the decompressor pump 335, the ink flow passage connecting unit 341, etc., with the passage of time.

The control circuit comprises a timing controller 371 for supplying command signals to an air introduction valve controller 372, a decompressor pump controller 373, a suction passage controller 374, an ink flow passage controller 375, and a valve unit controller 376.

The air introduction valve controller 372 receives a command and the air introduction valve 315 is opened or closed under the control of the air introduction valve controller 372. The decompressor pump controller 373 receives a command and the decompressor pump 335 is driven or stopped under the control of the decompressor pump controller 373.

A suction passage connecting unit 378 for connecting or disconnecting the decompressor pump 335 and the suction port 310 is placed in a connection state or a disconnection state under the control of the suction passage controller 374. The ink flow passage connecting unit 341 is placed in a connection state to or a disconnection state from the subtank side under the control of the ink flow passage controller 375.

The valve unit 314 is opened or closed under the control of the valve unit controller 376.

First, when the subtank becomes an ink end condition and the subtank is filled with ink, the timing controller 371 sends a valve closing command to the valve unit controller 376 and sends a drive command signal to the decompressor pump controller 373 after the expiration of a predetermined time.

Thus, after the valve unit 314 is closed, driving the decompressor pump 335 is started.

Under such control, the valve unit 314 is already closed before the inside of the subtank 301 is placed in a reduced pressure state by driving the decompressor pump 335. Therefore, a problem of sucking air from the nozzle orifices of the recording head and destroying a meniscus formed in the nozzle orifices can be prevented.

Likewise, the inside of the subtank 301 is also placed in a reduced pressure state by sending a connection command to the suction passage controller 374 after the expiration of a predetermined time. Also in this case, the valve unit 314 is already closed and therefore the problem of sucking air from the nozzle orifices of the recording head can be prevented.

Further, upon completion of filling the subtank with ink, the timing controller 371 sends a valve opening command to the air introduction valve controller 372 and sends a valve opening command to the valve unit controller 376 after the expiration of a predetermined time.

Thus, the air introduction valve 315 is first opened and the reduced pressure remaining in the subtank is canceled, resulting in the atmospheric pressure.

Since the valve unit 314 is opened, the problem of sucking air from the nozzle orifices of the recording head can also be prevented.

A drive stop signal is first sent to the decompressor pump controller 373 without sending a valve opening command to the air introduction valve controller 372, whereby the decompressor pump 335 is also stopped and the reduced pressure remaining in the subtank through the decompressor pump 335 is canceled during the expiration of a predetermined time, resulting in the atmospheric pressure.

Since the valve unit 314 is then opened, the problem of sucking air from the nozzle orifices of the recording head can also be prevented.

The open and closing states of the valve units 314, 313, and 311 and the air introduction valve 315 during printing are as follows:

The valve unit 314 is maintained open to supply ink to the recording head 333, the valve units 311 and 313 are closed, and the air introduction valve 315 is maintained open to place the inside of the subtank 301 under the atmospheric pressure.

If the printing terminates and a non-print state is entered (for example, power is turned off), the timing controller 371 shown in FIG. 40 sends a valve closing command to the valve unit controller 376, which then causes the valve body 314*a* in the valve unit 314 to move down, blocking the ink flow passage E for hermetically sealing ink in the recording head 333 and in the ink flow passage E on the recording head 333 side.

Consequently, evaporation of a solvent from ink in the hermetically sealed subtank 301 is prevented and an increase in viscosity of ink is suppressed.

The timing controller 371 sends a valve closing command to the air introduction valve controller 372, which then causes the valve body 315*a* in the air introduction valve 315 to move down, closing the air introduction port 309 for hermetically sealing the subtank 301.

Consequently, evaporation of a solvent from ink in the hermetically sealed subtank 301 is prevented and an increase in viscosity of ink is suppressed.

If the power is turned off, the valve units 311 and 313 are maintained closed as in the printing.

Then, if the power is turned on, as ink is supplied to the subtank, the timing controller 371 sends a valve opening command to the air introduction valve controller 372 and sends a valve opening command to the valve unit controller 376 after the expiration of a predetermined time.

Thus, the air introduction valve 315 is first opened and the reduced pressure remaining in the subtank is canceled, resulting in the atmospheric pressure.

Since the valve unit 314 is then opened, the problem of sucking air from the nozzle orifices of the recording head can also be prevented.

The subtank 301 is provided with means for detecting internal pressure (not shown) and if the pressure in the subtank 301 becomes a predetermined pressure or more or less in the power off state, the air introduction valve 315 is opened preceding the valve unit 314.

If the air introduction valve 315 is opened, preferably the valve unit 314 is maintained closed.

Since the air introduction port 309 is opened, if the outside temperature rises and the pressure in the subtank 301 becomes high because of expansion of ink or air or if the outside temperature lowers and the pressure in the subtank 301 becomes low, breakage of the subtank 301 can be prevented.

Ink drips from the recording head or inflow of air from the recording head can also be prevented.

If the pressure in the subtank 301 reaches a predetermined pressure or more or becomes a predetermined pressure or less, the valve unit 311 provided on the subtank side of the pump connecting unit may be opened preceding the valve unit 314.

Since the valve unit 311 provided on the subtank side of the pump connecting unit is thus opened preceding the valve unit 314, breakage of the subtank 301 can be prevented as the air introduction port 309 is opened.

Ink drips from the recording head or inflow of air from the recording head can also be prevented.

If the valve unit 311 provided on the subtank side of the pump connecting unit is opened, preferably the valve unit 314 is maintained closed.

Likewise, if the pressure in the subtank 301 reaches a predetermined pressure or more or becomes a predetermined pressure or less, the valve unit 313 provided on the subtank side of the main tank connecting unit may be opened preceding the valve unit 314.

If the urging force of the coil spring 366 of the valve unit 313 on the subtank side is set so as to open the valve unit 313 on the subtank side if the pressure in the subtank 301 becomes a predetermined pressure or less and if the force closing the air introduction valve 315 (the urging force of coil spring (not shown)) is set to open the air introduction valve 315 if the pressure in the subtank 301 reaches a predetermined pressure or more, the pressure in the subtank 301 can be prevented from abnormally rising or lowering and breakage of the subtank 301 can be prevented without providing the subtank 301 with the internal pressure detector.

Also in this case, preferably the valve unit 314 is maintained closed.

Thus, if the pressure in the subtank becomes the predetermined pressure or more, the air introduction valve 315 for closing the air introduction port 309 is opened based on the pressure difference between the inside and the outside of the subtank and if the pressure in the subtank becomes the predetermined pressure or less, the valve unit 313 provided on the subtank side of the pump connecting unit is opened based on the pressure difference between the inside and the outside of the subtank, so that the subtank 301 need not be provided with the means for detecting internal pressure, and breakage of the subtank 301 can be prevented according to the simple configuration.

Further, if the urging force of the coil spring of the valve unit 311 on the main tank side, like that of the coil spring 366, is set so as to open the valve unit 311 on the subtank side if the pressure in the subtank 301 becomes a predetermined pressure or less and if the force closing the air introduction valve 315 is set to open the air introduction valve 315 if the pressure in the subtank 301 reaches a predetermined pressure or more, the pressure in the subtank 301 can be prevented from abnormally rising or lowering and breakage of the subtank 301 can be prevented as with the valve unit 313 on the subtank side described above.

Also in this case, preferably the valve unit 314 is maintained closed.

Thus, if the pressure in the subtank becomes the predetermined pressure or more, the air introduction valve 315 for closing the air introduction port 309 is opened based on the pressure difference between the inside and the outside of the subtank and if the pressure in the subtank becomes the predetermined pressure or less, the valve unit 313 provided on the subtank side of the main tank connecting unit is opened based on the pressure difference between the inside and the outside of the subtank, so that breakage of the subtank 301 can be prevented according to the simple configuration as described above.

Next, a twelfth embodiment of the invention will be discussed with reference to FIG. 41 by taking an ink jet recording apparatus using an ink cartridge as an example.

Figure 41:
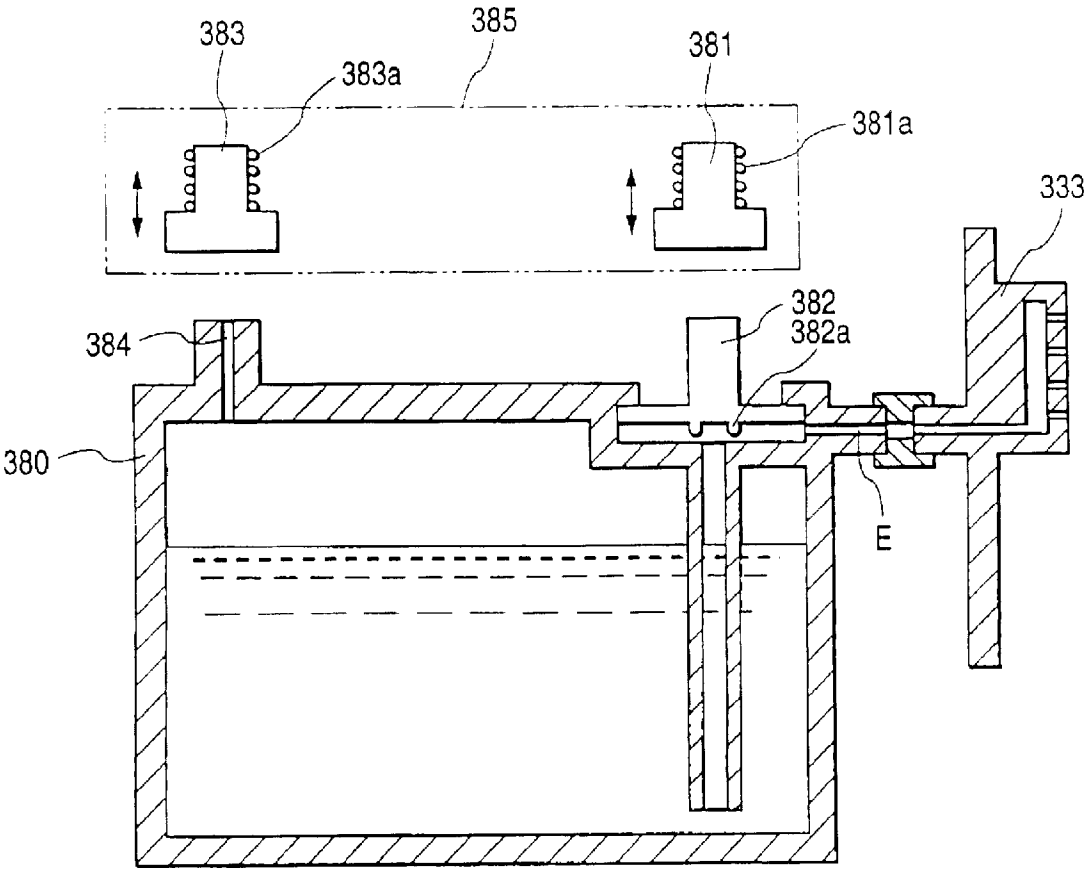
FIG. 41 is a sectional view to show the configuration of twelfth embodiment of the recording apparatus shown in FIG. 38.

In FIG. 41, numeral 380 denotes a cartridge mounted on a carriage (not shown) together with a recording head 333. A valve body 382 for opening and closing an ink flow passage E and an air introduction port 384 are placed in the top face of the ink cartridge 380.

A rod 381 that can be moved up and down is placed above the valve body 382. As the rod 381 moves down, the valve body 381 is pushed down, blocking the ink flow passage E.

The rod 381 is provided with a spring 381*a* for pressing the valve body 382 by a constant force.

The valve body 382 is provided on the bottom face with a coil spring (not shown) for pushing up the valve body 382 so as to open the ink flow passage E if the rod 381 moves up.

Further, a shield rod 383 that can be moved up and down is placed above the air introduction port 384. The shield rod 383 covers the air introduction port 384, thereby blocking the inside of the ink cartridge 380 from the atmosphere.

Like the rod 381, the shield rod 383 is also provided with a spring 383*a* for shielding the air introduction port 384 by a constant force.

If an internal pressure more than the above-mentioned press pressure occurs in a subtank, the air introduction port 384 is opened.

The spring 383*a* used has a smaller spring constant than the spring 381*a* and if a predetermined pressure is reached, the air introduction port 384 is first opened.

Since the air introduction port 384 is thus opened preceding the ink flow passage E, ink drips from the nozzle of the recording head 333, etc., can be prevented.

The operation of the rod 381 and the shield rod 383 is controlled by a controller 385.

That is, upon completion of printing, when the recording head 333 returns to the home position and power off is detected, the rod 381 and the shield rod 383 are moved down under the control of the controller 385, blocking the ink flow passage E and closing the air introduction port 384.

The ink flow passage E is blocked, thereby hermetically sealing ink in the recording head 333 and in the ink flow passage E on the recording head 333 side.

Consequently, evaporation of a solvent from ink hermetically sealed is prevented and an increase in viscosity of ink is suppressed.

The air introduction port 384 is closed, whereby the ink cartridge is hermetically sealed. Consequently, evaporation of a solvent from ink in the hermetically sealed ink cartridge is prevented and an increase in viscosity of ink is suppressed.

When the internal pressure of the ink cartridge becomes high, the shield rod 383 moves up against the urging force of the spring 383*a*, opening the air introduction port 384 to the atmosphere.

Consequently, breakage of the ink cartridge, inflow of air from the nozzle of the recording head, ink drips, etc., caused by pressure change of the ink cartridge can be prevented.

Then, if the power is turned on, preferably the air introduction port 384 is opened before the ink flow passage E is opened.

Figure 42:
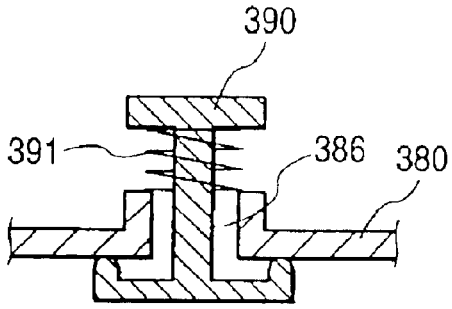
FIG. 42 is a sectional view to show a modified example of a valve used with the configuration shown in FIG. 41.
Figure 43:
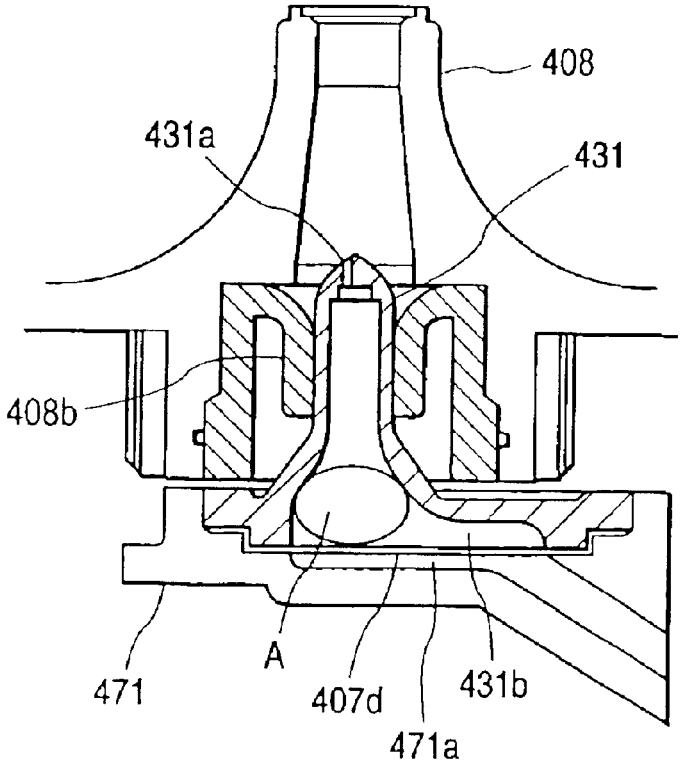
FIG. 43 is a sectional view to show a partial configuration of an ink cartridge placement mechanism in an ink jet recording apparatus in a related art

Preferably, the ink cartridge 380 is furthermore provided with a check valve 390 as shown in FIG. 42 for opening and closing a second air introduction port 386.

The second air introduction port 386 may be closed by the check valve 390 at the normal time with a coil spring 391 and when the internal pressure of the ink cartridge 380 becomes a predetermined pressure or less, the second air introduction port 386 may be opened for preventing breakage of the ink cartridge 380.

In the embodiments, so-called electromagnetic valves can be used as the valve units and the air introduction valves, but the valves may any valves if they are capable of opening and closing the ink flow passages and the air introduction ports; for example, they may be check valves, etc., mechanically operating.

In the description of the embodiments, the subtanks and the ink cartridges are hermetically closed in the power off state. However, if the print halt state continues exceeding a constant time in the power on state, preferably the subtanks and the ink cartridges are hermetically closed; the invention can also be applied to this case.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink jet recording apparatus comprising:

an ink jet recording head having nozzle orifices from which inkdrops are ejected;

an ink storage unit for storing ink to be supplied to the recording head;

an ink flow passage communicating the ink storage unit and the recording head;

a valve unit for opening/closing the ink flow passage;

a capping unit for sealing the nozzle orifices;

a suction pump for reducing pressure in an internal space of the capping unit to discharge inkdrops from the nozzles when the capping unit seals the nozzle orifices; and a control unit for controlling the valve unit, the capping unit and the suction pump to perform a normal operation of cleaning after an initial filling operation of the ink jet recording head, in such order that:

the suction pump decompresses the internal space of the capping unit under a condition that the valve unit closes the ink flow passage and the capping unit seals the nozzle orifice; and the valve unit opens the ink flow passage after the suction pump stops decompressing the internal space of the capping unit.

2. A cleaning control method, for an ink jet recording apparatus which comprises:

an ink jet recording head having nozzle orifices from which inkdrops are ejected;

an ink storage unit for storing ink to be supplied to the recording head;

an ink flow passage communicating the ink storage unit and the recording head;

a valve unit for opening/closing the ink flow passage;

a capping unit for sealing the nozzle orifices; and a suction pump for reducing pressure in an internal space of the capping unit to discharge inkdrops from the nozzles when the capping unit seals the nozzle orifices, orifices;

the cleaning control method comprising performing a normal operation of cleaning after an initial filling operation of the ink jet recording head by performing the steps of:

sealing the nozzle orifices by the capping unit;

closing the ink flow passage by the valve unit;

driving the suction pump to decompress the internal space of the capping unit; and opening the ink flow passage by the valve unit when a predetermined time period elapses after the suction pump is stopped driving.

3. The cleaning control method as set forth in claim 2, wherein the predetermined time period is defined as either a time period required for obtaining a satisfactory deaeration degree of ink between the valve unit and the nozzle orifices, or a time period required for accumulation air bubbles therein.

* * * * *